US010157538B2

(12) United States Patent
McNabb et al.

(10) Patent No.: US 10,157,538 B2
(45) **Date of Patent: *Dec. 18, 2018**

(54) MODULAR GARAGE DOOR OPENER

(71) Applicant: TTI (MACAO COMMERCIAL OFFSHORE) LIMITED, Macau (MO)

(72) Inventors: William McNabb, Anderson, SC (US); Mark Huggins, Anderson, SC (US); J. Porter Whitmire, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

This patent is subject to a terminal disclaimer.

(21) Appl. No.: 15/964,962

(22) Filed: Apr. 27, 2018

(65) Prior Publication Data

US 2018/0247523 A1 Aug. 30, 2018

Related U.S. Application Data

(63) Continuation of application No. 15/462,305, filed on Mar. 17, 2017, now Pat. No. 9,978,265.
(Continued)

(51) Int. Cl.
*G08C 17/02* (2006.01)
*G07C 9/00* (2006.01)

(52) U.S. Cl.
CPC ..... *G08C 17/02* (2013.01); *G07C 9/00182* (2013.01); *G07C 9/00857* (2013.01); *G08C 2201/92* (2013.01)

(58) Field of Classification Search
CPC ..... G08C 17/02; G08C 2201/92; G08C 2201/62; G07C 9/00182; G07C 9/00857; G07C 2009/00253; G07C 2009/00492
See application file for complete search history.

(56) References Cited

U.S. PATENT DOCUMENTS 1,557,856 A 10/1925 Luebbing
1,682,655 A 8/1928 Armour
(Continued)

FOREIGN PATENT DOCUMENTS

CA 2589760 9/1999
CA 2590140 9/1999
(Continued)

OTHER PUBLICATIONS

Doorking Inc., "Models 6050 and 6100 Vehicular Swing Gate Operator's Owner Manual," 2000 (53 pages).
(Continued)

*Primary Examiner* — Brian E Miller
(74) *Attorney, Agent, or Firm* — Michael Best & Friedrich LLP

(57) ABSTRACT

A modular garage door opener system includes an accessory device including a first electronic processor, a first memory, and a load, and includes a garage door opener including an accessory port, a second memory, and a second electronic processor. The accessory port is configured to be removably coupled to the accessory device. The second electronic processor receives new status data from the accessory device indicating a change in a status of the accessory device to a new status, sends the new status data to a remote server to update an accessory data set, receives new settings data from the remote server indicating a requested change in a setting of the accessory device, and sends the new settings data to the accessory device to update the setting of the accessory device. The first electronic processor controls the load of the accessory device based on the new settings data.

20 Claims, 28 Drawing Sheets

Related U.S. Application Data

(60) Provisional application No. 62/321,188, filed on Apr. 11, 2016.

(56) References Cited

U.S. PATENT DOCUMENTS

| | | | |
|---|---|---|---|
| 2,096,839 | A | 10/1937 | Barlow |
| 2,184,654 | A | 12/1939 | Small |
| 2,585,773 | A | 2/1952 | Hartman |
| 2,689,726 | A | 9/1954 | Purdy |
| 3,254,450 | A | 6/1966 | Schneider |
| 3,719,005 | A | 3/1973 | Carli |
| 3,780,949 | A | 12/1973 | Gavin |
| 3,996,957 | A | 12/1976 | Goldish et al. |
| 4,064,404 | A | 12/1977 | Willmott et al. |
| 4,338,526 | A | 7/1982 | Martin et al. |
| 4,360,801 | A | 11/1982 | Duhame |
| 4,366,482 | A | 12/1982 | Remes et al. |
| 4,426,639 | A | 1/1984 | Jessup |
| 4,433,274 | A | 2/1984 | Duhame |
| 4,464,651 | A | 8/1984 | Duhame |
| 4,538,661 | A | 9/1985 | Henry et al. |
| 4,614,057 | A | 9/1986 | Sorber |
| 4,665,378 | A | 5/1987 | Heckethorn |
| 4,738,052 | A | 4/1988 | Yoshida |
| 4,750,118 | A | 6/1988 | Heitschel |
| 4,750,295 | A | 6/1988 | Court et al. |
| 4,801,250 | A | 1/1989 | Lammers |
| D300,036 | S | 2/1989 | Mariol |
| 4,809,633 | A | 3/1989 | Santos |
| 4,821,024 | A | 4/1989 | Bayha |
| 4,835,410 | A | 5/1989 | Bhagwat et al. |
| 4,840,212 | A | 6/1989 | Wei |
| 4,847,542 | A | 7/1989 | Clark et al. |
| D303,394 | S | 9/1989 | Mariol |
| 4,904,880 | A | 2/1990 | Yoshida |
| 4,915,594 | A | 4/1990 | Lammers |
| 4,946,096 | A | 8/1990 | Ballard et al. |
| 5,086,385 | A | 2/1992 | Launey et al. |
| RE33,898 | E | 4/1992 | Santos |
| 5,109,222 | A | 4/1992 | Welty |
| 5,130,977 | A | 7/1992 | May |
| 5,140,583 | A | 8/1992 | May |
| 5,144,153 | A | 9/1992 | Scheppmann, II |
| 5,168,911 | A | 12/1992 | Gottschalk |
| D334,269 | S | 3/1993 | Jones et al. |
| 5,205,793 | A | 4/1993 | Jones |
| 5,226,256 | A | 7/1993 | Fries et al. |
| D340,724 | S | 10/1993 | Mariol |
| 5,281,782 | A | 1/1994 | Conatser |
| 5,282,337 | A | 2/1994 | Duhame et al. |
| 5,349,980 | A | 9/1994 | Spiegel |
| 5,369,913 | A | 12/1994 | Brickner |
| 5,430,720 | A | 7/1995 | Larsson |
| 5,510,975 | A | 4/1996 | Ziegler et al. |
| 5,576,739 | A | 11/1996 | Murphy |
| 5,589,747 | A | 12/1996 | Utke |
| 5,603,416 | A | 2/1997 | Richardson et al. |
| 5,609,300 | A | 3/1997 | Conatser |
| 5,639,219 | A | 6/1997 | Conatser |
| 5,687,897 | A | 11/1997 | Fa et al. |
| 5,699,967 | A | 12/1997 | Conatser et al. |
| 5,752,343 | A | 5/1998 | Quintus |
| 5,780,734 | A | 7/1998 | Johnson |
| 5,781,107 | A | 7/1998 | Ji |
| 5,785,228 | A | 7/1998 | Fa et al. |
| 5,793,300 | A | 8/1998 | Suman |
| 5,829,492 | A | 11/1998 | Gavronsky et al. |
| 5,832,974 | A | 11/1998 | Jou |
| 5,836,639 | A | 11/1998 | Kleefeldt et al. |
| D401,944 | S | 12/1998 | Campbell |
| D402,997 | S | 12/1998 | Campbell et al. |
| 5,844,328 | A | 12/1998 | Furst |
| 5,867,005 | A | 2/1999 | Brown |
| 5,872,513 | A | 2/1999 | Fitzgibbon |
| 5,877,957 | A | 3/1999 | Bennett |
| 5,883,579 | A | 3/1999 | Schreiner |
| 5,947,814 | A | 9/1999 | Czeck et al. |
| 5,969,637 | A | 10/1999 | Doppelt et al. |
| 6,002,346 | A | 12/1999 | Bowden et al. |
| 6,014,307 | A | 1/2000 | Crimmins |
| 6,019,084 | A | 2/2000 | Haynes et al. |
| 6,020,703 | A | 2/2000 | Telmet |
| 6,025,785 | A | 2/2000 | Farris |
| 6,027,148 | A | 2/2000 | Shoemaker |
| 6,036,109 | A | 3/2000 | DeYoung |
| 6,036,595 | A | 3/2000 | Vole |
| D422,603 | S | 4/2000 | DeYoung |
| 6,049,598 | A | 4/2000 | Peter et al. |
| 6,051,947 | A | 4/2000 | Lhotak et al. |
| 6,061,602 | A | 5/2000 | Meyer |
| 6,067,595 | A | 5/2000 | Lindenstruth |
| 6,068,203 | A | 5/2000 | DeYoung et al. |
| D427,282 | S | 6/2000 | Bower et al. |
| D427,283 | S | 6/2000 | Bower et al. |
| 6,070,361 | A | 6/2000 | Paterno |
| D428,470 | S | 7/2000 | Bower et al. |
| 6,084,358 | A | 7/2000 | Dolson |
| 6,089,626 | A | 7/2000 | Shoemaker |
| D429,313 | S | 8/2000 | Bower et al. |
| D429,314 | S | 8/2000 | Bower et al. |
| 6,102,667 | A | 8/2000 | Johnson |
| 6,124,822 | A | 9/2000 | Wu |
| D432,138 | S | 10/2000 | Scarth et al. |
| 6,133,703 | A | 10/2000 | Fitzgibbon et al. |
| D434,048 | S | 11/2000 | Orschell et al. |
| 6,154,150 | A | 11/2000 | Laubach |
| 6,166,634 | A | 12/2000 | Dean |
| 6,181,095 | B1 | 1/2001 | Telmet |
| 6,183,224 | B1 | 2/2001 | Conatser |
| 6,184,787 | B1 | 2/2001 | Morris |
| 6,191,706 | B1 | 2/2001 | Kositkun |
| 6,192,282 | B1 | 2/2001 | Smith et al. |
| D439,819 | S | 4/2001 | Bass et al. |
| 6,218,956 | B1 | 4/2001 | Davis |
| 6,218,962 | B1 | 4/2001 | Fiene |
| D441,561 | S | 5/2001 | Stoppenhagen et al. |
| D441,628 | S | 5/2001 | Bass et al. |
| 6,227,815 | B1 | 5/2001 | Chandra et al. |
| 6,229,276 | B1 | 5/2001 | Fitzgibbon et al. |
| D444,365 | S | 7/2001 | Bass et al. |
| D446,043 | S | 8/2001 | Stoppenhagen et al. |
| D446,433 | S | 8/2001 | Bass et al. |
| 6,278,249 | B1 | 8/2001 | Fitzgibbon |
| 6,310,548 | B1 | 10/2001 | Stephens, Jr. et al. |
| 6,328,223 | B1 | 12/2001 | Holt et al. |
| 6,346,889 | B1 | 2/2002 | Moss |
| 6,357,338 | B2 | 3/2002 | Montgomery |
| 6,375,430 | B1 | 4/2002 | Eckert et al. |
| 6,386,833 | B1 | 5/2002 | Montgomery |
| 6,386,969 | B1 | 5/2002 | O'Brien |
| 6,431,839 | B2 | 8/2002 | Gruber et al. |
| 6,435,076 | B2 | 8/2002 | Montgomery |
| 6,443,715 | B1 | 9/2002 | Mayleben et al. |
| 6,447,257 | B2 | 9/2002 | Orschell |
| D464,471 | S | 10/2002 | Burdsall et al. |
| D464,547 | S | 10/2002 | Bass et al. |
| 6,460,626 | B2 | 10/2002 | Carrier |
| 6,462,660 | B1 | 10/2002 | Cannon et al. |
| 6,464,531 | B2 | 10/2002 | Eckert et al. |
| 6,469,464 | B1 | 10/2002 | McCall |
| D465,981 | S | 11/2002 | Bass et al. |
| 6,484,784 | B1 | 11/2002 | Weik, III et al. |
| D469,672 | S | 2/2003 | Bass et al. |
| 6,522,258 | B1 | 2/2003 | Lott |
| 6,524,181 | B2 | 2/2003 | Wasson |
| 6,531,966 | B2 | 3/2003 | Krieger |
| 6,535,110 | B1 | 3/2003 | Arora |
| 6,553,336 | B1 | 4/2003 | Johnson et al. |
| 6,560,926 | B1 | 5/2003 | Gillett |
| 6,561,063 | B1 | 5/2003 | Mulford et al. |
| 6,561,233 | B2 | 5/2003 | Weems et al. |
| 6,563,278 | B2 | 5/2003 | Roman |
| 6,563,431 | B1 | 5/2003 | Miller, Jr. |
| D475,721 | S | 6/2003 | Harper et al. |

(56) References Cited

U.S. PATENT DOCUMENTS

| | | | |
|---|---|---|---|
| D476,061 | S | 6/2003 | Neal |
| 6,584,102 | B1 | 6/2003 | Lu |
| D477,384 | S | 7/2003 | Williams et al. |
| 6,593,856 | B1 | 7/2003 | Madau |
| D478,094 | S | 8/2003 | Scarth et al. |
| D478,095 | S | 8/2003 | Reger |
| D478,964 | S | 8/2003 | Williams et al. |
| 6,624,605 | B1 | 9/2003 | Powder et al. |
| 6,626,380 | B1 | 9/2003 | Williams et al. |
| D482,699 | S | 11/2003 | Graf et al. |
| 6,649,839 | B2 | 11/2003 | Eckert et al. |
| D484,571 | S | 12/2003 | Neal |
| 6,661,340 | B1 | 12/2003 | Saylor et al. |
| 6,661,350 | B1 | 12/2003 | Rohrberg |
| 6,669,114 | B1 | 12/2003 | Williams et al. |
| 6,670,725 | B2 | 12/2003 | Fitzgibbon et al. |
| D485,282 | S | 1/2004 | Scarth et al. |
| 6,676,382 | B2 | 1/2004 | Leighton et al. |
| 6,683,431 | B2 | 1/2004 | Fitzgibbon |
| 6,701,975 | B1 | 3/2004 | Neal |
| D488,082 | S | 4/2004 | Durr et al. |
| D489,736 | S | 5/2004 | Harper et al. |
| 6,748,061 | B2 | 6/2004 | Ahlstrom et al. |
| 6,752,433 | B2 | 6/2004 | Frost |
| D495,717 | S | 9/2004 | Harper et al. |
| 6,789,581 | B2 | 9/2004 | Cowan et al. |
| 6,792,321 | B2 | 9/2004 | Sepe, Jr. |
| D497,917 | S | 11/2004 | Harper et al. |
| 6,819,071 | B2 | 11/2004 | Graham et al. |
| D499,744 | S | 12/2004 | Orschell et al. |
| D500,331 | S | 12/2004 | Crisler, III et al. |
| D500,332 | S | 12/2004 | Crisler, III et al. |
| D501,146 | S | 1/2005 | Durr et al. |
| 6,853,313 | B2 | 2/2005 | Newcomer |
| 6,856,618 | B2 | 2/2005 | Strathmeyer |
| 6,860,065 | B2 | 3/2005 | Griffin et al. |
| D503,898 | S | 4/2005 | Durr et al. |
| 6,876,633 | B2 | 4/2005 | Strathmeyer |
| 6,878,889 | B1 | 4/2005 | Horst et al. |
| D504,903 | S | 5/2005 | Crisler, III et al. |
| D505,088 | S | 5/2005 | Durr et al. |
| 6,894,613 | B2 | 5/2005 | Stab |
| 6,897,406 | B2 | 5/2005 | Crisler, III et al. |
| D505,872 | S | 6/2005 | Durr et al. |
| 6,911,898 | B2 | 6/2005 | Chung |
| D507,279 | S | 7/2005 | Harper et al. |
| 6,917,288 | B2 | 7/2005 | Kimmell et al. |
| 6,918,291 | B2 | 7/2005 | Durr et al. |
| 6,920,718 | B2 | 7/2005 | Hom et al. |
| D508,930 | S | 8/2005 | Crisler, III et al. |
| 6,946,973 | B1 | 9/2005 | Yanda |
| D512,618 | S | 12/2005 | Bass et al. |
| 6,975,203 | B2 | 12/2005 | Brookbank |
| 6,982,652 | B2 | 1/2006 | Laird et al. |
| 6,989,760 | B2 | 1/2006 | Dierking et al. |
| D514,412 | S | 2/2006 | Lawrence et al. |
| 6,998,977 | B2 | 2/2006 | Gregori et al. |
| 7,000,251 | B2 | 2/2006 | DeYoung |
| 7,002,312 | B2 | 2/2006 | Wojciak, Jr. |
| 7,005,994 | B2 | 2/2006 | King |
| D517,934 | S | 3/2006 | Durr et al. |
| 7,015,790 | B1 | 3/2006 | Schrott et al. |
| 7,016,899 | B1 | 3/2006 | Stern et al. |
| 7,017,887 | B1 | 3/2006 | Verakis |
| D519,693 | S | 4/2006 | Ricker et al. |
| 7,031,325 | B1 | 4/2006 | Williams |
| D520,687 | S | 5/2006 | Ricker et al. |
| D521,694 | S | 5/2006 | Ricker et al. |
| 7,040,355 | B2 | 5/2006 | Wu |
| 7,042,492 | B2 | 5/2006 | Spinelli |
| 7,047,087 | B2 | 5/2006 | Hantke et al. |
| 7,049,980 | B1 | 5/2006 | Chemelewski |
| 7,057,547 | B2 | 6/2006 | Olmsted |
| 7,066,406 | B2 | 6/2006 | Williams et al. |
| D524,999 | S | 7/2006 | Ray |
| D525,432 | S | 7/2006 | Feldmann et al. |
| 7,072,688 | B2 | 7/2006 | Bodnar |
| D526,781 | S | 8/2006 | Feldmann et al. |
| D528,297 | S | 9/2006 | Feldmann et al. |
| 7,114,178 | B2 | 9/2006 | Dent et al. |
| 7,119,681 | B2 | 10/2006 | Eskildsen |
| 7,126,084 | B2 | 10/2006 | DeYoung |
| 7,140,179 | B2 | 11/2006 | Bass et al. |
| 7,140,598 | B2 | 11/2006 | Verakis et al. |
| 7,145,470 | B2 | 12/2006 | Hoermann |
| 7,146,345 | B2 | 12/2006 | Weik, III et al. |
| 7,153,418 | B2 | 12/2006 | Mauro, Sr. et al. |
| 7,155,213 | B1 | 12/2006 | Almeda |
| D534,698 | S | 1/2007 | Ray |
| D536,007 | S | 1/2007 | Bass et al. |
| 7,161,319 | B2 | 1/2007 | Ergun et al. |
| 7,161,498 | B1 | 1/2007 | Fan |
| D536,348 | S | 2/2007 | Bass |
| D536,707 | S | 2/2007 | Bass et al. |
| D536,708 | S | 2/2007 | Bass |
| 7,176,656 | B2 | 2/2007 | Feldmann |
| 7,183,933 | B2 | 2/2007 | Dzurko et al. |
| 7,194,412 | B2 | 3/2007 | Mays |
| 7,197,278 | B2 | 3/2007 | Harwood |
| 7,207,142 | B2 | 4/2007 | Mullet |
| 7,207,174 | B2 | 4/2007 | Montgomery et al. |
| 7,208,897 | B2 | 4/2007 | Hotto et al. |
| D542,538 | S | 5/2007 | Klein et al. |
| D543,361 | S | 5/2007 | Klein et al. |
| 7,224,275 | B2 | 5/2007 | Fitzgibbon |
| 7,262,572 | B2 | 8/2007 | Fitzgibbon |
| 7,265,508 | B1 | 9/2007 | Karasek et al. |
| 7,270,142 | B2 | 9/2007 | Acosta |
| 7,280,097 | B2 | 10/2007 | Chen |
| D557,898 | S | 12/2007 | Feldmann et al. |
| 7,302,775 | B2 | 12/2007 | Olmsted |
| 7,320,345 | B2 | 1/2008 | Matthews et al. |
| 7,337,016 | B2 | 2/2008 | Hantke et al. |
| 7,342,368 | B2 | 3/2008 | Roman |
| 7,345,574 | B2 | 3/2008 | Fitzgibbon |
| 7,382,063 | B2 | 6/2008 | Mullet et al. |
| 7,431,346 | B2 | 10/2008 | Frost et al. |
| D580,514 | S | 11/2008 | Bass et al. |
| D581,483 | S | 11/2008 | Bass et al. |
| 7,464,035 | B2 | 12/2008 | Funk et al. |
| 7,468,676 | B2 | 12/2008 | Styers et al. |
| 7,475,424 | B2 | 1/2009 | Lingafelt |
| 7,498,936 | B2 | 3/2009 | Maeng |
| 7,505,889 | B2 | 3/2009 | Salmonsen |
| 7,515,063 | B2 | 4/2009 | Brundula |
| 7,518,326 | B2 | 4/2009 | Shier et al. |
| 7,532,709 | B2 | 5/2009 | Styers et al. |
| 7,537,027 | B2 | 5/2009 | Bass et al. |
| 7,556,478 | B2 | 7/2009 | Klein et al. |
| D601,173 | S | 9/2009 | Wilmes et al. |
| 7,586,871 | B2 | 9/2009 | Hamilton |
| 7,602,283 | B2 | 10/2009 | John |
| D604,200 | S | 11/2009 | Fassold et al. |
| D605,919 | S | 12/2009 | Schneider et al. |
| D605,920 | S | 12/2009 | Schneider et al. |
| 7,635,966 | B2 | 12/2009 | Butler |
| D611,962 | S | 3/2010 | Schneider et al. |
| 7,673,075 | B1 | 3/2010 | Masiewicz |
| 7,677,476 | B2 | 3/2010 | Burdsall et al. |
| 7,681,032 | B2 | 3/2010 | Peled |
| 7,683,794 | B2 | 3/2010 | Contreras |
| 7,688,014 | B2 | 3/2010 | Tang |
| 7,710,284 | B2 | 5/2010 | Dzurko et al. |
| 7,739,647 | B2 | 6/2010 | Athani |
| D620,500 | S | 7/2010 | Brandt et al. |
| 7,755,223 | B2 | 7/2010 | Fitzgibbon |
| D622,739 | S | 8/2010 | Bass et al. |
| 7,778,207 | B2 | 8/2010 | Light |
| 7,778,604 | B2 | 8/2010 | Bauman |
| 7,786,619 | B2 | 8/2010 | Crusius et al. |
| 7,787,400 | B2 | 8/2010 | Light |
| 7,812,742 | B2 | 10/2010 | Pankowski |
| 7,813,114 | B2 | 10/2010 | Stewart et al. |
| 7,840,186 | B2 | 11/2010 | Franson |

(56) References Cited

U.S. PATENT DOCUMENTS 7,860,033 B2 12/2010 Light
7,869,582 B2 1/2011 Styers et al.
7,873,279 B2 1/2011 Alameh et al.
7,882,540 B2 2/2011 Lingafelt
7,884,869 B2 2/2011 Shurboff et al.
7,912,508 B2 3/2011 Lee et al.
7,913,889 B2 3/2011 Lawrence
D636,409 S 4/2011 Wilmes et al.
D636,792 S 4/2011 Parks et al.
D637,211 S 5/2011 Parks et al.
7,940,300 B2 5/2011 Spinelli
7,974,536 B2 7/2011 Yu et al.
7,983,451 B2 7/2011 Super et al.
7,996,231 B2 8/2011 Mays
8,004,555 B2 8/2011 Oswald et al.
8,007,110 B2 8/2011 Dunn et al.
8,015,997 B2 9/2011 Bass et al.
8,019,194 B2 9/2011 Morrison
8,023,478 B2 9/2011 Cam-Winget
8,026,946 B2 9/2011 Nassimi
8,027,277 B2 9/2011 Light
8,030,796 B2 10/2011 Fitzgibbon et al.
8,040,217 B2 10/2011 Fitzgibbon
8,058,841 B2 11/2011 Chander et al.
8,059,897 B2 11/2011 Xu et al.
8,061,573 B2 11/2011 Kramer
8,063,592 B2 11/2011 Shier et al.
8,066,205 B2 11/2011 Bass et al.
8,068,879 B2 11/2011 Bodas et al.
8,077,054 B1 12/2011 Aarons
8,086,781 B2 12/2011 Ananny
8,095,191 B2 1/2012 Gorsica et al.
8,102,844 B1 1/2012 Nelson
8,103,118 B2 1/2012 Foo et al.
8,111,133 B2 * 2/2012 Rodriguez ..... G07C 9/00182 340/5.7
8,132,929 B2 3/2012 Harton et al.
8,162,486 B2 4/2012 Borger et al.
8,174,274 B2 5/2012 Lawrence et al.
8,175,591 B2 5/2012 Fitzgibbon
8,179,473 B2 5/2012 Harmon et al.
8,180,336 B2 5/2012 Wesby
8,218,739 B2 7/2012 Styers et al.
8,223,217 B2 7/2012 Shurboff et al.
8,223,235 B2 7/2012 John
8,224,303 B2 7/2012 White
8,225,458 B1 7/2012 Hoffberg
8,231,247 B2 7/2012 Olmsted
8,237,383 B2 8/2012 Shier et al.
8,237,769 B2 8/2012 Crenshaw et al.
8,267,666 B2 9/2012 Gruber et al.
8,300,079 B2 10/2012 Tian
8,311,490 B2 11/2012 Witkowski
8,319,751 B2 11/2012 Challener et al.
8,325,040 B2 12/2012 Nassimi
8,330,570 B2 12/2012 Martin et al.
8,330,573 B2 12/2012 Crucs
8,373,555 B1 2/2013 Redden et al.
8,373,742 B2 2/2013 Wheatley et al.
8,375,913 B2 2/2013 Kwiecinski et al.
8,387,649 B2 3/2013 Parks et al.
8,410,930 B2 4/2013 Karasek et al.
8,419,379 B2 4/2013 Bass et al.
8,421,591 B2 4/2013 Karasek
8,430,184 B2 4/2013 Bass et al.
8,433,076 B2 4/2013 Zurek et al.
D682,651 S 5/2013 McRoberts et al.
D682,652 S 5/2013 McRoberts et al.
8,446,389 B2 5/2013 Challener et al.
8,466,808 B2 6/2013 Ghatak
8,494,224 B2 7/2013 Super et al.
8,494,861 B2 7/2013 Robb et al.
8,503,712 B2 8/2013 Ahmed et al.
8,504,574 B2 8/2013 Dvorak et al.
8,542,093 B2 * 9/2013 Rodriguez ..... G05B 19/042 340/5.51
8,558,885 B2 10/2013 Fitzgibbon
8,564,619 B2 10/2013 Alberth, Jr. et al.
8,576,179 B2 11/2013 Walliser et al.
8,576,372 B2 11/2013 Ji et al.
8,584,401 B2 11/2013 Planck et al.
8,587,404 B2 11/2013 Laird
8,589,968 B2 11/2013 Alberth et al.
8,593,471 B2 11/2013 Huang et al.
8,595,360 B2 11/2013 Hill et al.
8,620,841 B1 12/2013 Filson
8,626,593 B2 1/2014 Goldfinger
8,637,781 B2 1/2014 Derengowski et al.
8,638,951 B2 1/2014 Zurek et al.
8,643,467 B2 2/2014 Chutorash et al.
8,653,962 B2 2/2014 Maeng
8,682,388 B2 3/2014 Vuppu et al.
8,692,943 B2 4/2014 Tsuchihashi et al.
8,717,443 B2 5/2014 Kaehler et al.
8,726,324 B2 5/2014 Tirpak et al.
8,730,342 B2 5/2014 Shurboff et al.
8,760,406 B2 6/2014 Herrmann et al.
8,761,401 B2 6/2014 Sprunk et al.
8,761,815 B2 6/2014 Xu et al.
8,762,668 B2 6/2014 Taguchi
8,766,119 B2 7/2014 Cotha et al.
8,766,768 B2 7/2014 Martin et al.
8,767,533 B2 7/2014 Lu
8,786,435 B2 7/2014 Barnett
8,786,759 B2 7/2014 Wang et al.
8,788,676 B2 7/2014 Alameh et al.
8,797,274 B2 8/2014 Challener et al.
8,798,671 B2 8/2014 Grubb
8,810,433 B1 8/2014 Aarons
8,810,434 B2 8/2014 Aarons
8,817,951 B2 8/2014 Goffin et al.
8,818,461 B2 8/2014 Cybart et al.
8,841,988 B2 * 9/2014 Summerford ..... G07C 9/00182 340/5.64
8,842,180 B1 9/2014 Kasmir
8,842,885 B2 9/2014 Wang et al.
8,844,840 B2 9/2014 Lawrence
8,866,583 B2 10/2014 Ordaz
8,872,915 B1 10/2014 Scalisi
8,878,646 B2 11/2014 Chutorash et al.
8,890,823 B2 11/2014 Alameh et al.
8,896,533 B2 11/2014 Sonada et al.
8,896,753 B2 11/2014 Oozeki et al.
8,897,033 B2 11/2014 Slipy et al.
8,908,880 B2 12/2014 Zurek et al.
8,922,356 B2 12/2014 Lambert
8,922,696 B2 12/2014 Shibata et al.
8,933,877 B2 1/2015 Alameh
8,941,745 B2 1/2015 Tajima
8,953,082 B2 2/2015 Shimotono et al.
D724,923 S 3/2015 McRoberts et al.
8,994,496 B2 3/2015 Freese et al.
9,009,158 B2 4/2015 Tonegawa et al.
9,024,958 B2 5/2015 Nicholson et al.
9,077,716 B2 7/2015 Myers
9,099,021 B2 8/2015 Yu
9,110,635 B2 8/2015 Knox et al.
9,122,254 B2 9/2015 Cate et al.
9,134,887 B2 9/2015 Cudak et al.
9,141,099 B2 9/2015 Cate et al.
9,141,234 B2 9/2015 Nakamura et al.
9,161,000 B2 10/2015 Zhang et al.
9,163,845 B1 10/2015 Carlozzi
9,169,684 B2 10/2015 Fan et al.
9,185,275 B2 11/2015 Osborne et al.
9,189,952 B2 11/2015 Chutorash et al.
9,191,467 B2 11/2015 Triess
9,196,948 B2 11/2015 Yamamoto et al.
9,197,760 B2 11/2015 Karakaya et al.
9,213,659 B2 12/2015 Beaumont et al.
9,230,378 B2 * 1/2016 Chutorash ..... G07C 9/00182
9,235,830 B1 1/2016 VanBlon et al.
9,261,713 B1 2/2016 Weksler et al.

(56) References Cited

U.S. PATENT DOCUMENTS

D750,461 S 3/2016 McRoberts et al.
9,273,508 B2 3/2016 Manaras
9,277,175 B2 3/2016 Sano
9,284,771 B1 3/2016 Doherty
9,293,925 B2 3/2016 Heng et al.
9,297,464 B1 3/2016 Wang
9,304,591 B2 4/2016 Cromer et al.
9,310,886 B2 4/2016 McKenna et al.
9,328,834 B2 5/2016 Wang
9,333,945 B2 5/2016 Lin
9,351,271 B2 5/2016 Yang et al.
9,355,237 B2 5/2016 Peterson et al.
9,367,125 B2 6/2016 Gao et al.
9,376,851 B2 6/2016 Cate et al.
9,405,360 B2 * 8/2016 Ang ..... H04N 5/2251
9,406,360 B2 8/2016 Song
9,458,657 B2 10/2016 French et al.
9,559,545 B2 * 1/2017 Liu ..... H02J 50/90
9,600,950 B2 * 3/2017 Chutorash ..... G08C 17/00
9,728,020 B2 * 8/2017 Freese ..... G07C 9/00015
9,978,265 B2 5/2018 McNabb et al.
2002/0014954 A1 2/2002 Fitzgibbon et al.
2002/0108671 A1 8/2002 Campbell et al.
2002/0137543 A1 9/2002 Murnaghan
2002/0140576 A1 10/2002 Simon
2002/0180600 A1 12/2002 Kirkland et al.
2002/0183008 A1 * 12/2002 Menard ..... G07C 9/00182 455/66.1
2003/0025470 A1 2/2003 Fitzgibbon et al.
2003/0063715 A1 4/2003 Peplinski
2003/0063723 A1 4/2003 Booth et al.
2003/0160705 A1 8/2003 Guertz
2003/0211864 A1 11/2003 Bodnar
2004/0080424 A1 4/2004 Perry et al.
2004/0097264 A1 5/2004 Bodnar
2004/0099853 A1 5/2004 Verakis
2004/0143766 A1 7/2004 Fitzgibbon et al.
2004/0164693 A1 8/2004 Murray
2004/0194387 A1 10/2004 Hom et al.
2004/0210327 A1 10/2004 Robb
2004/0212335 A1 10/2004 Fitzgibbon
2004/0212498 A1 10/2004 Peterson et al.
2004/0216379 A1 11/2004 Gioia
2004/0239482 A1 12/2004 Fitzgibbon
2004/0239496 A1 12/2004 Fitzgibbon
2004/0257236 A1 12/2004 Klemish
2005/0012488 A1 1/2005 Fitzgibbon
2005/0012631 A1 1/2005 Gregori et al.
2005/0057100 A1 3/2005 Crusius et al.
2005/0057340 A1 3/2005 Fitzgibbon
2005/0109748 A1 5/2005 Albrecht et al.
2005/0134426 A1 6/2005 Mullet
2005/0176400 A1 8/2005 Mullet
2005/0184854 A1 8/2005 Mullet
2005/0207616 A1 9/2005 Brad et al.
2005/0212681 A1 9/2005 Dzurko
2005/0252613 A1 11/2005 Evans
2005/0253731 A1 11/2005 Fitzgibbon
2005/0269984 A1 12/2005 Piechowiak et al.
2005/0285553 A1 12/2005 Gregori
2006/0061313 A1 3/2006 Fitzgibbon et al.
2006/0103503 A1 5/2006 Rodriguez
2006/0108571 A1 5/2006 Verakis et al.
2006/0158339 A1 7/2006 Brundula
2006/0171453 A1 8/2006 Rohlfing et al.
2006/0179671 A1 8/2006 Ghatak
2006/0220785 A1 10/2006 Ferdman
2006/0220830 A1 10/2006 Bennett
2006/0238337 A1 10/2006 Minassian
2006/0255931 A1 11/2006 Hartsfield et al.
2007/0033932 A1 2/2007 Montgomery et al.
2007/0046232 A1 3/2007 Mullet
2007/0080933 A1 4/2007 Chen
2007/0080934 A1 4/2007 Chen
2007/0189911 A1 8/2007 Holt
2007/0229218 A1 10/2007 Nassimi
2007/0229220 A1 10/2007 Nassimi
2007/0235149 A1 10/2007 Hillar
2007/0252545 A1 11/2007 Callentine
2007/0253849 A1 11/2007 Holt
2007/0269318 A1 11/2007 Bass
2007/0273472 A1 11/2007 Gregori
2008/0079570 A1 4/2008 Fineman et al.
2008/0106370 A1 5/2008 Perez
2008/0194291 A1 8/2008 Martin
2008/0280551 A1 11/2008 Ashworth
2009/0124189 A1 5/2009 Barber
2009/0229190 A1 9/2009 Daniel-Wayman et al.
2009/0230768 A1 9/2009 Daniel-Wayman et al.
2009/0231093 A1 9/2009 Keller, Jr. et al.
2009/0231121 A1 9/2009 Daniel-Wayman et al.
2009/0231427 A1 9/2009 Fitzgibbon et al.
2009/0231434 A1 9/2009 Fitzgibbon et al.
2009/0313898 A1 12/2009 Manaras
2010/0058669 A1 3/2010 Cole
2010/0090796 A1 4/2010 Perez
2010/0108627 A1 5/2010 Lupinacci et al.
2010/0127882 A1 5/2010 Sitarski
2010/0156182 A1 6/2010 Mertel et al.
2010/0159846 A1 6/2010 Witkowski
2010/0166404 A1 7/2010 Lombardi
2010/0245040 A1 9/2010 Greves
2010/0258631 A1 10/2010 Rueblinger et al.
2010/0271202 A1 10/2010 Lin
2010/0315510 A1 12/2010 Dunn et al.
2010/0328219 A1 12/2010 Lombardi et al.
2011/0063101 A1 3/2011 Cristoforo
2011/0199234 A1 8/2011 Butler, III et al.
2011/0273378 A1 11/2011 Alameh et al.
2011/0278759 A1 11/2011 Sohn et al.
2011/0311052 A1 12/2011 Myers
2012/0020638 A1 1/2012 Morrison
2012/0036437 A1 2/2012 Alberth, Jr. et al.
2012/0059969 A1 3/2012 Chou
2012/0133485 A1 5/2012 Nassimi
2012/0133527 A1 5/2012 Lin
2012/0138189 A1 6/2012 Lunn
2012/0172027 A1 7/2012 Partheesh
2012/0188077 A1 7/2012 Sawyer
2012/0139701 A1 9/2012 Crucs
2012/0235785 A1 9/2012 Alberth et al.
2012/0242840 A1 9/2012 Nakfour et al.
2012/0258668 A1 10/2012 Rokusek et al.
2012/0260575 A1 * 10/2012 Monaco ..... E05F 15/72 49/13
2012/0327180 A1 12/2012 Thorson et al.
2013/0055641 A1 3/2013 Chen
2013/0063259 A1 3/2013 Kramer et al.
2013/0081329 A1 4/2013 French et al.
2013/0151977 A1 6/2013 Arteaga-King
2013/0152129 A1 6/2013 Alberth et al.
2013/0160036 A1 6/2013 Narasimhan et al.
2013/0179238 A1 7/2013 Warner
2013/0190052 A1 7/2013 Lundell
2013/0202130 A1 8/2013 Zurek et al.
2013/0202132 A1 8/2013 Zurek et al.
2013/0222137 A1 8/2013 Alameh et al.
2013/0286232 A1 10/2013 Sheh
2013/0293670 A1 11/2013 Ayoub et al.
2013/0308835 A1 11/2013 Thorson
2013/0322568 A1 12/2013 Pais et al.
2013/0326595 A1 12/2013 Myers
2014/0007505 A1 1/2014 Manaras
2014/0009461 A1 1/2014 Dai et al.
2014/0022108 A1 1/2014 Alberth, Jr. et al.
2014/0033773 A1 2/2014 Myers
2014/0078660 A1 3/2014 Dondzik et al.
2014/0085492 A1 3/2014 Petrescu
2014/0115360 A1 4/2014 Zhou et al.
2014/0117757 A1 5/2014 Tsui et al.
2014/0118111 A1 5/2014 Saladin
2014/0118240 A1 5/2014 Pais
2014/0118354 A1 5/2014 Pais et al.
2014/0122729 A1 5/2014 Hon

(56) References Cited

U.S. PATENT DOCUMENTS

| | | | | |
|---|---|---|---|---|
| 2014/0125499 | A1 | 5/2014 | Cate | |
| 2014/0145824 | A1 | 5/2014 | Chutorash | |
| 2014/0176387 | A1 | 6/2014 | Coles et al. | |
| 2014/0181338 | A1 | 6/2014 | Loh | |
| 2014/0184854 | A1 | 7/2014 | Musatenko | |
| 2014/0198466 | A1 | 7/2014 | Sawadski et al. | |
| 2014/0208128 | A1 | 7/2014 | Gyorfi et al. | |
| 2014/0239781 | A1 | 8/2014 | Allore et al. | |
| 2014/0240464 | A1 | 8/2014 | Lee | |
| 2014/0240469 | A1 | 8/2014 | Lee | |
| 2014/0241614 | A1 | 8/2014 | Lee | |
| 2014/0259927 | A1 | 9/2014 | MaNally | |
| 2014/0266593 | A1 | 9/2014 | Nye et al. | |
| 2014/0267716 | A1 | 9/2014 | Child et al. | |
| 2014/0268459 | A1 | 9/2014 | Robinson et al. | |
| 2014/0282923 | A1 | 9/2014 | Narayan et al. | |
| 2014/0299345 | A1 | 10/2014 | McRoberts et al. | |
| 2014/0320263 | A1 | 10/2014 | Fan | |
| 2014/0325124 | A1 | 10/2014 | Antonakopoulos | |
| 2014/0339329 | A1 | 11/2014 | Lawrence et al. | |
| 2014/0351617 | A1 | 11/2014 | Connell et al. | |
| 2014/0360744 | A1 | 12/2014 | Lawrence | |
| 2014/0372198 | A1 | 12/2014 | Goldfinger | |
| 2015/0015369 | A1 | 1/2015 | Lamb | |
| 2015/0087288 | A1 | 3/2015 | Dharawat et al. | |
| 2015/0148983 | A1 | 5/2015 | Fitzgibbon | |
| 2015/0179011 | A1 | 6/2015 | Kramer et al. | |
| 2015/0193999 | A1 | 7/2015 | Freese et al. | |
| 2015/0205363 | A1 | 7/2015 | Wu | |
| 2015/0275564 | A1 | 10/2015 | Rosenthal et al. | |
| 2015/0281658 | A1 | 10/2015 | Lee et al. | |
| 2015/0308425 | A1 | 10/2015 | Skotty | |
| 2015/0312531 | A1 | 10/2015 | Samad et al. | |
| 2015/0339031 | A1* | 11/2015 | Zeinstra | B60K 37/06 715/747 |
| 2015/0351145 | A1* | 12/2015 | Burks | G08C 17/02 455/41.3 |
| 2016/0014330 | A1 | 1/2016 | Deng et al. | |
| 2016/0018798 | A1 | 1/2016 | Jiang et al. | |
| 2016/0027262 | A1 | 1/2016 | Skotty et al. | |
| 2016/0053699 | A1 | 2/2016 | Ozkan | |
| 2016/0071348 | A1 | 3/2016 | Chutorash et al. | |
| 2016/0093180 | A1 | 3/2016 | Fitzgibbon et al. | |
| 2016/0117879 | A1 | 4/2016 | Chutorash et al. | |
| 2016/0148494 | A1 | 5/2016 | Kim | |
| 2016/0189513 | A1* | 6/2016 | Sloo | G08B 21/02 340/522 |
| 2016/0194912 | A1 | 7/2016 | Fitzgibbon et al. | |
| 2016/0210844 | A1 | 7/2016 | Kim | |
| 2016/0281411 | A1* | 9/2016 | Calagaz, Jr. | E05F 15/77 |
| 2016/0288647 | A1* | 10/2016 | Baur | B60Q 9/00 |
| 2017/0169636 | A1* | 6/2017 | Piche | G07C 9/00142 |
| 2017/0175433 | A1* | 6/2017 | Kang | E05F 15/77 |
| 2017/0294113 | A1 | 10/2017 | McNabb et al. | |
| 2017/0295658 | A1 | 10/2017 | Whitmire et al. | |
| 2018/0112454 | A1 | 4/2018 | Preus et al. | |
| 2018/0151006 | A1 | 5/2018 | Huggins et al. | |

FOREIGN PATENT DOCUMENTS

| | | |
|---|---|---|
| CA | 2369939 | 10/2000 |
| CA | 2390885 | 1/2003 |
| DE | 8409497 | 8/1984 |
| DE | 3420677 | 12/1985 |
| DE | 8802513 | 4/1988 |
| DE | 4028190 | 3/1992 |
| DE | 19649054 | 5/1998 |
| EP | 0881349 | 12/1998 |
| EP | 0882866 | 12/1998 |
| EP | 0995619 | 4/2000 |
| EP | 1006310 | 6/2000 |
| EP | 1790814 | 5/2007 |
| EP | 1985787 | 10/2008 |
| EP | 2608438 | 6/2013 |
| EP | 2645638 | 10/2013 |
| EP | 2803545 | 11/2014 |
| GB | 2238578 | 6/1991 |
| JP | 2004062548 | 2/2004 |
| JP | 2004162318 | 6/2004 |
| KR | 20100091821 | 8/2010 |
| WO | WO9939505 | 8/1999 |
| WO | WO0135577 | 5/2001 |
| WO | WO01093220 | 12/2001 |
| WO | WO2005104342 | 11/2005 |
| WO | WO2007028323 | 3/2007 |
| WO | WO2007047720 | 4/2007 |
| WO | WO2007082514 | 7/2007 |
| WO | WO2012092706 | 7/2012 |
| WO | WO2012171756 | 12/2012 |
| WO | WO2014146269 | 9/2014 |
| WO | WO2014158508 | 10/2014 |
| WO | WO2015031812 | 3/2015 |

OTHER PUBLICATIONS

Ryobi, "18 Volt, 1 Hour Charger P110 Operator's Manual," downloaded from <http://manuals.ryobitools.com/documents/2101> Aug. 28, 2015 (10 pages).

Ryobi, "GD200 Garage Door Opener Operator's Manual," published Feb. 18, 2016 (156 pages).

YouTube, "Ryobi Garage Door Opener," <https://www.youtube.com/watch?v=RMu0Kac79oE> published Apr. 4, 2016 (1 page).

International Search Report and Written Opinion for Application No. PCT/US2017/022998 dated Jun. 9, 2017 (9 pages).

Stuart, "New Ryobi Garage Door Opener and Modular Accessory System," <http://toolguyd.com/ryobi-garage-door-opener-modular-system/> 2016, (29 pages).

Image of Ryobi Garage Door Opener Booth at Mar. 17, 2016 Sales Show.

Ryobi, "GD200 Ultra-Quiet Garage Door Opener," Media Sheet Mar. 25, 2017 (2 pages).

Description of Video Published to YouTube.com of Ryobi ultra-quiet garage door opener on Apr. 4, 2016, and Provided to Third Parties Mar. 25, 2016 <https://www.youtube.com/watch?v=7bExdu51oEw>.

Ryobi Media Images Provided to Third Parties Mar. 25, 2016 (1 page).

Al-Ali et al., "Java-Based Home Automation System," IEEE Transactions on Consumer Electronics, vol. 50, Issue: 2, May 2004, pp. 498-504.

Borodulkin et al., "3D Virtual, Smart Home User Interface," International Symposium on Virtual and Intelligent Measurement Systems, May 2002 pp. 1-5.

Cena et al., "A Protocol for Automatic Node Discovery in CANopen Networks," IEEE Transactions on Industrial Electronics, vol. 50, No. 3, Jun. 2003.

D. Snoonian, "Smart Buildings," IEEE Spectrum, Aug. 2003, pp. 18-23.

Den Hartog et al., "Convergence of Residential Gateway Technology", IEEE Communications Magazine, pp. 138-143 vol. 42, Issue: 5, May 2004.

J. C. Lupo, "Smart Sensorweb," Battlespace Digitization and Network Centric Warfare, Proceedings of the SPIE, vol. 4396, 2001.

Jacobson, "Lowe's Iris to Launch First Ever UL-Compliant Z-Wave Garage Door Controller, <"http://www.cepro.com/article/lowes_iris_to_launch_first_ever_ul_compliant_zwave_garage_door_controller/> Dec. 2013 ( 3 pages).

Kensetsu Bousai, "Remote Manipulation Shutter," Apr. 1990 pp. 32-34.

Lee et al., "Network Configuration Technique for Home Appliances Based on LnCP," IEEE Transactions Consumer Electronics, vol. 49, No. 2, pp. 367-374, 2003.

Lee et al., "Network-Based Fire-Detection System via Controller Area Network for Smart Home Automation", IEEE Consumer Electronics Society, Nov. 2004.

Marples et al., "The Open Services Gateway Initiative: An Introductory Overview", IEEE Communications Magazine, pp. 110-114, 2001.

(56) References Cited

OTHER PUBLICATIONS

Nunes et al., "An Architecture for a Home Automation System," IEEE International Conference on Electronic Circuits System, pp. 259-262, 1998.
Odajima et al., "Parking Assistance Support System," Report No. 22, Dec. 2000, pp. 36-42.
R. Harper, "Inside the Smart Home," Springer-Verlag London Limited, 2003.
S. Chemishikan, "Building Smart Services for Smart Home," Proceedings of the IEEE 4th International Workshop on Networked Appliances, pp. 215-224, 2002.
Sarijari et al., "Wireless Home Security and Automation System Utilizing ZigBee Based Multi-Hop Communication," Proceedings of the IEEE 2208 6th National Conference on Telecommunication Technologies and IEEE 2008 2nd Malaysia Conference on Photonics, Aug. 26-27, 2008.
Sommer, Antriebe & Funk, "Drahtlose Kommunikation Und Information" 2007 (24 pages).
Sriskanthan et al., "Bluetooth Based Home Automation System," Microprocessors and Microsystems, vol. 26, pp. 281-289, 2002.
Tajika et al., "Networked Home Appliance System using Bluetooth Technology Integrating Appliance Control/Monitoring with Internet Service", IEEE Transactions on Consumer Electronics, pp. 1043-1048, vol. 49, Issue: 4, Nov. 2003.
Valtchev et al., "Service Gateway Architecture for a Smart Home," IEEE Communications Magazine, Apr. 2002.
Chowdhury et al., "Distributed Processing in the Home using a PC with a Wireless Speech Interface," IEEE International Conference on Acoustics, Speech, and Signal Processing. Proceedings, 1999, pp. 2363-2366.
Rao et al., "iMobile: A Proxy-Based Platform for Mobile Services," Wireless Mobile Internet, 2001 (9 pages).
Spinellis et al., "The Information Furnace: User Friendly Home Control," Proceedings of the 3rd International System Administration and Networking Conference SANE 2002, pp. 145-174.
Wang et al., "The SIMBA User Alert Service Architecture for Dependable Alert Delivery," IEEE Xplore Conference: Conference: Dependable Systems and Networks, 2001 pp. 1-11.
Wang et al., "Towards Dependable Home Networking: An Experience Report," Technical Report, Microsoft Research Microsoft Corporation, 2000, (7 pages).
White, "How Computers Work," Que, 1999 pp. 210-213.
United States Patent Office Action for U.S. Appl. No. 15/976,160 dated Aug. 9, 2018, 6 pages.

* cited by examiner

MODULAR GARAGE DOOR OPENER

CROSS-REFERENCE TO RELATED APPLICATIONS

This application is a continuation of U.S. patent application Ser. No. 15/462,305, filed on Mar. 17, 2017, which claims priority to U.S. Provisional Patent Application No. 62/321,188, filed on Apr. 11, 2016, the entire contents of which are incorporated herein by reference.

FIELD OF THE INVENTION

The present invention relates to garage door openers, and more particularly to garage door openers with accessories.

SUMMARY OF THE INVENTION

The present invention provides, in one aspect, a modular garage door opener system including an accessory device having a first electronic processor, a first memory, and a load that is controllable by the first electronic processor, a garage door opener having a motor configured to drive a garage door to open and close, an accessory port, a second memory, and a second electronic processor. The accessory port is configured to be removably coupled to the accessory device such that the accessory device is in electrical communication with the accessory port. The second electronic processor is coupled to the second memory and is configured to execute instructions stored in the second memory to receive new status data from the accessory device indicating a change in a status of the accessory device to a new status, send the new status data to a remote server to update an accessory data set, receive new settings data from the remote server indicating a requested change in a setting of the accessory device, and send the new settings data to the accessory device to update the setting of the accessory device and, thereby, control the load of the accessory device.

The present invention provides, in another aspect, a communication method for a garage door opener including an accessory port configured to receive an accessory device. The method includes the garage door opener receiving the accessory device in the accessory port. The method also includes the garage door opener receiving, from the accessory device, an initial data set including a unique identifier for the accessory device, an initial status indicating a status of the accessory device, and an initial setting indicating a setting of the accessory device. The method also includes the garage door sending, by an electronic processor of the garage door opener, the initial data set to a remote server for storage as an accessory data set. The method also includes the garage door opener receiving, by the electronic processor, new status data from the accessory device indicating a change in the status of the accessory device to a new status. The method also includes the garage door opener sending, by the electronic processor, the new status data to the remote server to update the accessory data set. The method also includes the garage door receiving, by the electronic processor, new settings data from the remote server indicating a requested change in the setting of the accessory device. The method also includes the garage door opener sending, by the electronic processor, the new settings data to the accessory device to update the setting of the accessory device.

The present invention provides, in another aspect, a communication method for an accessory device configured to be coupled to an accessory port of a garage door opener.

The method includes the accessory device receiving power from the accessory port upon being coupled to the accessory port. The method also includes the accessory device sending to the garage door opener, by an electronic processor of the accessory device, an initial data set including a unique identifier for the accessory device, an initial status indicating a status of the accessory device, and an initial setting indicating a setting of the accessory device. The method also includes the accessory device receiving, by the electronic processor, new settings data, from the garage door opener, to update the setting of the accessory device. The method also includes controlling, by the electronic processor, a load of the accessory device in response to the new settings data. The method also includes sending, by the electronic processor, new status data, to the garage door opener, indicating a change in the status of the accessory device to a new status.

The present invention also provides, in another aspect, a communication method for a remote server configured to communicate with a peripheral device and an accessory device coupled to an accessory port of a garage door opener. The method includes the remote server receiving from the garage door opener, by an electronic processor of the remote server, an initial data set including a unique identifier for the accessory device, an initial status indicating a status of the accessory device, and an initial setting indicating a setting of the accessory device. The method also includes the remote server storing, by the electronic processor, the initial data set as an accessory data set associated with the accessory port of the garage door opener. The method also includes the remote server sending, by the electronic processor, the initial data set to the peripheral device. The method also includes the remote server receiving, by the electronic processor, new status data from the garage door opener. The method also includes the remote server sending, by the electronic processor, the new status data to the peripheral device. The method also includes the remote server receiving, by the electronic processor, new settings data from the peripheral device. The method also includes the remote server sending, by the electronic processor, the new settings data to the garage door opener, wherein a load of the accessory device is controlled in response to the new settings data.

In some instances, the method may also include the remote server updating, by the electronic processor, the accessory data set to include the new status data, and updating, by the electronic processor, the accessory data set to include the new settings data.

In some instances, the method may also include the remote server receiving from the garage door opener, by the electronic processor, an second initial data set including a second unique identifier for a second accessory device, a second initial status indicating a second status of the second accessory device, and a second initial setting indicating a second setting of the second accessory device. The method may also include the remote server storing, by the electronic processor, the second initial data set as a second accessory data set associated with a second accessory port of the garage door opener. The method may also include the remote server sending, by the electronic processor, the second initial data set to the peripheral device. The method may also include the remote server receiving, by the electronic processor, second new status data from the garage door opener. The method may also include the remote server sending, by the electronic processor, the second new status data to the peripheral device. The method may also include the remote server receiving, by the electronic processor, second new settings data from the peripheral device. The method may also include the remote server sending, by the electronic processor, the second new settings data to the garage door opener, wherein a second load of the second accessory device is controlled in response to the second new settings data.

In some instances, after the second accessory device is disconnected from the second accessory port and the accessory device is disconnected from the accessory port, and after the second accessory device is connected to the accessory port, receiving, by the electronic processor, the second initial data set from the garage door opener, the method may include the remote server storing, by the electronic processor, the second initial data set as the accessory data set associated with the accessory port of the garage door opener. The method may also include sending, by the electronic processor, the second initial data set to the peripheral device.

The invention also provides, in another aspect, a communication method for a peripheral device configured to communicate with an accessory device coupled to an accessory port of a garage door opener, the method comprising. The method includes the peripheral device receiving from a remote server, by an electronic processor of the peripheral device, an initial data set including a unique identifier for the accessory device, an initial status indicating a status of the accessory device, and an initial setting indicating a setting of the accessory device. The method includes the peripheral device receiving, by the electronic processor, new status data for the accessory device from the remote server indicating a change in the status of the accessory device to a new status. The method includes the peripheral device receiving, by the electronic processor, user input indicating a requested change of the setting of the accessory device. The method includes the peripheral device sending, by the electronic processor, new settings data indicating the requested change to the remote server to control a load of the accessory device.

In some instances, the method may also include the peripheral device displaying, on a display of the peripheral device, the accessory device based on the unique identifier and the status of the accessory device based on the initial status. The method may also include the peripheral device displaying, on the display of the peripheral device, the new status of the accessory device upon receipt of the new status data.

In some instances, the method may also include the peripheral device receiving from the remote server, by the electronic processor, a second initial data set including a second unique identifier for a second accessory device, a second initial status indicating a second status of the second accessory device, and a second initial setting indicating a second setting of the second accessory device. The method may also include the peripheral device receiving, by the electronic processor, second new status data for the second accessory device from the remote server indicating a change in the second status of the second accessory device to a second new status. The method may also include the peripheral device receiving, by the electronic processor, second user input indicating a second requested change of the second setting of the second accessory device. The method may also include the peripheral device sending, by the electronic processor, second new settings data indicating the second requested change to the remote server to control a second load of the second accessory device.

In some instances, the method may also include the peripheral device receiving from the remote server, by the electronic processor, a second initial data set including a second unique identifier for a second accessory device, a second initial status indicating a second status of the second accessory device, and a second initial setting indicating a second setting of the second accessory device. The method may also include the peripheral device displaying, on a display of the peripheral device, the accessory device based on the unique identifier and the status of the accessory device based on the initial status. The method may also include the peripheral device displaying, on the display of the peripheral device, the second accessory device based on the second unique identifier and the second status of the accessory device based on the second initial status.

Other features and aspects of the invention will become apparent by consideration of the following detailed description and accompanying drawings.

DETAILED DESCRIPTION

Figure 1:
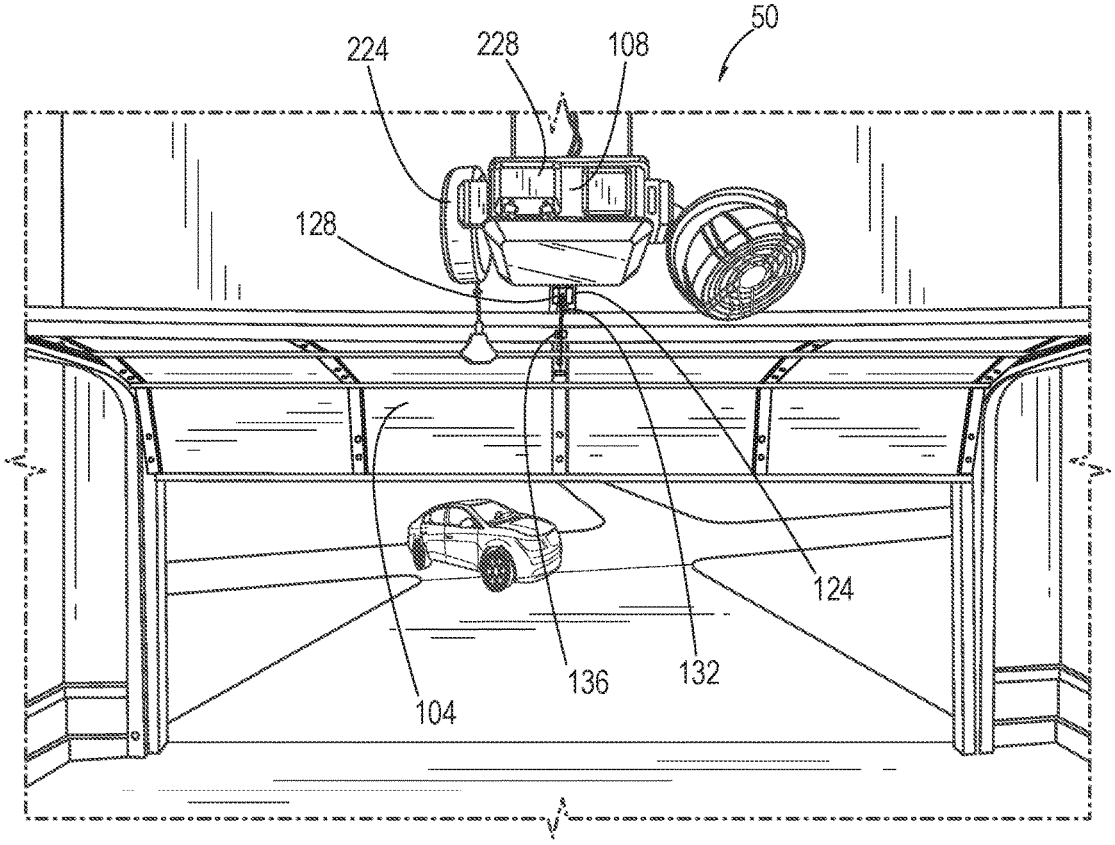
FIG. 1 is a perspective view of a garage door opener system.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIGS. 1-36 illustrate a modular garage door system 50 including a garage door opener 100 operatively coupled to a garage door 104. The garage door opener 100 is configured to receive a variety of accessory devices 200, such as a battery charger 204/battery pack 208, a speaker 212, a fan 216, an extension cord reel 220, an environmental sensor 224, a park-assist laser 228, a folding light 232, a retractable area light 236, and an inflator cord reel 240. The garage door system 50 may be operated by a wall-mounted keypad 244, a passcode keypad 248, and/or a peripheral device 252 (e.g., a smartphone based application, etc.). In the illustrated embodiment, the garage door opener 100 is configured to be coupled directly to an AC power source, and optionally use the battery 208 as back-up power source when AC power is unavailable. In addition, the accessory devices 200 communicate with the peripheral device 252 wirelessly via a communication method 900.

With reference to FIGS. 1-5, the garage door opener 100 includes a housing 108 supporting a motor 112 (e.g., a 2 HP electric motor) that is operatively coupled to a drive mechanism 116. The drive mechanism 116 includes transmission coupling the motor to a drive chain 120 having a shuttle 124 configured to be displaced along a rail assembly 128 upon actuation of the motor 112. The shuttle 124 may be selectively coupled to a trolley 132 that is slidable along the rail assembly 124 and coupled to the door 104 via an arm member.

With continued reference to FIGS. 1-5, the trolley 132 is releaseably coupled to the shuttle 124 such that the garage door system 50 is operable in a powered mode and a manual mode. In the powered mode, the trolley 132 is coupled to the shuttle 124 and the motor 112 is selectively driven in response to actuation by a user. As the motor 112 is driven, the drive chain 120 is driven by the motor 112 along the rail assembly 128 to displace the shuttle 124 (and therefore the trolley 132) thereby opening or closing the garage door 104. In the manual mode, the trolley 132 is decoupled from the shuttle 124 such that a user may manually operate the garage door 104 to open or close without resistance from the motor 112. The trolley 132 may be decoupled, for example, when a user applies a force to a release cord 136 to disengage the trolley 132 from the shuttle 124.

In another embodiment, the drive mechanism 116 includes a transmission coupling the motor 112 to a drive belt that is operatively coupled to the garage door 104 via a rail and carriage assembly. The rail and carriage assembly includes a rail that is coupled to the main housing and a surface above the garage door opener 100 (e.g., a garage ceiling) and supports a trolley coupled to the drive belt. The trolley includes an inner trolley member and an outer trolley member. The inner trolley member is coupled to and driven by the belt, and the outer trolley member is coupled to the garage door (e.g., via a bracket).

The inner trolley member and the outer trolley member are releasably coupled to one another such that the garage door system 50 is operable in a powered mode and a manual mode. In the powered mode, the inner trolley is coupled to the outer trolley and the motor 112 is selectively driven in response to actuation by a user. As the motor 112 is driven, the belt is driven by the motor 112 along the rail to displace the trolley thereby opening or closing the garage door 104. In the manual mode, the outer trolley is decoupled from the inner trolley such that a user may manually operate the garage door 104 to open or close without resistance from the motor 112.

Figure 2:
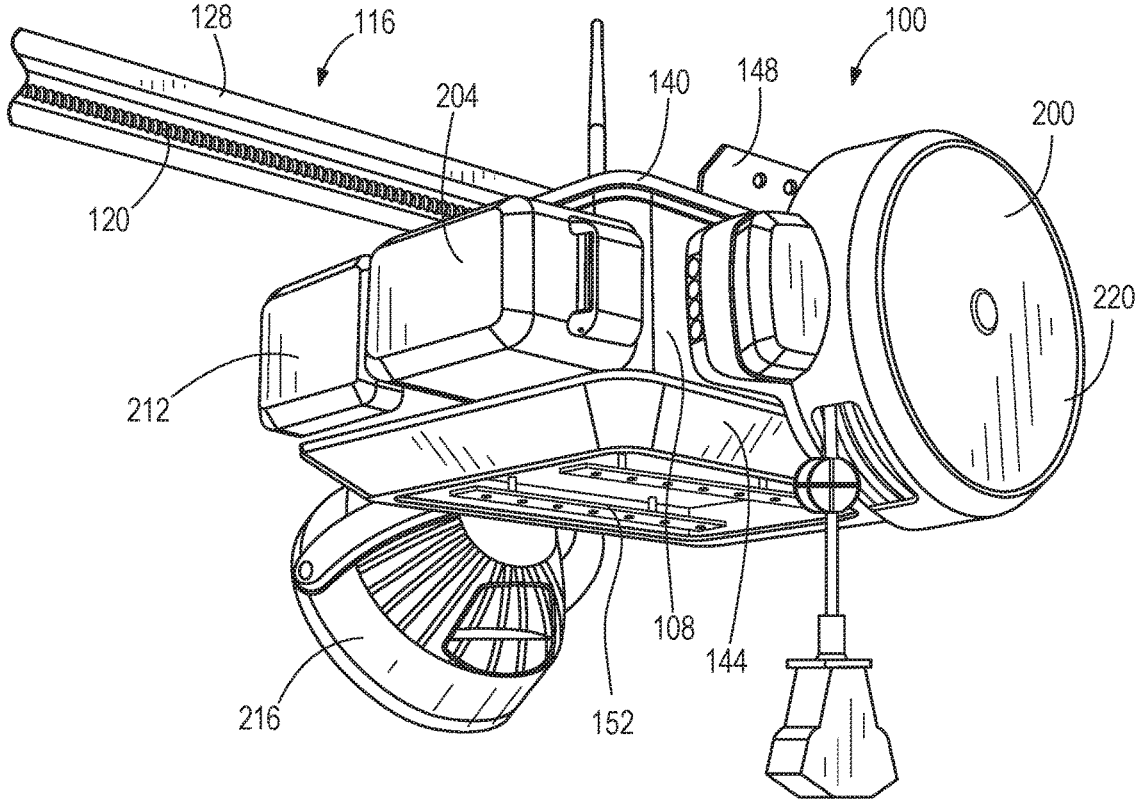
FIG. 2 is a first perspective view of a garage door opener.
Figure 3:
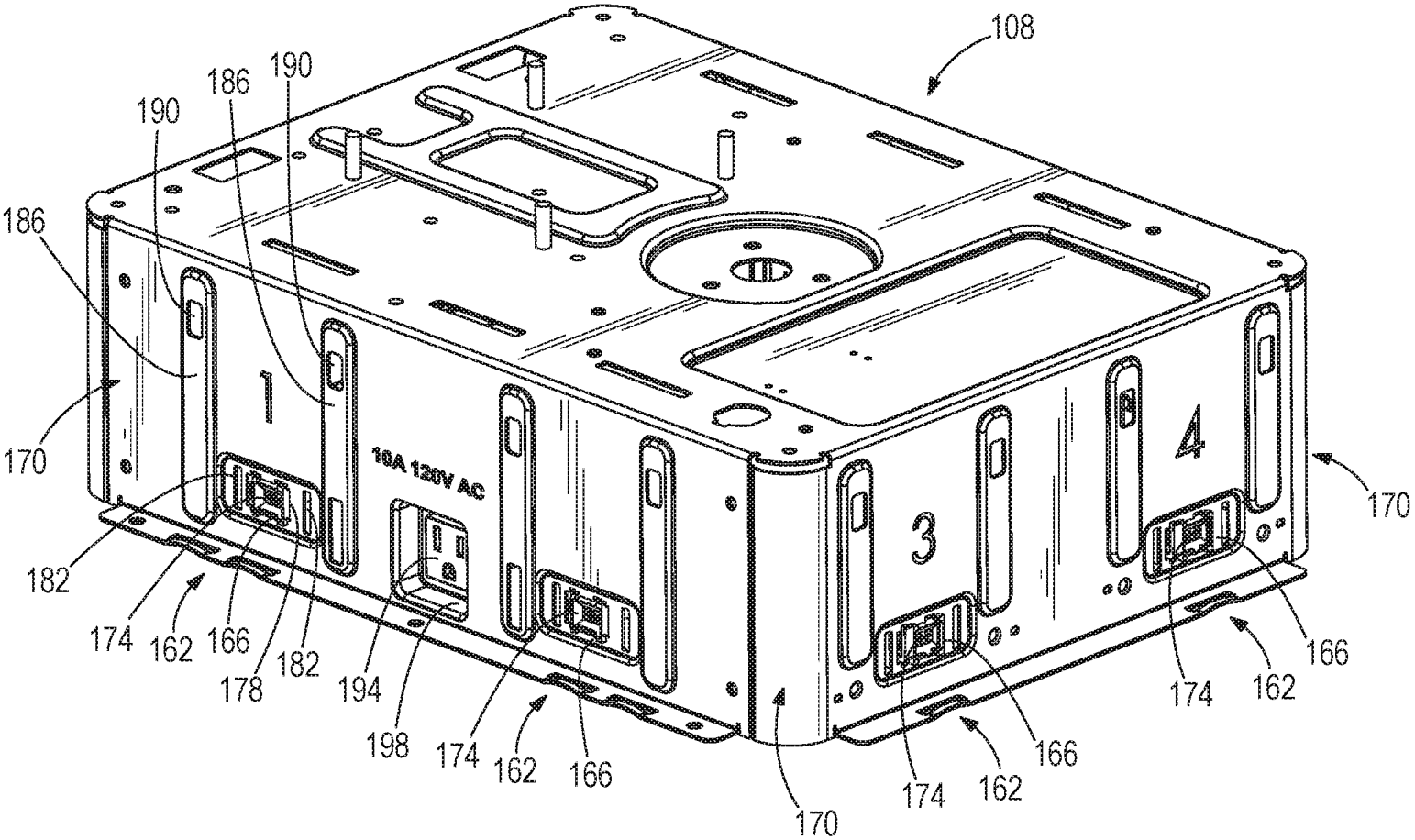
FIG. 3 is a housing of the garage door opener of FIG. 2.
Figure 4:
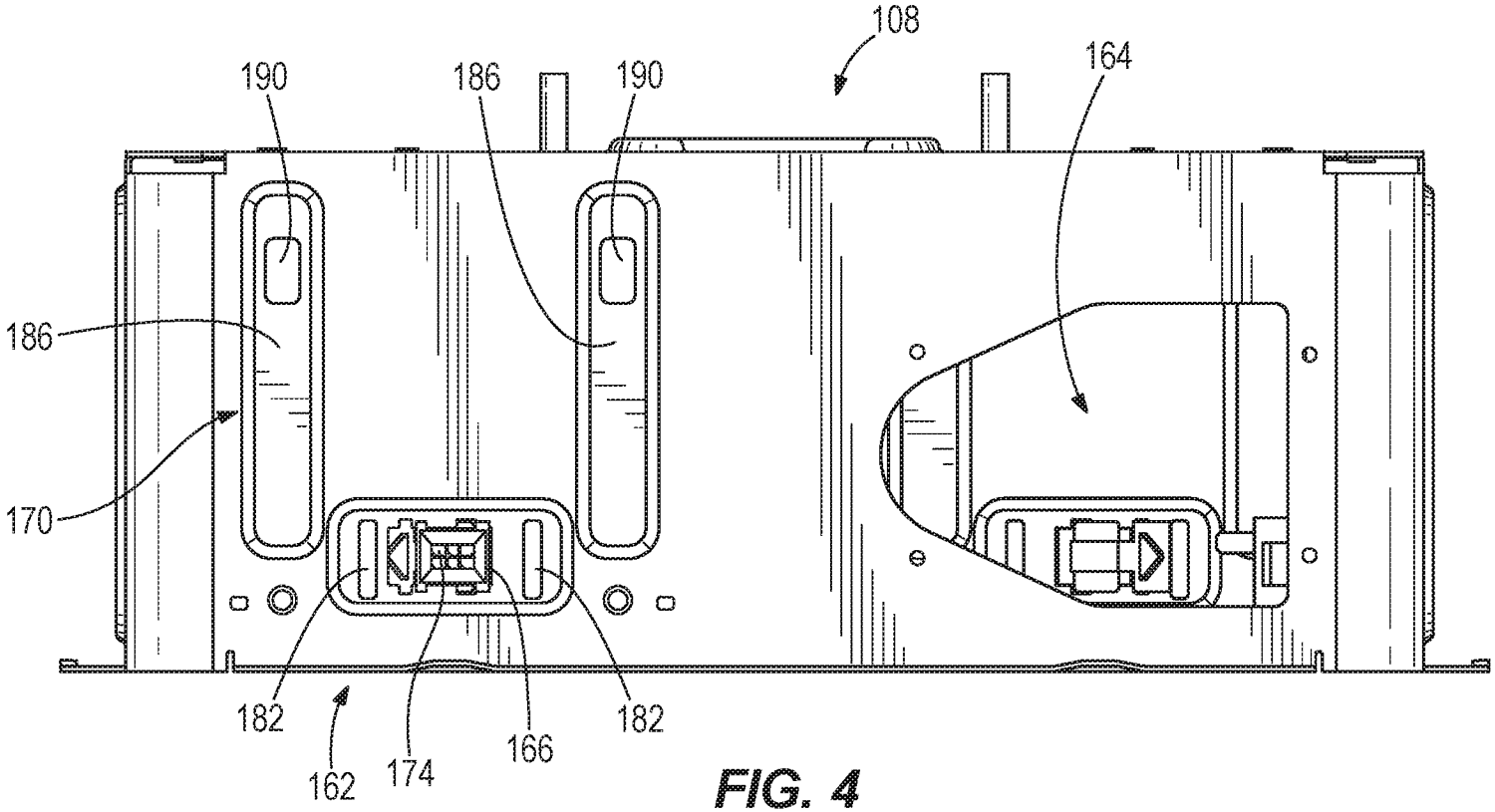
FIG. 4 is a side view of the housing of FIG. 3.
Figure 5:
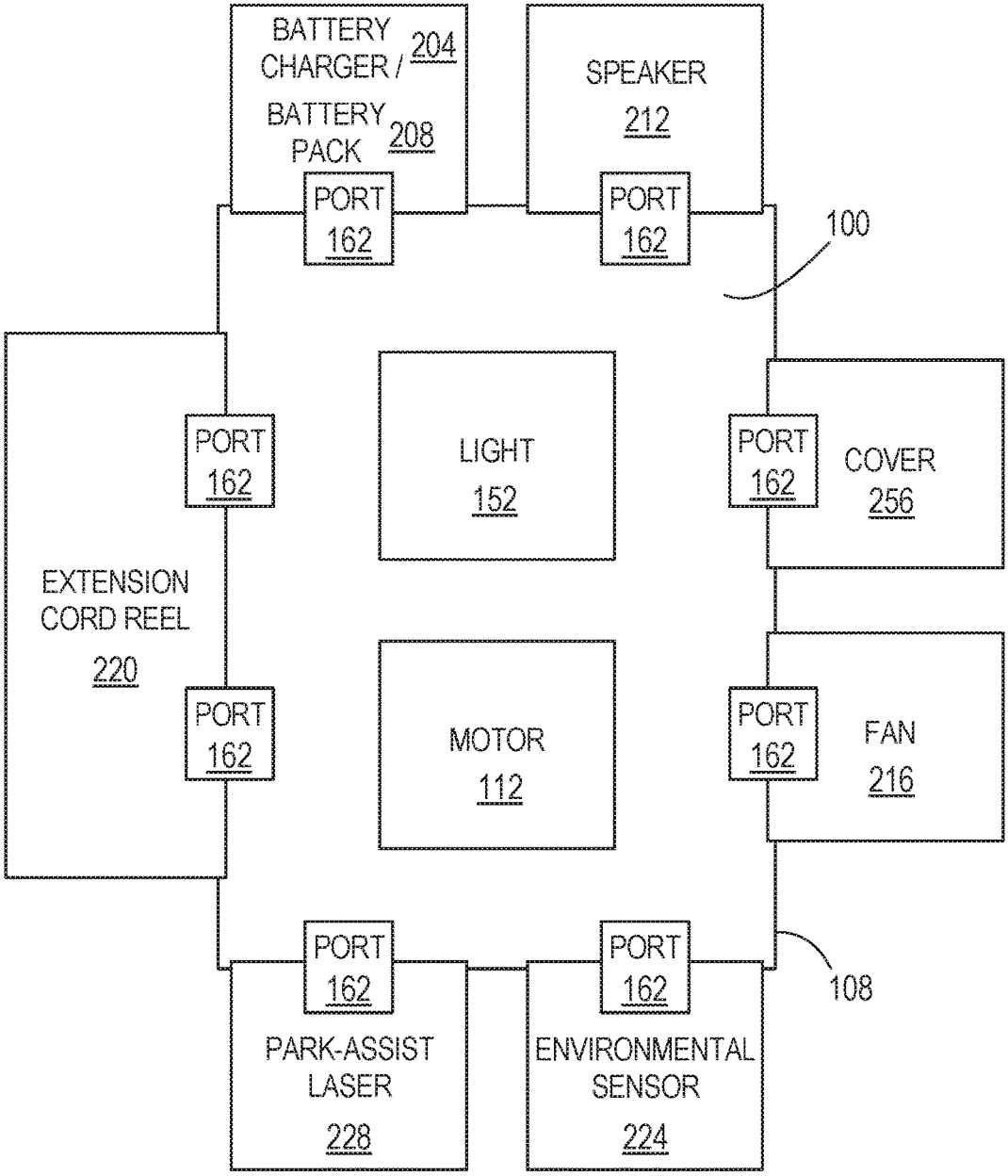
FIG. 5 is a schematic of the garage door opener.

FIGS. 2-4 illustrate the garage door opener 100, which includes the housing 108 supporting the motor 112 (shown in FIG. 5). The housing is encased by an upper cover 140 and a lower cover 144 (FIG. 2). The upper cover 140 is coupled to the rail assembly 128 and the surface above the garage door (e.g., the garage ceiling) by, for example, a support bracket 148. In the illustrated embodiment, the lower cover 144 supports a light 152 (e.g., one or more LED lights), enclosed by a transparent cover or lens 156 (FIG. 8), which provides light to the garage. As illustrated in FIG. 2, in which the cover 156 is removed, the light 152 includes a pair of linear LED strips having a plurality of LEDs disposed at regular intervals along the LED strips. However, in other embodiments, the light 152 may include a single LED strip or more than two LED strips. In addition, the strips may have any shape (e.g., arcuate strips or sections of the strips, obliquely angled portions, etc.), and may include different patterns of LED placement. Furthermore, the LEDs may be configured such that they can emit varying intensities of light or colors of light (e.g., via pulse width modulation).

The light 152 may either be selectively actuated by a user or automatically powered upon actuation of the garage door opener 100. In one example, the light 152 may be configured to remain powered for a predetermined amount of time after actuation of the garage door opener 100, or in response to a signal sent to an accessory device 200 by a peripheral device.

With reference to FIGS. 3 and 4, the housing 108 includes accessory ports 162 that receive and support modular, interchangeable accessory devices 200. In the illustrated embodiment, the housing 108 has eight accessory ports 162 with two ports 162 disposed on each side of the housing 108. However, this configuration is merely exemplary—that is, the housing 108 may include more than eight ports 162 or less than eight ports 162, and each side of the housing 108 may include more or less than two ports 162. Additionally, the housing 108 may include more or less than four sides with each having one or more ports 162, and other surfaces of the housing (e.g., the top and bottom) may include one or more ports 162.

With continued reference to FIGS. 3 and 4, each port 162 includes a communication interface 166 and a coupling interface 170. The communication interface 166 includes an electrical connector 174 disposed within a recess 178. The electrical connector 174 is configured to facilitate electrical communication and data communication between the accessory device 200 and the garage door opener 100. The electrical connector 174 may be any type of powered input/output port. Additionally, in further embodiments the electrical connector 174 may define separate power connectors and data connectors, which may similarly be any type of power connectors and data connectors. In the illustrated embodiment, two slots 182 are formed on either side of the electrical connector 174 and receive a portion of an accessory device 200 to align and mechanically couple the accessory device 200 with housing 108. The coupling interface 170 is defined by a pair of spaced apart, raised surfaces 186 defined on either side of the communication interface 166. Each raised surface 186 includes a chamfered edge and has an aperture 190 defined there through. However, the raised surfaces 186 may be omitted in other embodiments. The apertures 190 are configured to receive portions of the accessory devices 200 to facilitate mechanical coupling of the accessory device 200 to the garage door opener 100.

In the illustrated embodiment, the housing 108 includes an electrical outlet 194 (also referred to as a pass-through outlet) disposed between ports 162 on one or more sides of the housing 108 (FIG. 3). The electrical outlet 194 is a standard U.S. three-prong female AC plug 194 defined within a recess 198. However, the electrical outlet 194 may be any type of AC or DC electrical outlet. Therefore, an electrical device (e.g., a power tool, an air compressor, a light, etc.) including a corresponding connector configured to be coupled to the electrical outlet 194 may receive AC power from the electrical outlet 194.

Furthermore, in the illustrated embodiment, one of the ports 162 is omitted such that a portion of the housing includes a customized port 164 for permanently receiving a specific accessory device 200 (e.g., a battery charging port for fixedly receiving a charger) (FIG. 4). This type of customized port 164 may also be used in place of other ports 162 in other embodiments.

With reference to FIGS. 2 and 5, the garage door opener 100 receives a variety of different accessory devices 200 within the ports 162. In the illustrated examples, two ports 162 and the electrical outlet 194 receive the extension cord reel 220 on one side of the housing 108. On another side of the housing 108, one port 162 receives the environmental sensor 224 and the other port 162 receives the park-assist laser 228. On yet another side, one port 162 receives the fan 216 and the other port 162 is unused and blocked by a cover 256. The final side includes one of the ports 162 and the customized port 164, where the port 162 receives the speaker 212 and the customized port 164 supports the battery charger 204 for receiving a battery pack 208 (e.g., a power tool battery pack). Each accessory device 200 will be described in greater detail below with reference to FIGS. 11-22.

Figure 6:
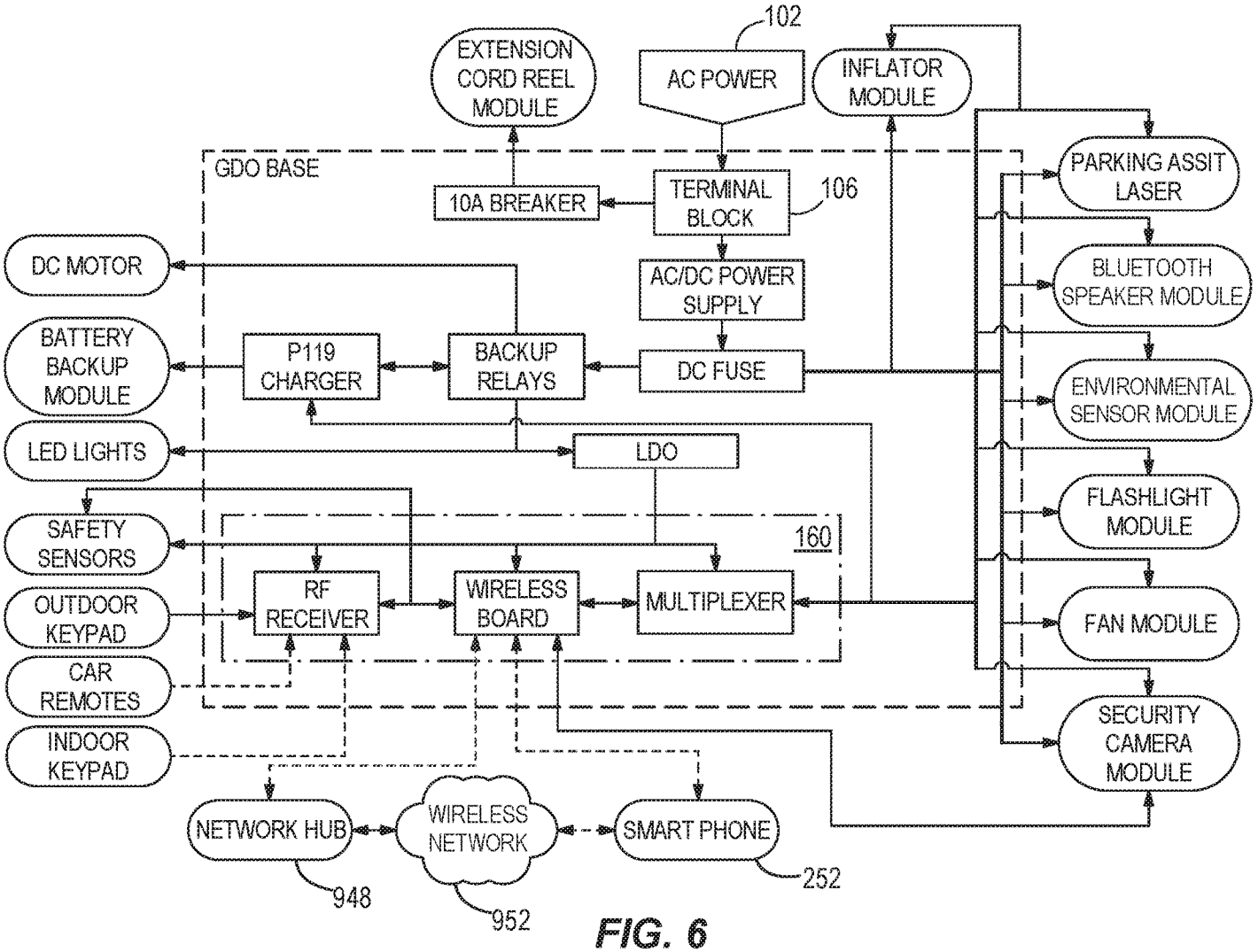
FIG. 6 is a second schematic of the garage door opener.
Figure 7:
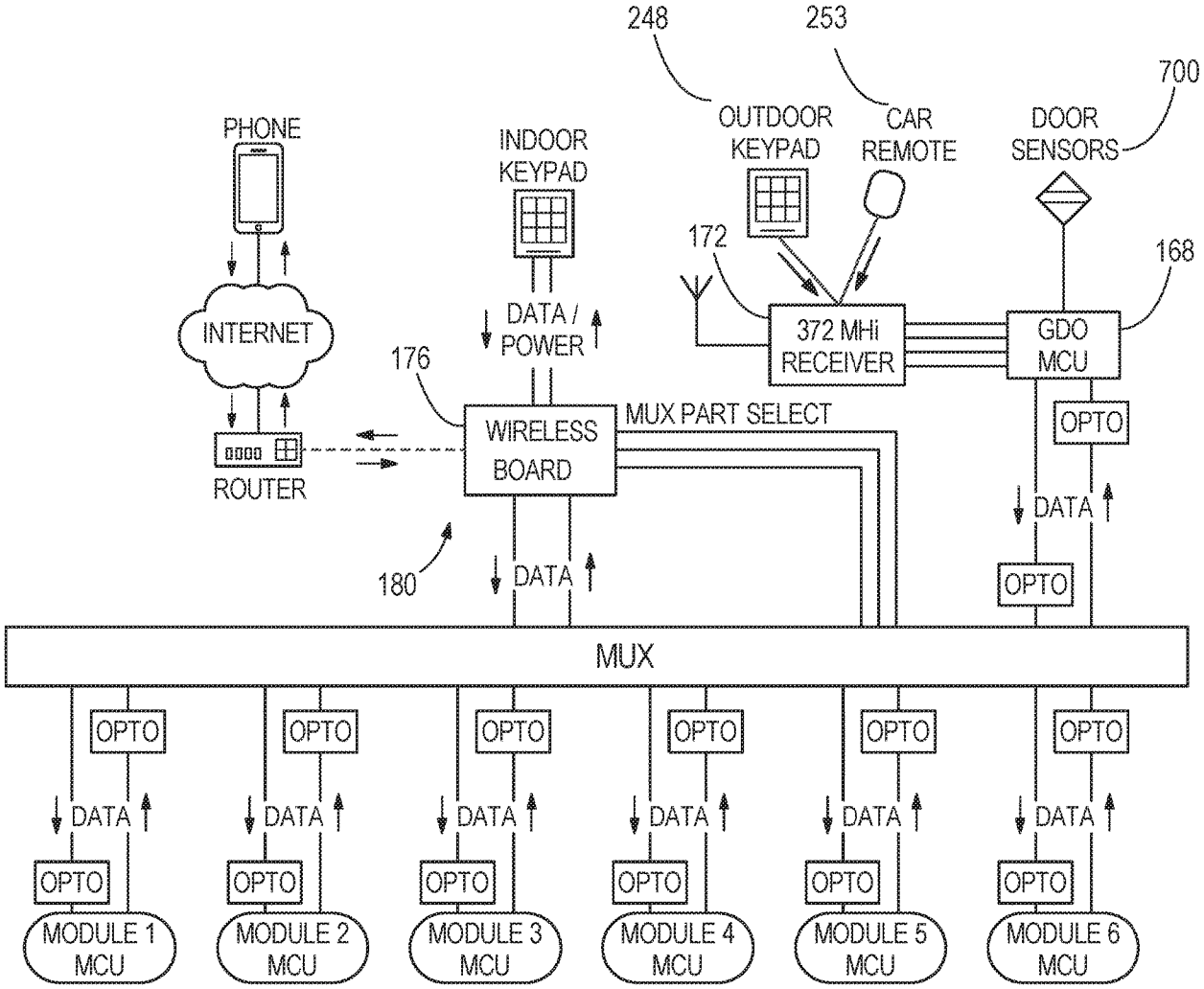
FIG. 7 is a schematic of communication boards within the garage door opener.

With reference to FIGS. 6 and 7, the garage door opener 100 includes a power inlet 102 configured to receive power from an external power source, such as a standard 120 VAC power outlet. The power from the external power source is received at a terminal block 106, which directs power to the motor 112, the light 152, the accessory devices 200, the electrical outlet 194 (via a circuit breaker), and at least one communication board 160 disposed on or within the garage door opener 100 via, for example, a DC fuse. The electrical outlet 194 is coupled to the AC power source 102 via the terminal block 106 such that the electrical outlet 194 is a 'pass through' outlet receiving standard AC power from the AC power source. In this embodiment, the garage door opener 100 includes a garage door opener communication board 168 having a radio-frequency (RF) receiver 172 and a wireless board 176 having a transceiver 180. The garage door opener communication board 168 is in communication with obstruction sensors 700, the remote controller 253 (also referred to as car remote 253), the passcode keypad 248, and the wireless board 176 (e.g., via a multiplexer) and is configured to actuate operation of the motor 112 based on communications received from the foregoing devices. The wireless board 176 is configured to send and receive communications from a network hub 948, a wireless network 952 (e.g., including a remote server 950 (FIG. 30), a peripheral device 252, the wall-mounted keypad 244, and the accessory devices 200. In other embodiments, the garage door opener 100 includes a single communication board 168 communicating with each of the foregoing devices.

Figure 10:
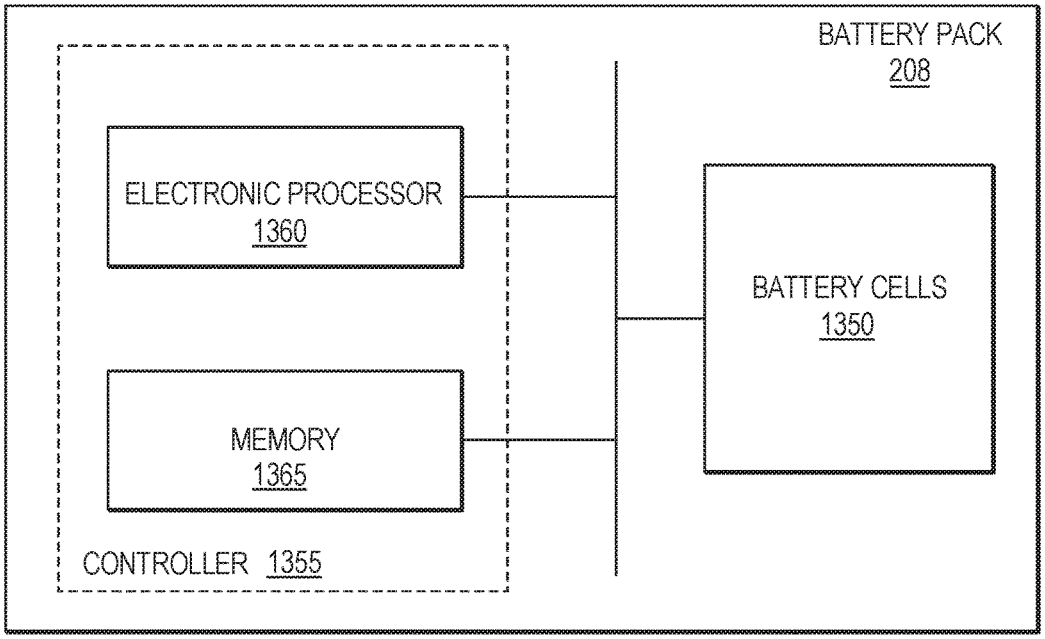
FIG. 10 is a block diagram of a battery pack.

The garage door opener communication board 168 and the wireless board 176 may be referred to as a controller of the garage door opener, with the controller including an electronic processor and memory storing instructions. The electronic processor executes the instructions to carry out the functionality of the garage door opener communication board 168 and the wireless board 176 described herein and, more generally, the control functionality of the garage door opener 100 described herein. The controller may reside on the communications board 160 of FIG. 6, or may be separated onto separate physical boards. An example of a similarly configured controller having an electronic processor and memory, albeit for a battery pack, is illustrated in FIG. 10 as controller 1355.

Figure 8:
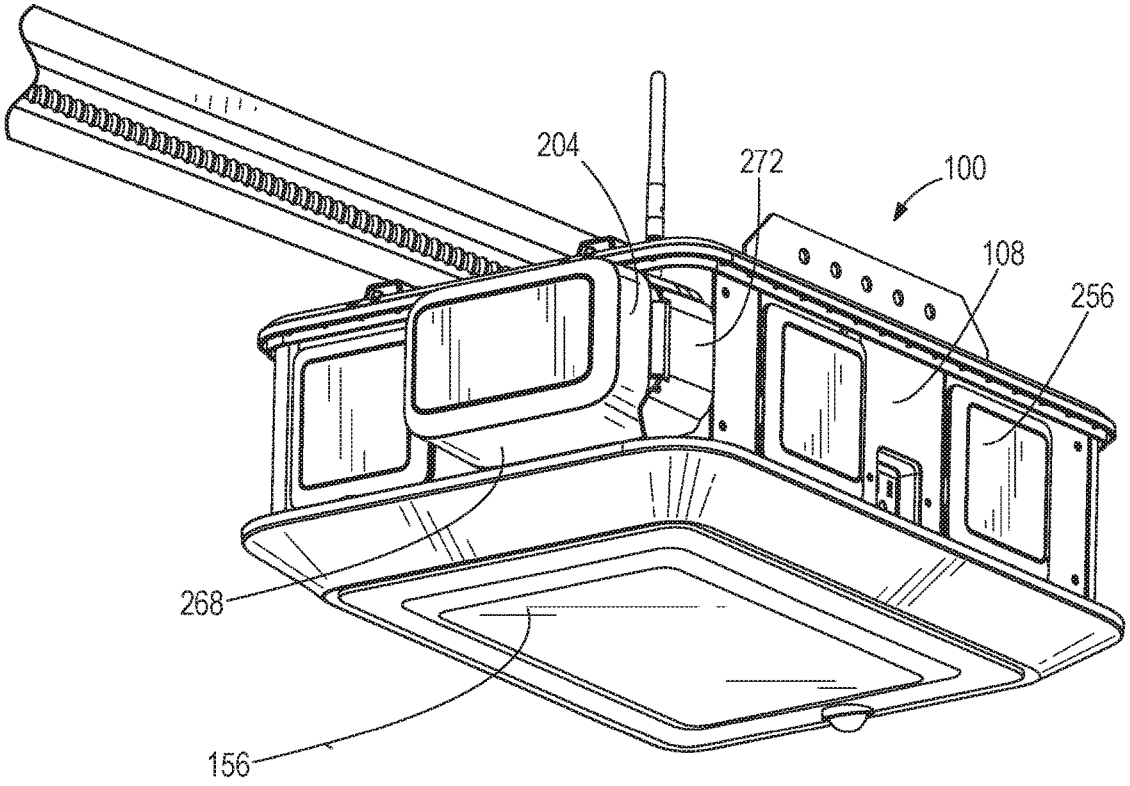
FIG. 8 is a second perspective view of the garage door opener.
Figure 9A:
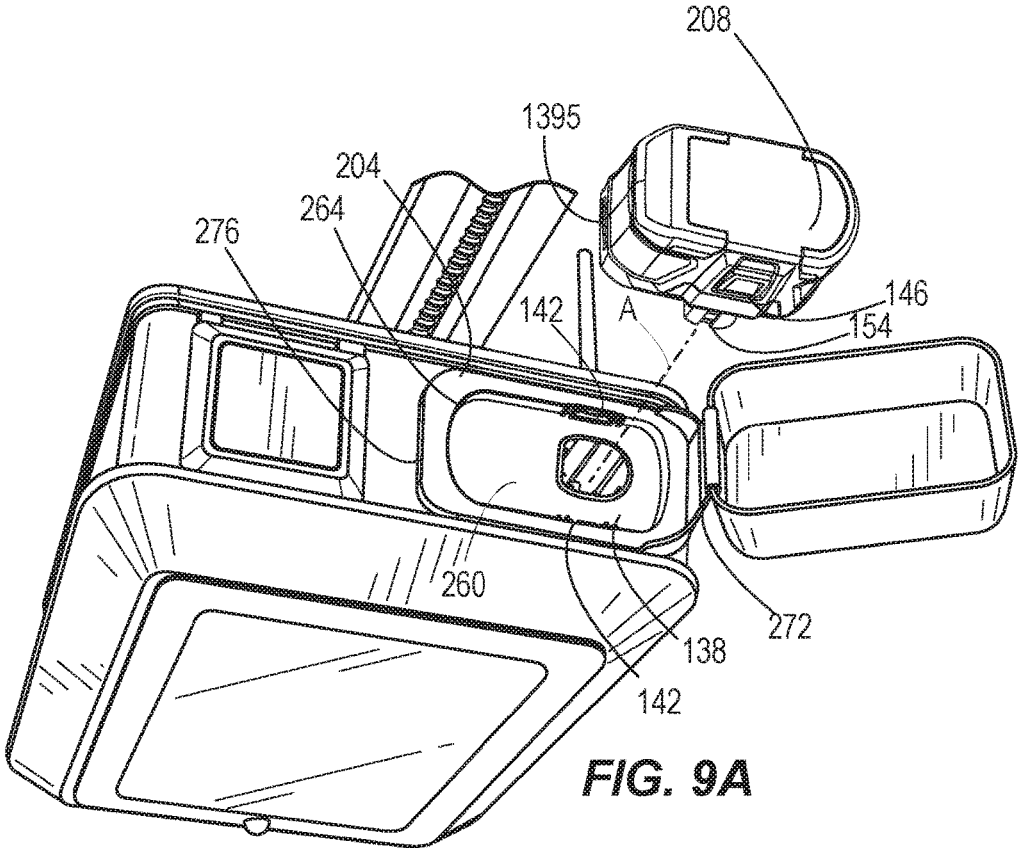
FIG. 9A is a third perspective view of the garage door opener.
Figure 9B:
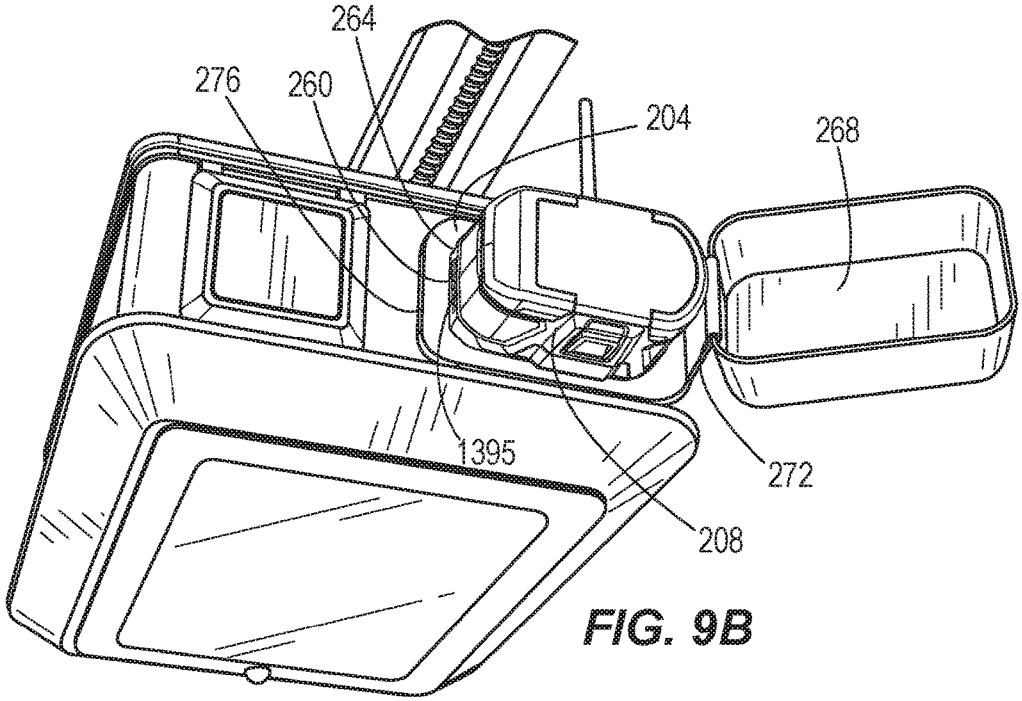
FIG. 9B is a fourth perspective view of the garage door opener.

FIGS. 8, 9A, and 9B illustrate the battery charger 204 disposed on the housing. In the illustrated embodiment, the battery charger 204 includes a charging port 260 defined by a recess 138 that is sized and shaped to receive a battery pack 208. The charging port 260 includes electrical contacts configured to mechanically and electrically engage a set of battery pack contacts to transfer electrical charge from the garage door opener 100 to the battery pack 208 and also communicate data signals therebetween. Additionally, the charging port 260 includes a mechanical coupling mechanism 264 to engage and retain the battery pack 208 within the charger 204. The mechanical coupling mechanism 264 includes two slots 142 disposed on opposed sides of the recess 138 that are configured to receive battery pack latch members 146 to secure and maintain engagement of the battery pack 208 and the garage door opener 100 (FIG. 9A). In the illustrated embodiment, the charging port 260 is configured to receive a battery pack 208 that is inserted along an insertion axis A. However, in other embodiments, the battery receiving portion may be configured to receive a battery pack configured as a 'slide on' battery pack that is inserted along an axis generally perpendicular to the insertion axis.

In other embodiments, however, the mechanical coupling mechanism 264 may be any other conventional battery pack coupling mechanism, such as those seen in battery chargers and/or power tools. The mechanical coupling mechanism may include alignment rails, pivoting latch members received in corresponding slots, or other features used to receive and retain a battery pack within a charging or power tool port either in place of or in addition to the features described above.

The battery charger 204 further includes a door 268 pivotally coupled to a side of the battery charger 204 via a hinged connection 272 such that the door 268 is movable between a closed position (FIG. 8) and an open position (FIGS. 9A and 9B). The door 268 is configured to cover the battery charger 204 when a battery pack 208 is not connected. Additionally, the door 268 is sized and shaped to enclose a battery pack 208 received within the charger 204. The door 268 is retained in a closed position by a locking mechanism 276 defined by a press fit detent; however, other locking mechanisms may be used.

FIGS. 9A and 9B illustrate battery pack 208 that may be coupled to the charger 204 via the charging port 260. The battery pack 208 includes latches 146 on either side of the pack 208 for engaging the slots 142 of the charging port 260 on the charger 204. The battery pack 208 further includes an insertion portion 154 that is received by the charging port 260 of the charger 204. The insertion portion 154 includes a top support portion having a stem extending vertically from the top support portion. The stem has contacts that receive power from the charger 204 and may communicate data between the charger 204 and the battery pack 208. The battery pack 208 further includes a fuel gauge 1395 that indicates a state of charge of the battery pack. The battery pack 208 may be a power tool battery pack configured to power tools (e.g., drills/drivers, impact drills/drivers, hammer drills/drivers, saws, and routers) having a battery receiving portion similar to the charging port 260. In the illustrated embodiment, when the battery pack 208 is coupled to the charging port 260 and the door 268 is open, the fuel gage 1395 is visible to a user (FIG. 9B).

The battery cells of the battery packs 208 may provide a voltage output of about 18 volts, of another value in a range between 17 to 21 volts, or another value, such as about 12 volts, about 28 volts, about 36 volts, about 48 volts, another value or range between 12 to 48 volts, or another value. The term "about" may indicate a range of plus or minus 20%, 15%, 10%, 5%, or 1% from an associated value. The battery cells 1350 may have various chemistry types, such as lithium ion, a nickel cadmium, etc. In addition, the battery packs 208 may provide different capacities in terms of amp-hours because of differences in one or more of the size, capacity, and number of cells (e.g., 5 cells, 10, cells 15 cells, etc.).

When the battery pack 208 is coupled to the battery charger 204, the battery pack 208 also provides power to the garage door opener 100 when the garage door opener 100 loses power—that is, the battery pack 208 serves as a 'DC battery back up.' The garage door opener 100 is configured to detect loss of power and reconfigure the battery charger 204 to receive power from the battery pack 208 when power is lost. In this way, even when the garage door system 50 loses external power, the garage door opener 100 is still able operate the garage door 104.

In one embodiment, the garage door opener 100 monitors a voltage of battery cells of the battery pack 208 (e.g., at continuous intervals, continuously, etc.) when the battery pack 208 is connected to the charger 204 via a charging circuit. The charging circuit may include a processor that is configured to monitor battery pack properties (e.g., type of battery, charge state, temperature, number of charge cycles, etc.) to determine and execute a charging protocol stored in a memory of the charging circuit. The charging protocol may include a constant or variable current application, constant or variable voltage application, a programmed sequence of constant/variable current and constant/variable voltage, and automatic shut-off in response to monitored battery pack properties (e.g., at completed charge, a temperature threshold, etc.). The charging circuit may also be configured to execute a different charging protocol for different types of battery packs. For example, the charging circuit may include a first charging protocol for a first battery pack (e.g., a lithium ion battery pack) and a second charging protocol for a second battery pack (e.g., a nickel cadmium battery pack).

In one embodiment, if the charging circuit detects that the voltage of the battery pack 208 is below a predetermined level, the charger 204 is configured to charge the battery 208. Once the voltage of the battery pack 208 reaches the predetermined level, the charger 204 is configured to cease charging operations (e.g., via the use of a relay). In the case where AC power is lost, and the battery pack 208 is used as a battery back up to power the garage door opener 100, the battery pack 208 is operatively connected to the garage door opener 100 to power the motor 112 (e.g., via a relay activated by the loss of AC power). In other words, and with reference to FIG. 6, in a power outage, the battery pack 208 provides power to the circuitry of the battery charger 204, which forwards the power to reconfigurable backup relays. The backup relays include power switching elements that are automatically switched to accept power from the battery charger 204 when power is not present from the DC fuse and that are automatically switched to accept power from the DC fuse when power (from the terminal block 106) is present. The DC fuse directs power received, whether from the battery pack 208 or the terminal block 106, to the motor 112 and other components of the garage door opener 100.

In an alternate embodiment, certain control circuitry of the charging circuit may be disposed within the battery pack rather than the garage door opener (i.e., the battery pack is a 'smart' battery pack). In this embodiment, illustrated in FIG. 10, the battery pack 208 includes battery cells 1350 and a battery controller 1355 having an electronic processor 1360 and a memory 1365. The electronic processor 1360 executes instructions stored in the memory 1365 to control the functionality of charging circuit described herein, such as to control the charge and discharge of the battery cells 1350 (e.g., via switching elements (not shown)). For example, the battery controller 1360 may monitor pack properties and execute the charging functions described above in response to the monitored pack properties. Additionally, the battery controller may either communicate with the charger of the garage door opener (e.g., via a connection of a battery data contact and a charger data contact) to control charging functions (e.g., operate one or more garage door opener relays) or control functions within the battery pack. Controlling functions within the battery pack may include, for example, disconnecting (e.g., via a relay) the battery pack contacts from battery cells of the battery pack in response to any of the monitored battery pack properties described above.

The charger 204 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the charger 204 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850 (e.g., based on parameters the controller sensors regarding a coupled battery pack), which is sent to the wireless board 176 for communication to the peripheral device via the remote server 950.

In one embodiment, the status field 858 includes, for example, the charge state of the battery (e.g., full charge or charging, a percentage of charge, etc), among others. The settings field 862 includes an on/off toggle for the charging the battery, among others. In this example, the user may set the values for the settings field 862 (e.g., via the peripheral device 252), which turns the charger on and off, while also monitoring the charge state of the battery.

Figure 11:
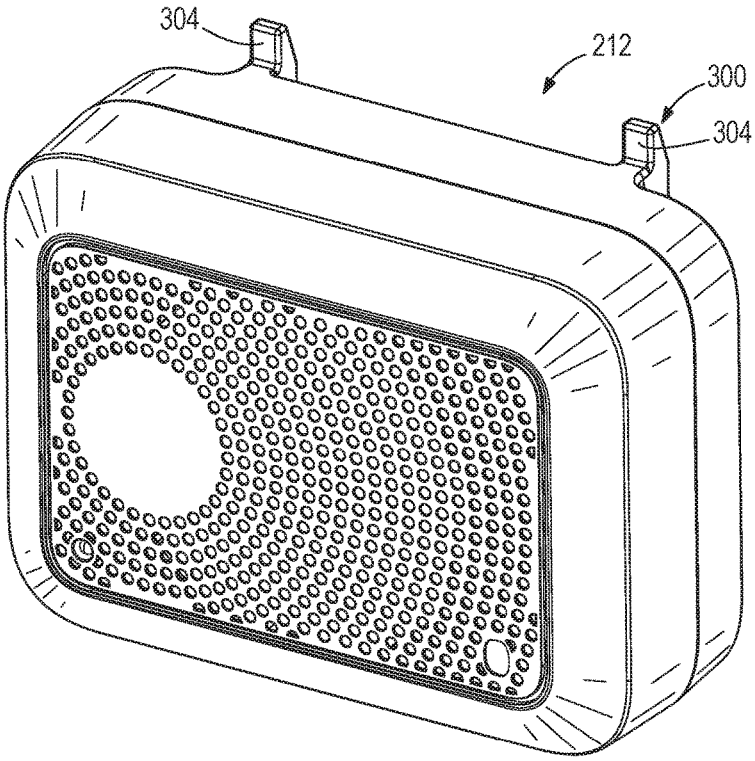
FIG. 11 is a front perspective view of an accessory speaker.
Figure 12:
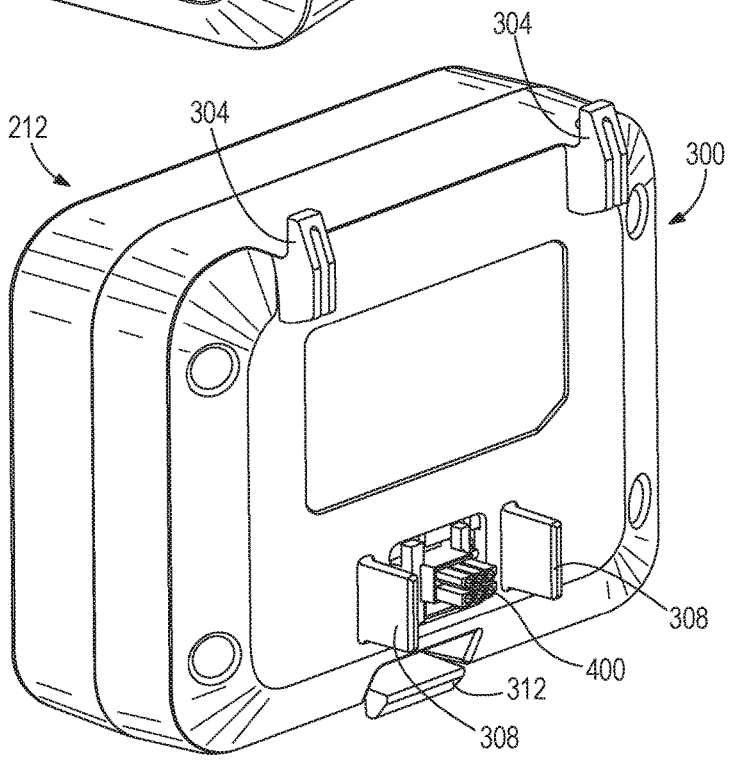
FIG. 12 is a rear perspective view of the accessory speaker.

FIGS. 11 and 12 illustrate the accessory speaker 212 configured to be detachably coupled to the garage door opener 100. In the illustrated embodiment, the speaker 212 is a wireless speaker 212 (e.g., a Bluetooth® speaker) that may be wirelessly coupled to a peripheral device 252. In one embodiment, the speaker 212 receives an audio stream from a peripheral device 252 communicating with the garage door opener 100, and subsequently drives a speaker 212 to output the audio stream using power from the garage door opener 100 via the electrical mounting interface 400. In another embodiment, the wireless speaker 212 receives an audio stream wirelessly directly from a peripheral device 252 via an integral transceiver, and drives a speaker 212 to output the audio stream using power from the garage door opener 100 via the electrical mounting interface 400.

With reference to FIG. 12, the speaker 212 includes a mechanical mounting interface 300 configured to be coupled to the coupling interface 170 of the housing 108, and an electrical mounting interface 400 configured to be coupled to the communication interface 166 of the housing 108. The mechanical mounting interface 300 includes a pair of hooks 304 that are received within the apertures 190 of the coupling interface 170, a pair of projections 308 disposed on opposing sides of the electrical mounting interface 400, and at least one protruding latch member 312 configured to engage a corresponding retention member on the housing 108. The projections 308 are configured to be received within the slots 182 to assist with alignment of the electrical mounting interface 400 and the communication interface 166. When coupled, the speaker 212 receives power from the garage door opener 100 via connection defined by between the electrical mounting interface 400 and the communication interface 166. The speaker 212 also sends and receives data from the garage door opener 100 via connection defined by between the electrical mounting interface 400 and the communication interface 166.

The speaker 212 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the speaker 212 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, on/off state of the speaker, the pairing status (e.g, Bluetooth® pairing status), and speaker volume, among others. The settings field 862 includes an on/off toggle, a pairing toggle (e.g., to turn pairing on/off), and a volume value, among others. In this example, the user may set the values for the settings field 862 (e.g., via the peripheral device 252), which updates the speaker 212 to turn on/off, turn pairing on/off, or alter the volume of the speaker.

Figure 13:
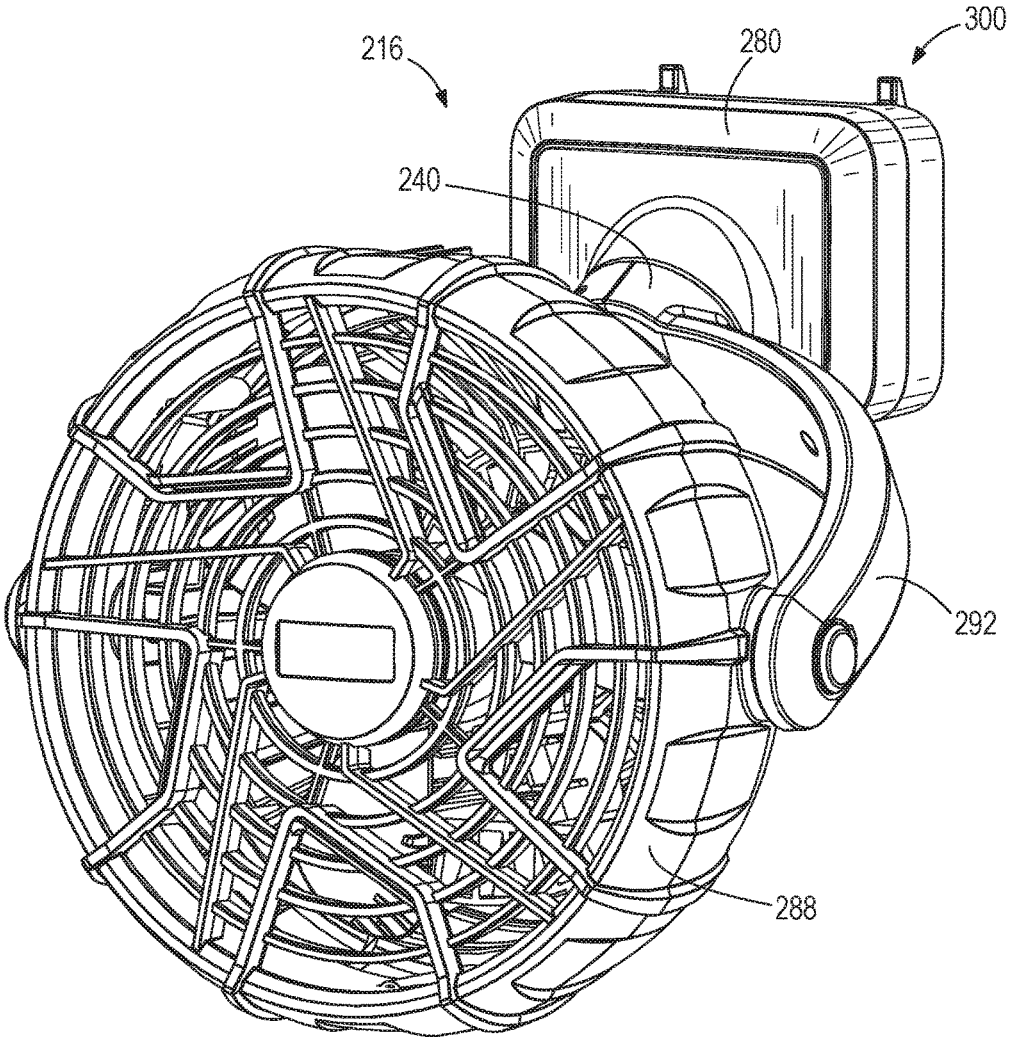
FIG. 13 is a front perspective view of an accessory fan.
Figure 14:
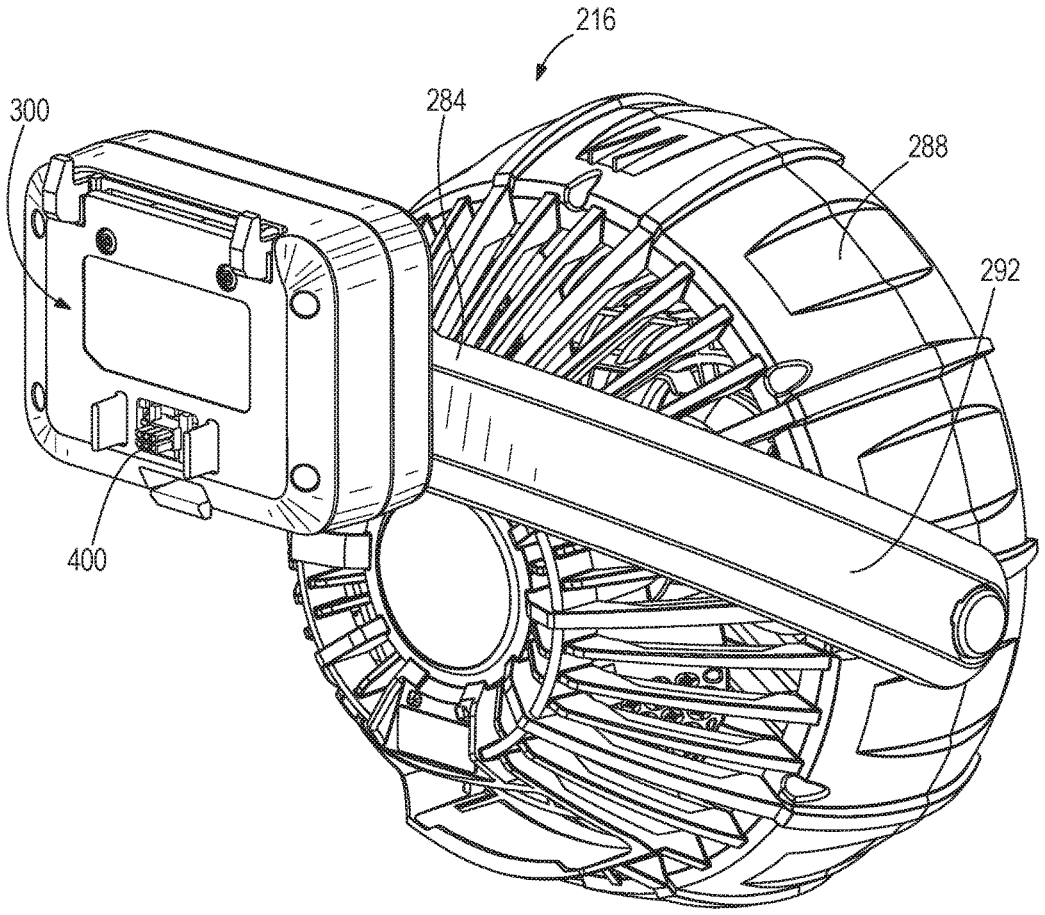
FIG. 14 is a rear perspective view of the accessory fan.

With reference to FIGS. 13 and 14, the accessory fan 216 includes a mounting member 280 supporting a rotatable and pivotal yoke 284 having a fan 288 pivotally retained between a pair opposed arms 292 (i.e., the fan is supported by a gimbal mount). As seen in FIG. 12, the mounting member 280 includes a mechanical mounting interface 300 and an electrical mounting interface 400 that are substantially similar to the interfaces described above with reference to FIGS. 11 and 12. The interfaces 300, 400 engage the housing 108 in a substantially similar matter as those described above with reference to FIGS. 11 and 12.

The fan 216 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the fan 216 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, on/off state of the fan and fan speed (high, medium, low, etc), among others. The settings field 862 includes an on/off toggle and a fan speed value, among others. In this example, the user may set the values for the settings field 862 (e.g., via the peripheral device 252), which updates the fan 216 to turn on/off and adjust the speed of the fan.

Figure 16:
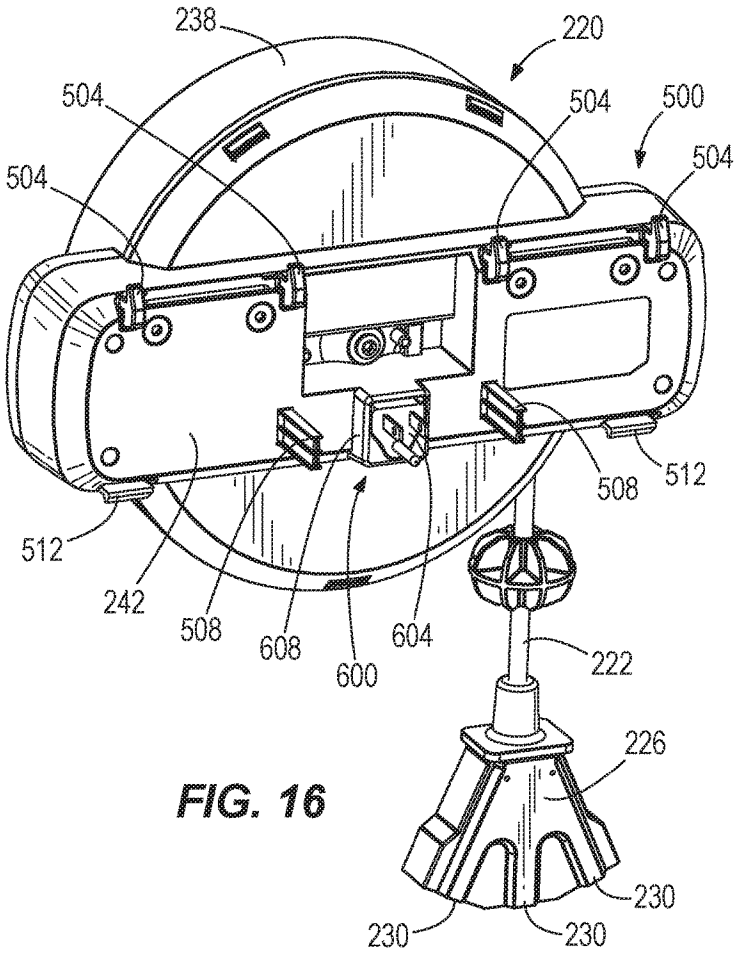
FIG. 16 is a rear perspective view of the accessory cord reel.
Figure 15:
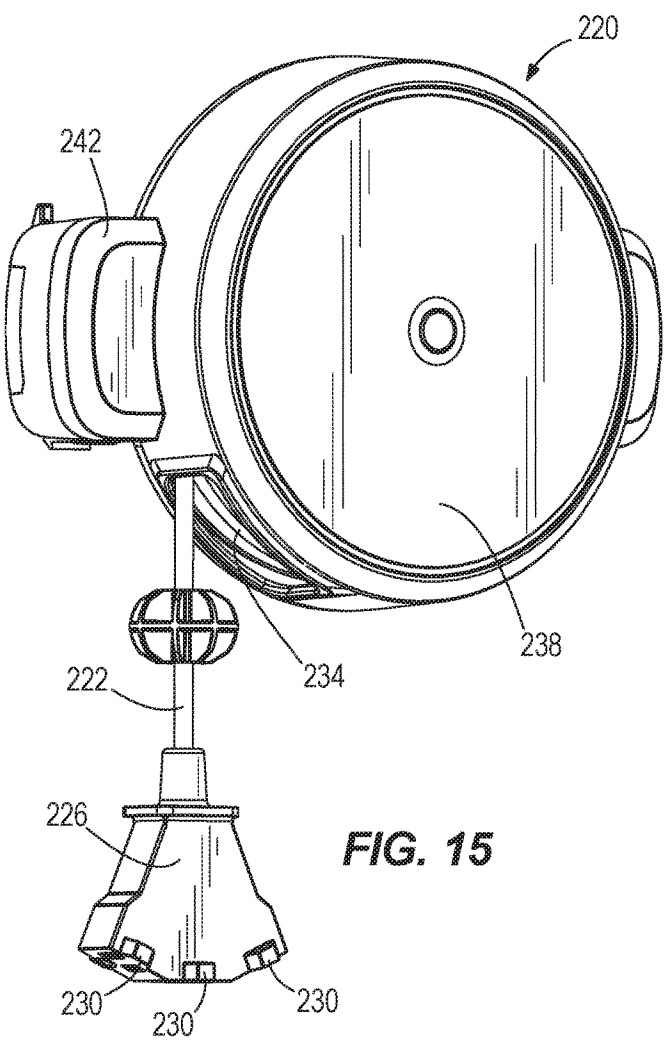
FIG. 15 is a front perspective view of an accessory cord reel.

With reference to FIGS. 15 and 16, the accessory retractable cord reel 220 includes an extension cord 222 having power outlet member 226 having a plurality of power outlets 230 extending from an aperture 234 in a cylindrical main housing 238, with excess extension cord 222 being retained on a cord spooling mechanism (not shown) supported within the housing 238. In one embodiment, the cord spooling mechanism includes a rotatable plate for supporting the cord 222 that is biased by a spring (e.g., a torsion spring). The spring biases the rotatable plate to drive automatic spooling of the cord 222. The cord spooling mechanism also includes a locking member that engages the rotatable plate to fix the rotatable plate into a position allowing the cord extend from the housing at a desired length. The locking member may include a user accessible actuator (e.g., a button, a switch, etc.) or an automatic mechanism. The automatic mechanism may, for example, be engaged when the cord is extended and subsequently released via the application of a first force, and then disengaged when a second force is applied to the cord. However, other spooling mechanisms may be used as well.

With reference to FIG. 16, the main housing 238 includes a mounting plate 242 extending across a rear surface of the main housing 238. The mounting plate 242 includes a mechanical mounting interface 500 defined by four hooks 504, two projections 508, and two latch members 512. The projections 508 are disposed on opposing sides of an electrical mounting interface 600 that includes a male AC plug or plug 604 (e.g., a standard three prong US plug, other standard AC plugs, standard DC plug, etc.). The male AC plug 604 extends from an end of a projecting member 608 that is sized and shaped to be received with the recess 198 of the housing 108. In addition, the AC plug 604 is a pivotable plug to facilitate the attachment between the retractable extension cord reel 220 and the garage door opener 100.

Figure 17:
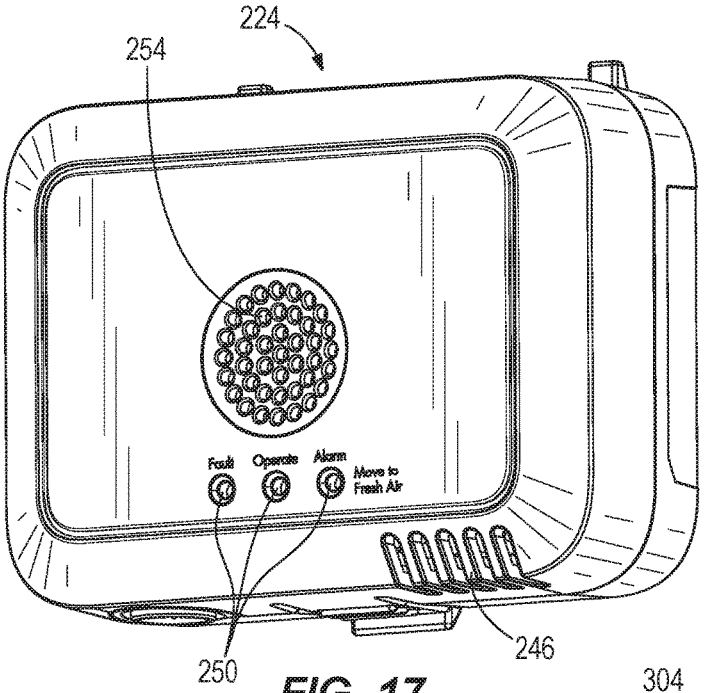
FIG. 17 is a front perspective view of an accessory environmental sensor.

FIG. 17 illustrates the environmental sensor 224. In the illustrated embodiment, the environmental sensor 224 includes an air inlet 246, indicators 250 (e.g., LEDs), and a speaker 254. The air inlet 246 allows ambient air within the garage to enter the environmental sensor 224. Inside the sensor 224, the air is analyzed to determine the presence of carbon monoxide. The environmental sensor 224 provides an alert to a user within the garage. For example, one of the indicators 250 may be activated to indicate the presence of carbon monoxide within the garage and/or the speaker 254 is activated to sound an alarm. Furthermore, in some embodiments, the environmental sensor 224 communicates the presence of carbon monoxide to a peripheral device 252 (e.g., a cell phone, a computing device, one of the keypads, etc.) either directly or via the garage door opener 100.

Although the illustrated environmental sensor 224 is a carbon monoxide detector, other air characteristics may be analyzed in addition to or in place of carbon monoxide. For example, other air characteristics may include humidity, temperature, and the presence of other gases (e.g., smoke, etc.). In other embodiments, the environmental sensor 224 may include a display (e.g., LCD, etc.) for displaying air characteristics to the user.

The environmental sensor 224 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the environmental sensor 224 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, measured temperature values, measure humidity levels, carbon monoxide levels, and carbon monoxide sensor operability, among others. The settings field 862 includes a high/low temperature alarm set point, a high/low humidity alarm set point, and a carbon monoxide level set point, among others. In this example, the user may set the values for the settings field 862 (e.g., via the peripheral device 252), which updates the environmental sensor to alert a user (e.g., via the indicators 250, the speaker 254, an alert on the peripheral device 252, etc.) when the values in the status field 858 exceed the values in the settings field 862. In addition, a user may simply monitor the current values of the status field 858 (e.g., the current temperature, humidity level, or presence of carbon monoxide).

The environmental sensor 224 includes the mechanical mounting interface 300 and the electrical mounting interface 400 on a rear surface (not shown) that are substantially similar to the interfaces described above with reference to FIGS. 11 and 12. The interfaces 300, 400 engage the housing in a substantially similar manner as those described above with reference to FIGS. 11 and 12.

Figure 18:
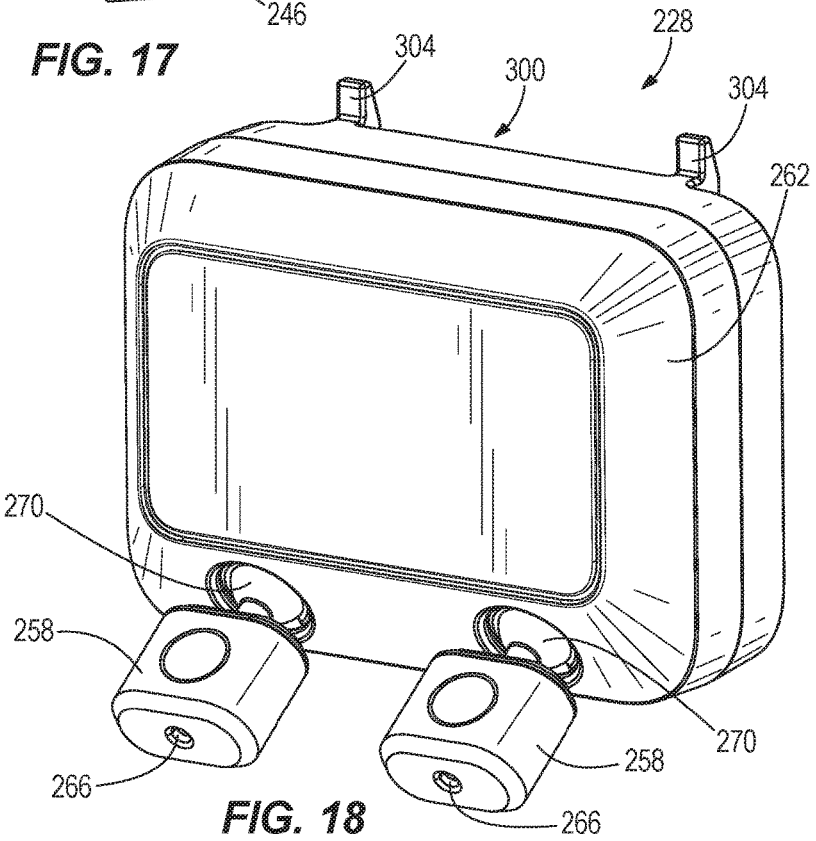
FIG. 18 is a front perspective view of an accessory park-assist laser.
Figure 19:
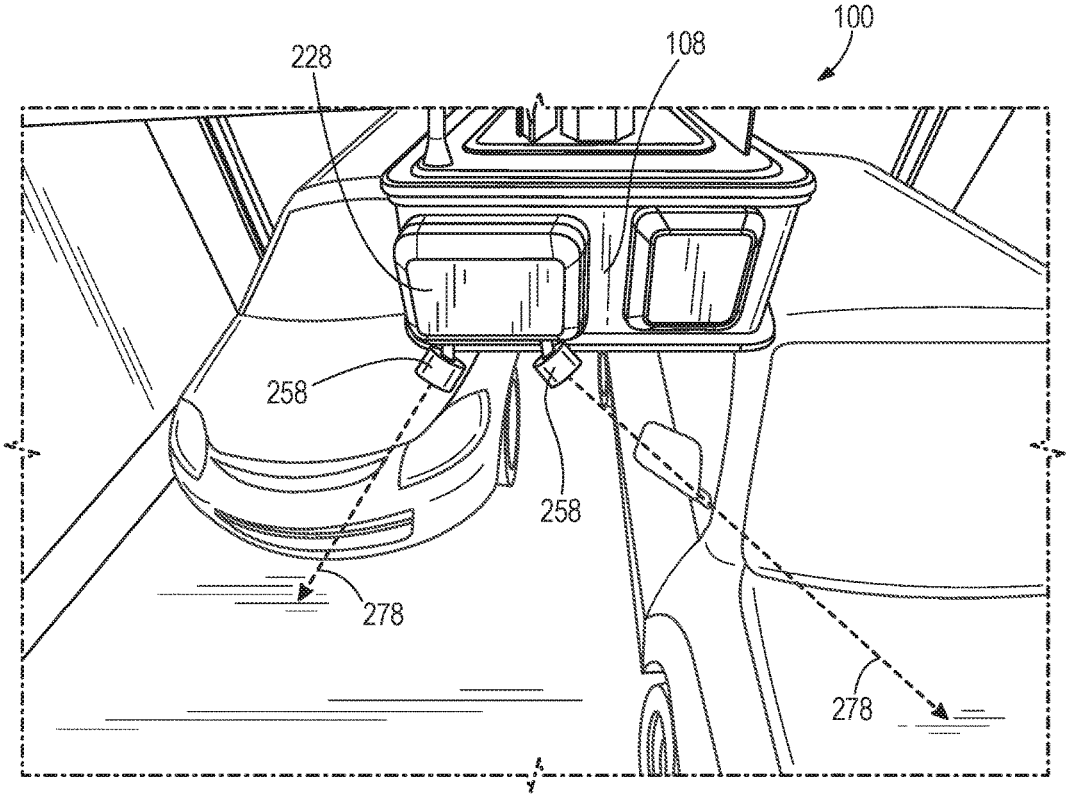
FIG. 19 is a perspective view of the garage door opener system including the accessory park-assist laser of FIG. 18.
Figure 20:
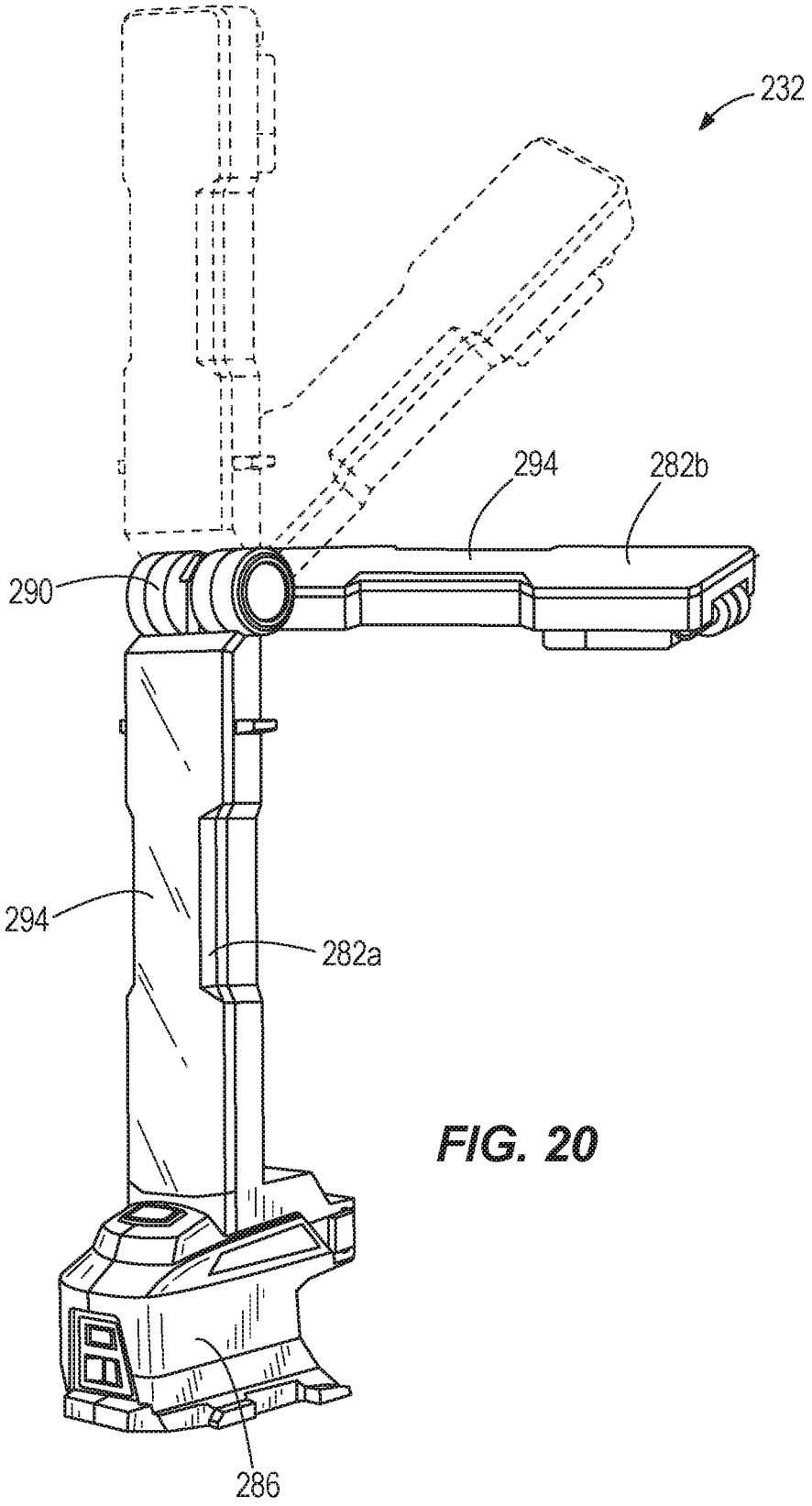
FIG. 20 is a perspective view of an accessory folding light.

FIGS. 18 and 19 illustrate the park-assist laser 228, which includes one or more adjustable laser units 258 coupled to a main housing 262. In the illustrated embodiment, each laser unit 258 includes a laser 266 and a spherical coupling end 270 that is movably received within a recess 274 on the housing 262. The park-assist laser 228 further includes the mechanical mounting interface 300 and the electrical mounting interface 400 on a rear surface (not shown) that are substantially similar to the interfaces described above with reference to FIGS. 11 and 12. The interfaces 300, 400 engage the housing in a substantially similar manner as those described above with reference to FIGS. 11 and 12.

With reference to FIG. 19, the laser units 258 are adjustable by a user such that the lasers 266 are oriented to direct visible laser light 278 toward a floor of the garage. The laser light 278 provides a user with a visible reference point to assist the user with parking a vehicle. The lasers 266 may be manually enabled by a user when desired for use (e.g., via a peripheral device). In addition, the lasers 266 may be automatically powered when the garage door opener 100 is actuated. In one specific example, the lasers 266 may be actuated for a predetermined period of time after the garage door opener 100 has been actuated.

The park-assist laser 228 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the park-assist laser 228 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, an on/off value for the first laser 266 and an on/off value for the second laser 266. The settings field 862 includes, for example, a toggle for automatic activation of park-assist laser 228 upon actuation of the garage door opener 100, a toggle for automatic activation of park-assist laser 228 upon obstruction sensors 700 being tripped, and a timer value to determine the amount of time the park-assist laser 228 remains active before automatically turning off. A user may monitor the status field 858 of the park-assist laser using, for example, a peripheral device 252 to determine whether each of the first and the second laser 266 is on or off With reference to FIG. 20, the folding light 232 includes a pair of lighting sections 282 extending away from a base portion 286. The lighting sections 282 include one or more pivoting connections 290. In the illustrated embodiment, a first lighting section 282*a* is pivotally coupled to the base portion 286, and the first lighting section 282*a* is also pivotally coupled a second lighting portion 282*b*. Furthermore, each pivoting connection 290 permits movement in more than one plane.

Each lighting section support one or more lights 294 (e.g., LED lights or strips) encased by a lens. The lighting sections 282 are selectively actuated independently of one another.

The folding light 232 further includes a mechanical mounting interface 300 and an electrical mounting interface 400 on the base portion 286 that are substantially similar to the interfaces described above with reference to FIGS. 11 and 12. The interfaces 300, 400 engage the housing in a substantially similar manner as those described above with reference to FIGS. 11 and 12.

The folding light 232 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the folding light 232 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, on/off state of each section of the light, among others. The settings field 862 includes an on/off toggle for each section of the light, among others. In this example, the user may set the values for the settings field 858 (e.g., via the peripheral device 252), which turns each light section 282 on/off. The user may also monitor the on/off state of each light section 282.

Figure 21:
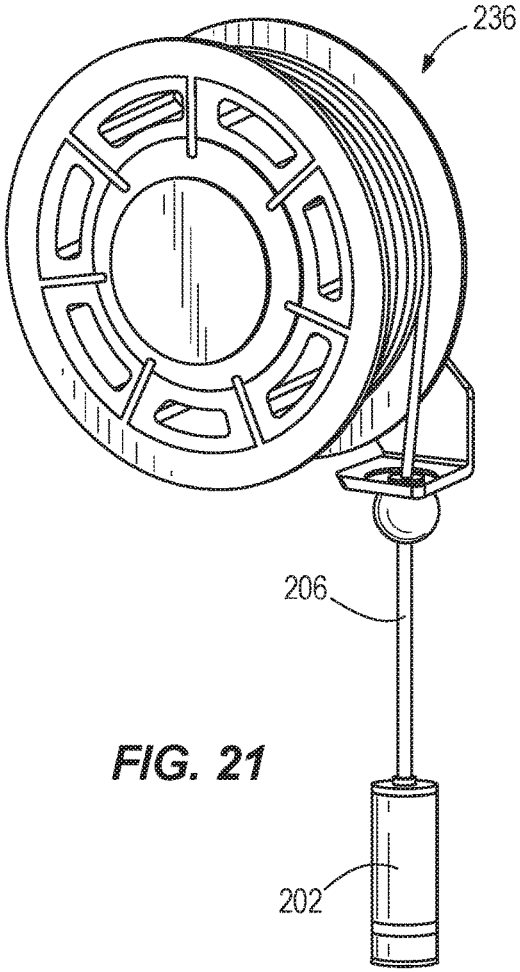
FIG. 21 is a perspective view of an accessory area light.

With reference to FIG. 21, the retractable area light 236 includes an area light 202 disposed on one end of a retractable cord 206. The retractable cord 206 is wrapped around a cord spooling mechanism. The cord spooling mechanism is substantially similar to the cord spooling mechanism described above with reference to FIGS. 15 and 16.

With continued reference to FIG. 21, the retractable area light further 236 includes a mechanical mounting interface 300 and an electrical mounting 400 interface on a rear surface that are substantially similar to the interfaces described above with reference to FIGS. 11 and 12. The interfaces 300, 400 engage the housing in a substantially similar manner as those described above with reference to FIGS. 11 and 12. Alternatively, the retractable area light 236 may include a mounting plate that is substantially similar to the mounting plate 242 described above with reference to FIGS. 15 and 16.

Figure 22:
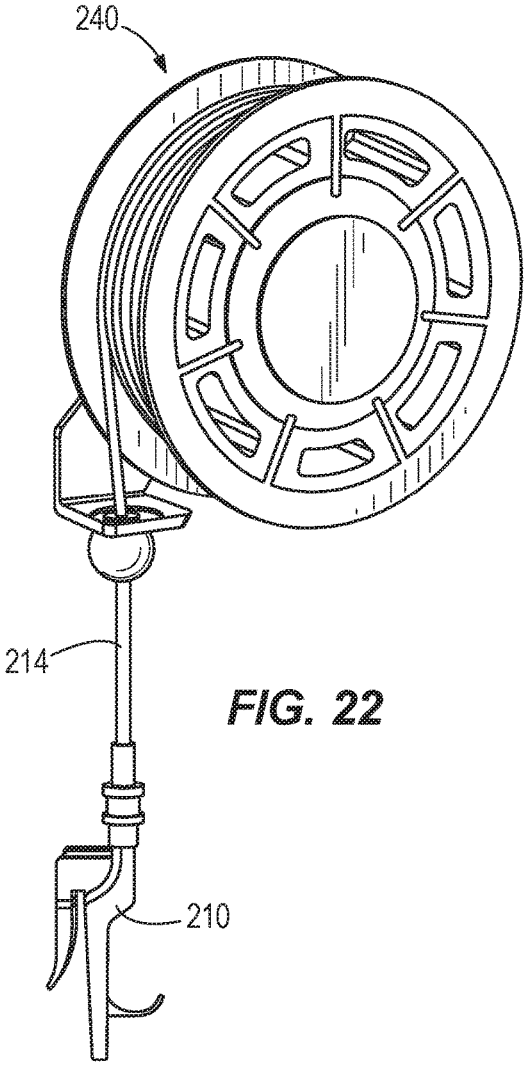
FIG. 22 is a perspective view of an accessory inflator.

With reference to FIG. 22, the accessory inflator cord reel 240 includes an inflator or air delivery nozzle 210 disposed on one end of a retractable cord 214. The retractable cord 214 is wrapped around a cord spooling mechanism. The cord spooling mechanism is substantially similar to the cord spooling mechanism described above with reference to FIGS. 15 and 16.

With continued reference to FIG. 22, the inflator reel 240 further includes a mechanical mounting interface 300 and an electrical mounting interface 400 on a rear surface that are substantially similar to the interfaces described above with reference to FIGS. 11 and 12. The interfaces 300, 400 engage the housing in a substantially similar manner as those described above with reference to FIGS. 11 and 12.

The inflator reel 240 is configured to be operatively coupled to a compressor (not shown) in order to provide compressed air to peripheral objects (e.g., a car tire, etc.). The compressor may be directly coupled to/supported on the garage door opener 100. Alternatively, the compressor may be placed remotely from the garage door opener 100 but configured to be fluidly coupled to the inflator reel 240 (e.g., via tubes extending from the compressor to the inflator reel 240).

The inflator reel 240 further includes a controller in communication with the wireless board 176 of the garage door opener 100. The controller includes a memory storing an initial data set 850 including a unique identifier 854, a predetermined initial status field 858, and a predetermined initial settings field 862 that is communicated to the garage door opener 100 each time the inflator reel 240 is coupled to the port 162. Thereafter, the controller is configured to send and receive data from, for example, the remote server 950 via the wireless board 176. More specifically, the controller receives updates to the settings field 862 of the data set 850 based on data received from the wireless board 176. The controller also updates the status field 858 of the data set 850, which is sent to the wireless board 176 for communication to the peripheral device via the remote server 950.

In one embodiment, the status field 858 includes, for example, pressure of the compressed gas within the compressor and an on/off state of the compressor, among others. The settings field 862 includes an on/off toggle for the compressor and an inflator pressure limit value, among others. In this example, the user may set the values for the settings field 862 (e.g., via the peripheral device 252) in order to turn the compressor on/off or change the inflator pressure limit value, while also monitoring the pressure of the gas within the compressor.

Each of the accessory devices 200 described in FIGS. 8, 9A, 9B, and 11-22 may be interchangeably coupled to the ports 162 of the housing 108 due to the common mechanical mounting interfaces 300 and electrical mounting interfaces 400. In other words, each accessory device 200 may be coupled to any port 162 on the housing. This modular design allows a user to couple desired accessory devices 200 to the garage door opener 100 in a preferred location, while removing accessory devices 200 that the user does not require. This modular design allows the user to customize the garage door opener 100 to fit their specific needs.

Figure 23:
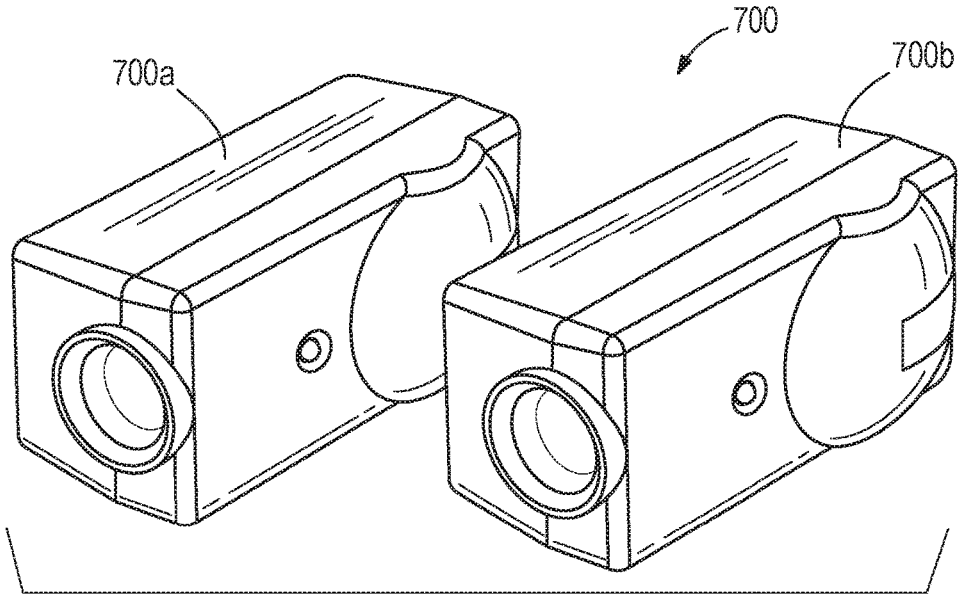
FIG. 23 is a perspective view of a pair of obstruction sensors.
Figure 24:
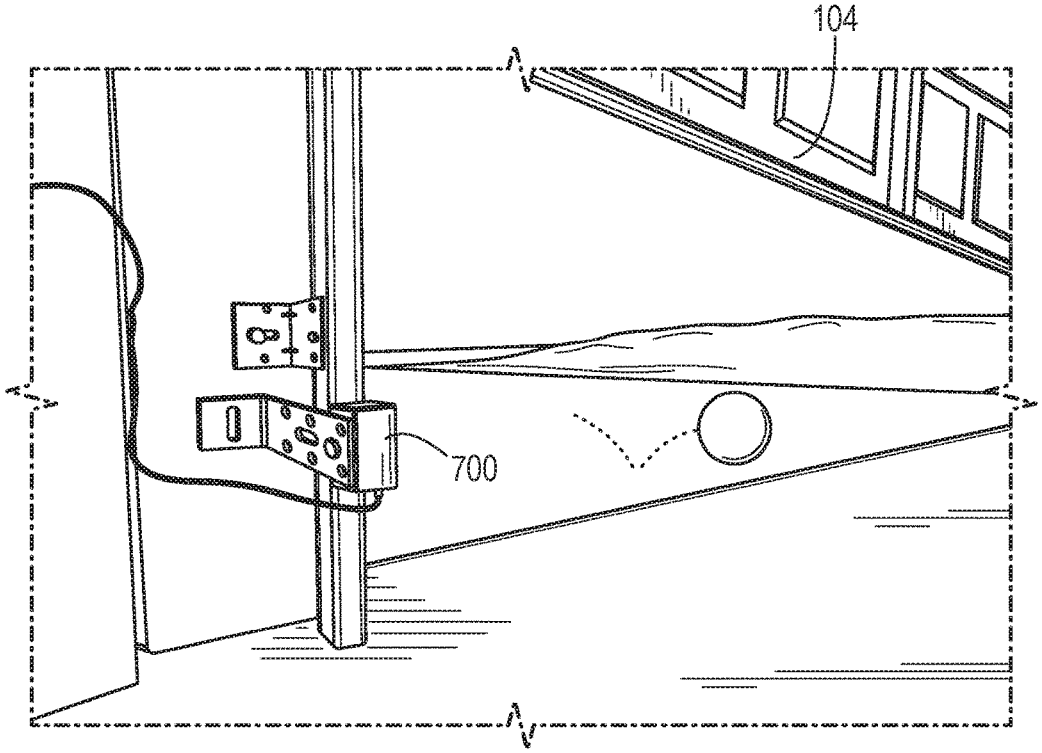
FIG. 24 is a perspective view of the obstruction sensors of FIG. 23 being used in the garage door opener system.

FIGS. 23 and 24 illustrate a pair of obstacle detection sensors 700*a*, 700*b*. As seen in FIG. 24, the obstacle detection sensors 700*a*, 700*b* are mounted on opposing sides of the garage door 104 in facing relation to one another. The obstacle detection sensors 700*a*, 700*b* include a transmitter (e.g., sensor 700*a*) and a receiver (e.g., sensor 700*b*), where the transmitter directs a beam of light (e.g., infrared light) toward the receiver. If the beam is interrupted (i.e., an object passes through the beam) during operation of the garage door 104, the obstacle sensor sends a signal to the garage door opener 100 to pause and/or reverse operation. The obstacle sensors 700*a*, 700*b* may communicate with the garage door opener 100 via a wired or wireless connection.

Figure 25:
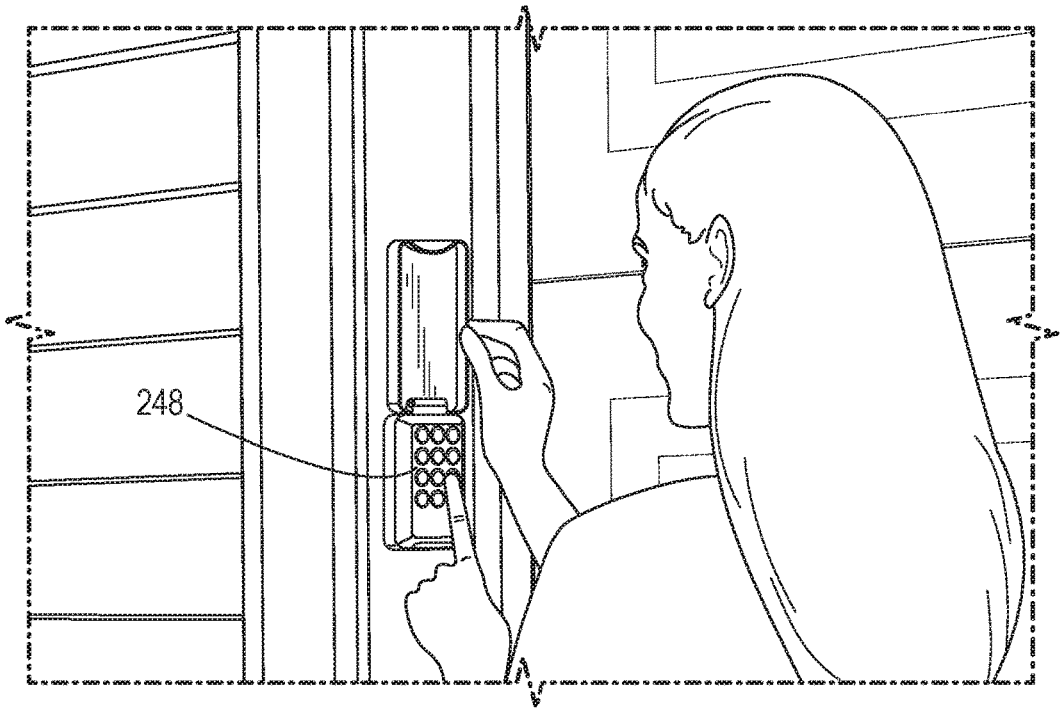
FIG. 25 is a perspective view of an outdoor keypad for use with the garage door opener system of FIG. 1.
Figure 26:
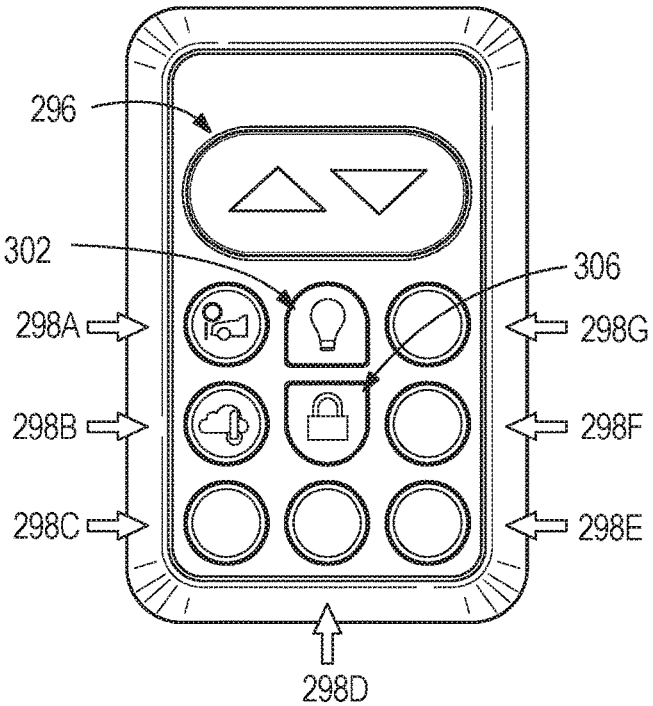
FIG. 26 is a front view of an indoor keypad for use with the garage door opener system of FIG. 1.

FIGS. 25 and 26 illustrate exemplary control devices for the garage door system 50. FIG. 25 illustrates a passcode keypad 248 including buttons. The passcode keypad 248 requires a user to press a specific sequence of buttons in order to actuate the garage door opener 100 to open or close the garage door 104. The passcode keypad 248 may be placed on a surface that is outside of the garage, and operatively communicates with the garage door opener 100 via a wired or wireless connection (e.g., via radio frequency communication).

FIG. 26 illustrates a wall-mounted keypad 244 having a first button 296, a plurality of second buttons 298, a light control button 302, and a lock button 306. The first button 298 operates the door to open or close. In one example, the first button 296 operates the door between two states (e.g., an open position and a closed position). As such, each time the first button 296 is actuated, the door is operated to move from the state it is in (i.e., a current state) to the other state.

That is, if the garage door is in the open position and the first button 296 is actuated, the garage door is operated into the closed position, and vice versa. In some embodiments, if the first button 296 is pressed while the door is moving between states, operation of the door is halted and maintained in an intermediate position. A subsequent actuation of the first button 296 causes the door to travel toward the state opposite the state the door was moving toward prior to being halted in the intermediate position.

The plurality of second buttons 298 (e.g., 298A, 298B, etc.) each controls operation of one accessory device 200 received in an accessory port 162 corresponding to each of the second buttons 298—that is, second button 298A controls an accessory device 200 coupled to a first accessory port 162, second button 298B controls an accessory device coupled to a second accessory port 162, etc. In one example, the second buttons 298 are configured to cycle through states of the accessory device 200 (e.g., the settings data 858) to move between different states of the settings data 858 as described above with reference to each accessory device 200. For example, the speaker 212 may be cycled between a first state where the speaker 212 is powered on and a second state where the speaker 212 is powered off with each actuation of one of the second buttons 298. In another example, the fan 216 may be cycled between a first state where the fan 216 is driven at a high speed, a second state where the fan 216 is driven at a medium speed, a third state where the fan 216 is driven at a low speed, and a fourth state where the fan 216 is off upon each actuation of another of the second buttons 298. In yet another example, the parking laser 228 may be cycled between a first state where the parking laser 228 is powered on (e.g., for a predetermined amount of time) and a second state where the parking laser 228 is powered off with each actuation of yet another of the second buttons 298. Finally, in a last example, the inflator 240 may be cycled between a first state where the inflator 240 is powered on and a second state where the inflator 240 is powered off with each actuation of another one of the second buttons 298.

The light control button 302 is configured to operate the light 152 between an on or off condition. In another example, the on condition is set for a predetermined amount of time before the light 152 reverts to the off condition without actuation of the light control button 302. In yet another example, the light 152 may be cycled between a first state where the light 152 is set to a high intensity level, a second state where the light 152 is set to a medium intensity level, a third state where the light 152 is set to a low intensity level, and a fourth state where the light 152 is off upon each actuation of the light control button 302.

The lock button 306 is configured to operate the garage door opener 100 between a locked condition in which one or more of the garage door opener 100, the accessory devices 200, and the light 152 are prevented from being operated to change states, and an unlocked position in which one or more of the garage door opener 100, the accessory devices 200, and the light 152 are permitted to be operated to change states. As seen in FIG. 26, the wall-mounted keypad 244 may be mounted to a wall within the garage, and operatively communicates with the garage door opener 100 via a wired or wireless connection (e.g., via radio frequency communication).

In an alternate embodiment, the wall-mounted keypad may include a display. The display shows the status of the garage door as well as the status of accessory devices 200 coupled to the garage door opener 100. It should be noted that the first button 296, the second buttons 298, the light control button 302, and the lock button 306 may be configured as any acceptable actuator such as a switch, a slider, an actuator on a touch screen, etc. in other embodiments.

Figure 27:
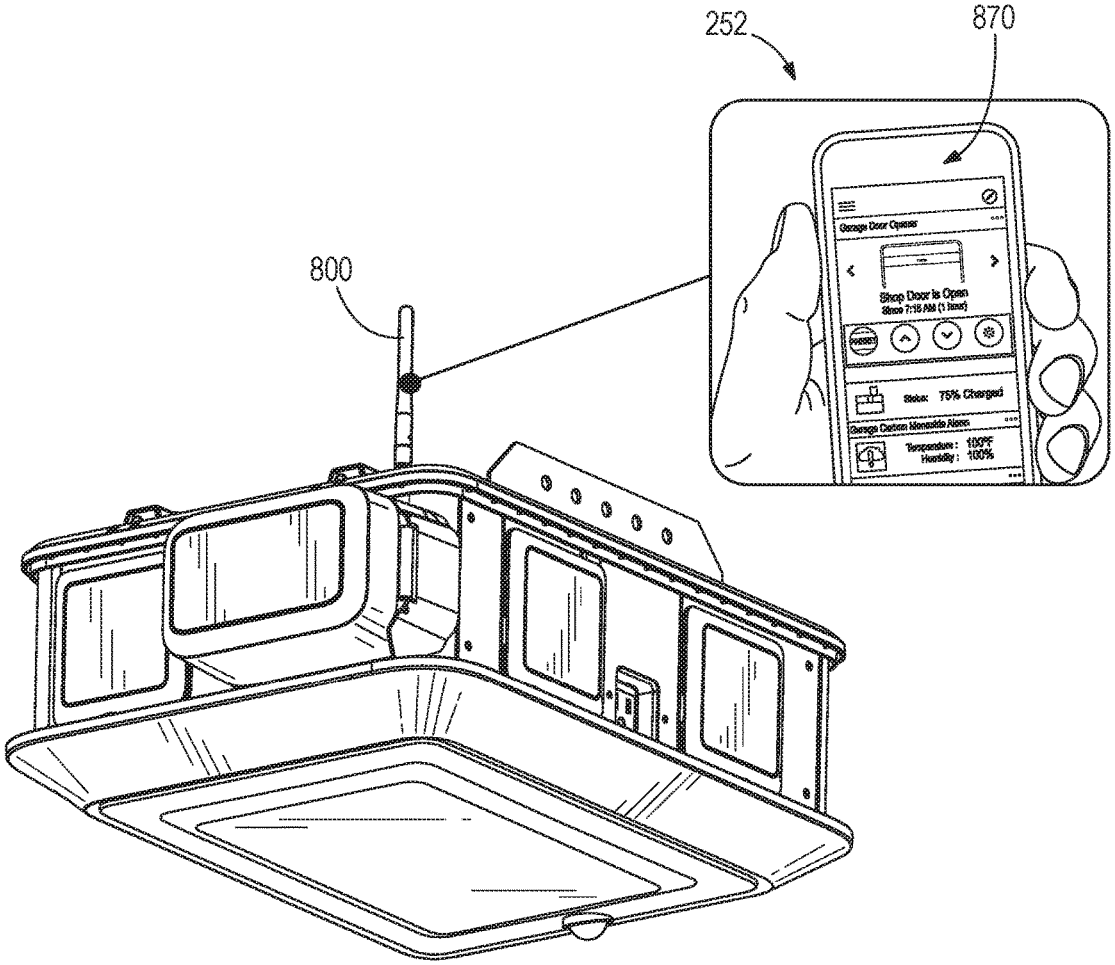
FIG. 27 is a perspective view of the garage door opener including a transceiver in communication with a peripheral device.
Figure 28:
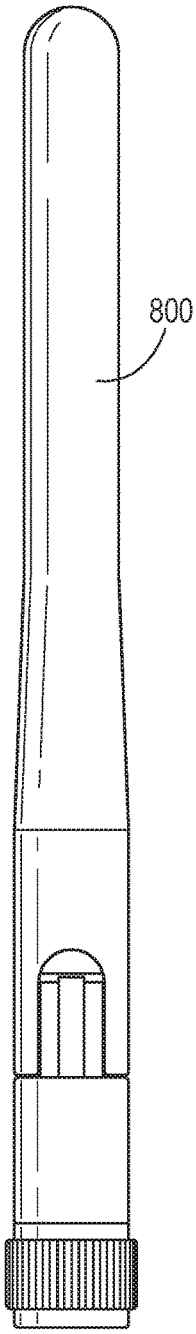
FIG. 28 is a side view of a removable antenna.
Figure 29:
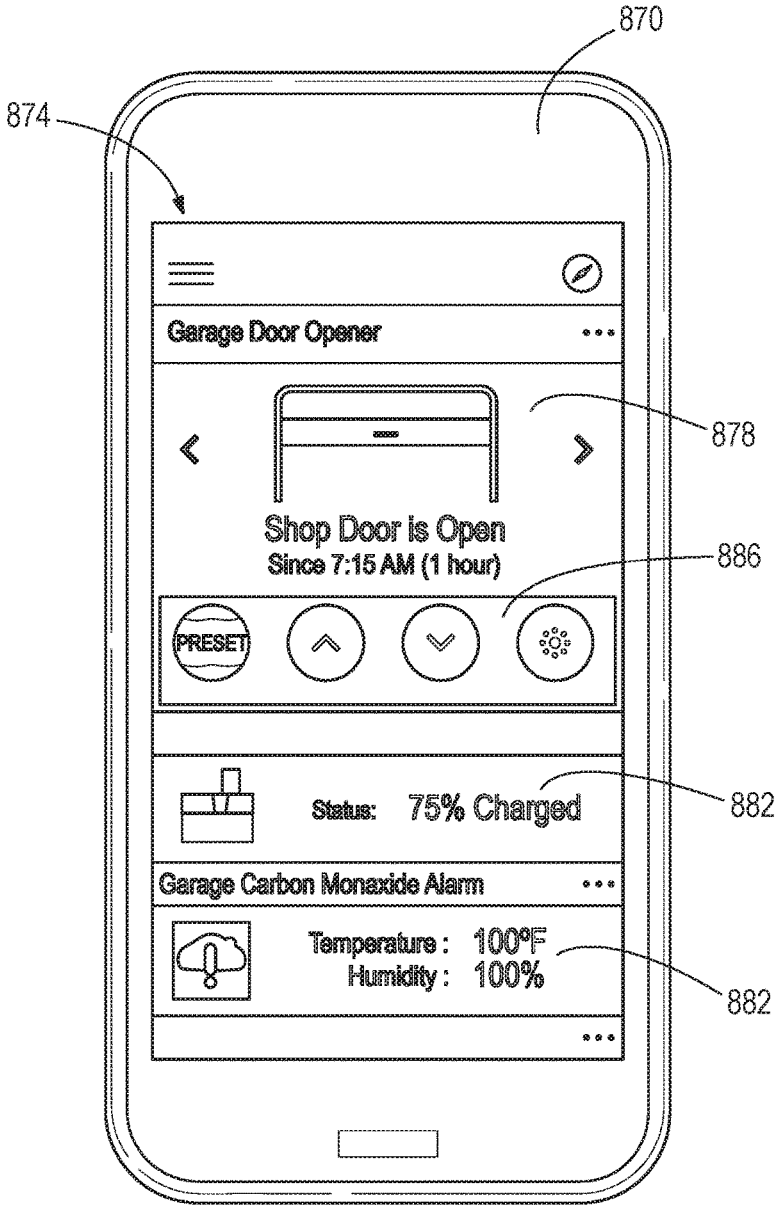
FIG. 29 is a perspective view of a peripheral device application for use with the garage door opener system of FIG. 1.

With reference to FIGS. 27-29, the wireless board 176 is in communication with a peripheral device 252 via a transceiver 800. The transceiver 800 may include a removable antenna including a connecting member pivotally coupled to a main body (e.g., having a 180 degree pivoting range) (FIG. 28). The connecting member is configured to be coupled to the garage door opener (e.g., via a threaded connection, press fit connection, detent mechanism, etc.) to increase communication range of the wireless board. In one example, the antenna may be offer a signal boost (e.g., approximately a 2 dB boost) to enhance communication range. The transceiver receives data and commands from the peripheral devices 252, whether through direct wireless communications or indirect wireless communications from the peripheral device 252 through the wireless network (e.g., the remote server 950). In one example, one peripheral device 252 is a smartphone 870 including a smartphone application 874 for controlling the garage door system 50 (FIG. 29). The smartphone application 874 includes a partitioned user interface 878, where each component/accessory device 200 of the garage door 100 includes a partition of the interface 878. In this example, each partition includes a display 882 for showing the status of the component associated with the partition, as well as one or more actuators 886 for controlling the operation of each component.

Figure 30:
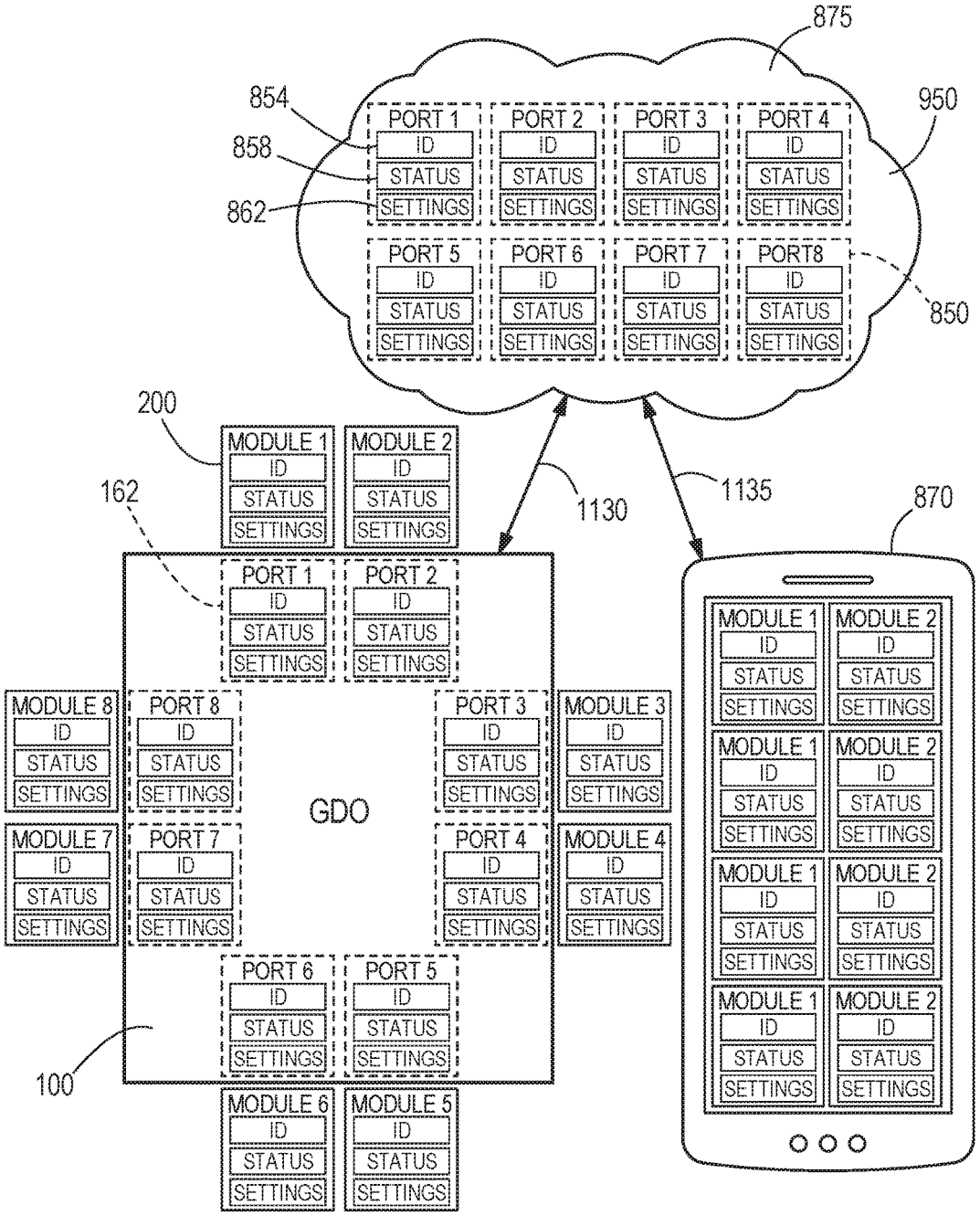
FIG. 30 illustrates a module communication method data transfer structure.

With reference to FIG. 30, the module communication diagram for communication between the accessory devices 200, the garage door opener 100, and the peripheral device 252, includes the communication of a port identifier 848 indicating the port 162 that an accessory device 200 is coupled to, and the data set 850 including at least identifier (ID) data 854, settings data 858, and status data 862 from each of the accessory devices 200, to the peripheral devices 252 via garage door opener's wireless board 176 and, optionally, a remote server 950. In this communication method, the garage door opener 100 acts as an intermediary communication device or pass through device—that is, the wireless board 176 determines the port 162 in which the accessory 200 is received (e.g., associates the accessory 200 with a port identifier 848) and understands data sets 850 that it sends and receives is divided into categories (e.g., unique identifier 854, status 858, settings 862), but does not actually process or 'understand' the data contained within the data set 850. Rather, it simply routes the port identifier 848 and data set 850 associated with each connected accessory device 200 to the peripheral device 252 via the remote server. This, for example, allows the garage door opener 100 to receive one of multiple different accessories in a single port 162, and allows each accessory device 200 to be moved from a first port 162 to another port 162. For example, when a first accessory device 200 is coupled to a first port 162, the first accessory device 200 is assigned a first port identifier 848 associated with the first port 162, and when the first accessory device 200 is subsequently coupled to a second port 162, the first accessory device is assigned a second port identifier 848 associated with the second port 162. In another example, when a first accessory device 200 is coupled to a first port 162, the first accessory device 200 is assigned a first port identifier 848 associated with the first port 162, and when a second accessory device 200 is subsequently coupled to the first port 162, the second accessory device is assigned the first port identifier 848 associated with the first port 162.

When the accessory device 200 is plugged into or otherwise coupled to the garage door opener 100, the accessory communicates the initial data set 850 to the garage door opener 100 defining the unique identifier 854, initial status 858, and initial settings 862. The garage door opener 100 receives the initial data set 850 from the accessory 200 and sends the initial data set 850 and port 162 to the remote server 950. The collection of data sets 850 for the various accessories 200 may be collectively referred to as accessory information 875. A peripheral device 252 monitors the remote server 950 and is configured to process this initial data set 850 and the port number to identify the accessory device 200 (e.g., via the unique identifier), the port 162 in which the accessory device 200 is coupled, and the initial status 858 and settings 862 associated with that particular accessory device 200. Thereafter, the peripheral device 252 can update the settings 862 of the accessory device 200 and monitor the status 858, while the accessory device 200 can update the status 858 delivered to the remote server 950 and monitor the settings 862 provided by the peripheral device 252.

Figure 31:
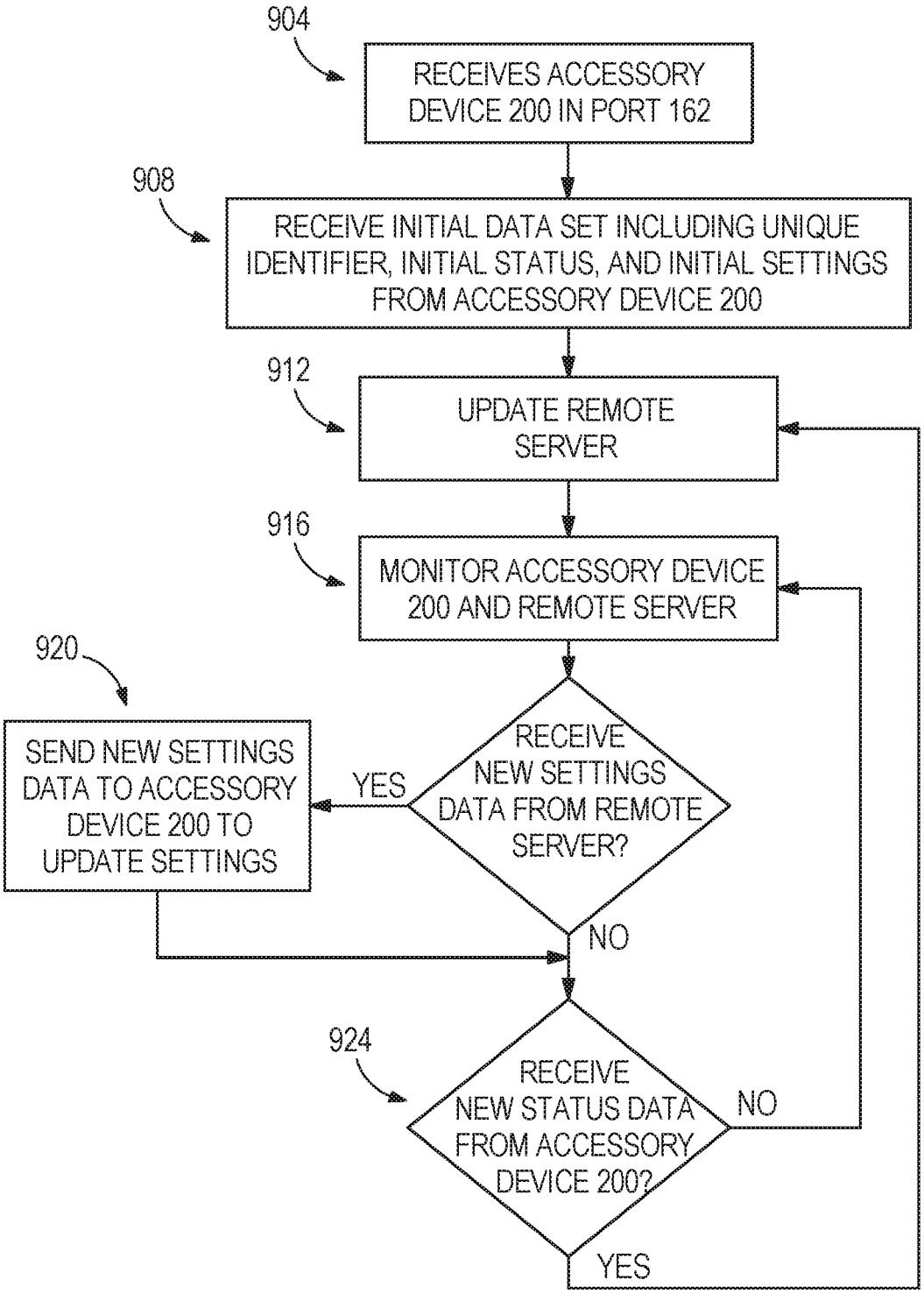
FIG. 31 is a flow chart illustrating a module communication method.

With reference to FIG. 31, the module communication method 900 includes a step 904 in which the garage door opener 100 receives the accessory device 200 in the port 162, as described in detail above. In a step 908, the garage door opener 100 receives the initial data set 850 including the unique identifier 854, the initial statuses 858, and the initial settings 862. The initial data set 850 may be received with the port identifier 848 as well. The initial data set 850 is forwarded to the remote sever 950 (without processing) via the wireless board 176 in a step 912. In other words, the wireless board 176 (and therefore garage door opener 100) acts as a serial pass through device to transmit the data set 850 between the accessory device 200 and the remote server 950. The port identifier 848 may also be transmitted with the initial data set to the remote server 950. Once the data set 850 is uploaded to the remote server 950, a peripheral device 252 may download or otherwise access the data set 850 and furthermore update the settings 862. In step 916, the wireless board 176 monitors the accessory device 200 for changes in the status 858 and monitors the remote server 950 for changes in the settings 862 (e.g., via input from the peripheral device 252). In step 920, the garage door opener 100 determines if the new settings 862 have been received from the remote server 950. If new settings 862 are received, the garage door opener 100 passes the new settings 862 to the accessory device 200 to update the settings of the accessory device 200 (step 922). For example, the garage door opener 100 may pass the new settings 862 to the port identified by the port identifier 848, which may be transmitted with the new settings 862 by the remote server 950. As described above, in response to updated settings 862 received by one of the accessories 200, the accessory 200 may change its operation (e.g., a light or component may be enabled or disabled, a level of operation may be changed, etc.). Whether or not new settings data 862 has been received, the garage door opener 100 proceeds to step 924. In step 924, the garage door opener 100 determines if new status data 858 is received from the accessory device 200. If new status data 858 is received, the garage door opener 100 updates the remote server 950 (step 912). If no new status data 858 is received, the garage door opener 100 continues to monitor the accessory device 200 and the remote server 950 (step 916). In other embodiments, steps 920 and 924 may be reversed, or accomplished concurrently.

Figure 32:
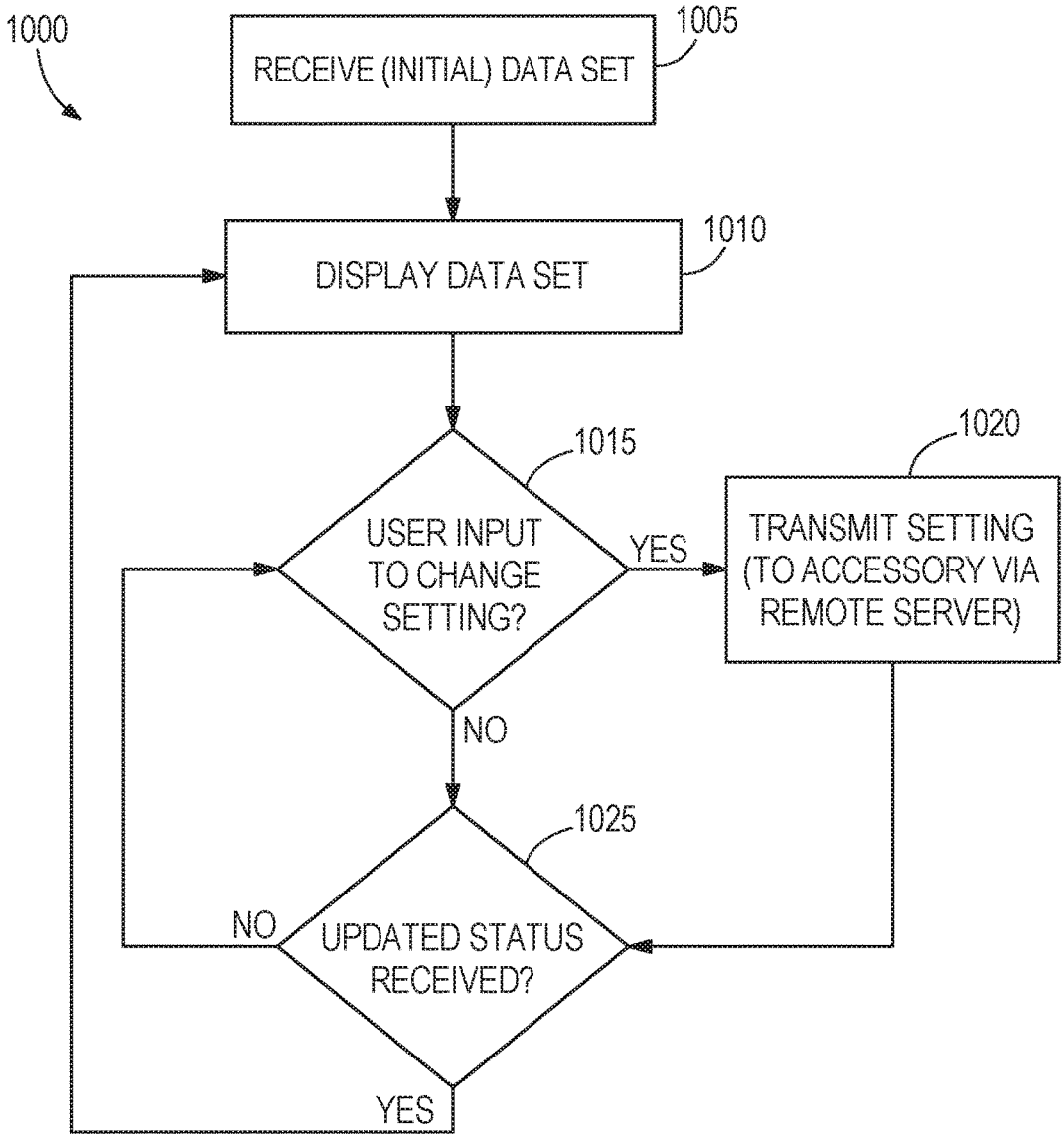
FIG. 32 is a flow chart illustrating a module communication method according to another embodiment of the invention.

FIG. 32 illustrates a peripheral device communication method 1000 for a peripheral device (e.g., the peripheral device 252) to obtain status information from one or more of the accessory devices 200 of the garage door opener 100 and to update settings of one or more of the accessory devices 200. In step 1005, the peripheral device 252 receives the initial data set 850 including the unique identifier 854, the initial statuses 858, and the initial settings 862 information. The retrieval of the initial data set 850 may occur upon start-up of a software application (or, "app") executed on the peripheral device 252 that, for example, includes sending of an initial request to the remote server 950 for the initial data set 850.

In step 1010, at least a portion of the initial data set 850 is displayed on the peripheral device 252. For example, a screen of the peripheral device 252 illustrates the port 162 or 164 associated with the initial data set, the type of the accessory 200 coupled thereto (determined based on the unique identifier 854), the initial status 858, and the initial settings 862. The type of the accessory 200 is determined based on the unique identifier 854, which may serve as an index into a lookup table of unique identifiers matched to accessory types. The lookup table may further be associated with a graphic or icon that is then displayed on the screen in combination with a name (e.g., "fan") of the accessory 200. In one example, a particular unique identifier 854 indicates a lack of an accessory at an associated port, which may also be displayed on the display of the peripheral device 252 in step 1010.

In step 1015, the peripheral device 252 determines whether user input has been received that indicates a request to change an accessory setting. For example, the peripheral device 252 may include a touch screen display illustrating each coupled accessory 200. The peripheral device 252 may receive a user selection of one of the displayed accessories, which leads to a separate accessory screen particular to the type of accessory selected. The accessory screen illustrates the type of accessory, the settings of the accessory, and the statuses of the accessory (e.g., textually, graphically, or both) as determined based on the obtained data set for that accessory. Each setting may have a toggle (e.g., on/off), slider bar, numerical input, radio buttons, or other user input selectors that may be manipulated by a user to provide a setting update request received by the peripheral device 252.

When, in step 1015, the peripheral device 252 determines that user input has been received (e.g., via one of the user input selectors), the peripheral device 252 proceeds to step 1020, where the peripheral device 252 communicates the new setting to the remote server 950. The remote server 950 overwrites the previous setting stored in the data set for the particular accessory with the new setting. As described with respect to method 900, the garage door opener 100 obtains the updated setting from the remote server 950, and, in turn, provides the updated setting to the particular accessory 200 to which the new setting is directed.

The peripheral device 252 proceeds to step 1025 regardless of whether user input is received. In step 1025, the peripheral device 252 determines whether an update to the data set 850 has occurred, such as a new status 858 or new unique identifier 854. When an update to the data set 850 has occurred, the peripheral device 252 returns to step 1010 to display the new data set 850 as described above. When an update to the data set 850 has not occurred, the peripheral device 252 returns to step 1015 to determine whether user input has been received. Accordingly, the peripheral device 252 may loop between steps 1015 and 1025 until either the data set 850 is updated or user input is received.

In some instances, a new setting 858 provided to one of the accessories 200 will cause a status update on the accessory 200, which is then provided to the remote server 950 and eventually displayed on the peripheral device (e.g., step 1010), providing user feedback of a successful settings update on the accessory.

In some embodiments, the data transmitted to/from the remote server 950 by/to the peripheral device 252 and the garage door opener 100, may result from periodic polling of data by one or more of the remote server 950, the peripheral device 252, and the garage door opener 100. For example, with reference to FIG. 32, the peripheral device 252 may poll the remote server 950 each time the step 1025 is reached in the method 1000. In some embodiments, the data transmitted to/from the remote server 950, to/from the peripheral device 252 and the garage door opener 100, may result from pushing of data by one or more of the remote server 950, the peripheral device 252, the garage door opener 100 either periodically or in response to changes in the data to be transmitted (e.g., a unique identifier, a setting, and/or a status). For example, data (e.g., settings data) may be pushed from the peripheral device 252 to the remote server 950 upon a status change (e.g., steps 1015 and 1020), and data (e.g., status data) may be pushed to the peripheral device 252 from the remote server 950 upon a status change received from the garage door opener 100.

While the method 900 and method 1000 of FIGS. 31 and 32, respectively, are generally described with respect to a single accessory 200, the methods and steps therein may be repeated (serially or concurrently) for each accessory 200 and/or port 162,164 of the garage door opener 100. For example, with reference to the method 1000, when obtaining the initial data set in step 1005, the peripheral device may receive the initial data set for each of the ports 162,164, which then may be displayed in step 1010.

In some embodiments, the peripheral device 252, based on received user input, may be used to control the garage door opener 100 to drive the motor 112 to open and shut the garage door. For example, the peripheral device 252 may transmit an open or close request, via the remote server 950, to the wireless board 176. The wireless board 176, in turn, controls the motor 112 in accordance with the request to open or shut the garage door. Additionally, the garage door opener 100 may use a motor 112 position sensor (e.g., Hall sensors or a resolver) to determine the status of the garage door as being either open, shut, or a position between open and shut. The garage door opener 100, via wireless board 176, may then communicate the state of the garage door to the peripheral device 252 for display to a user.

Figure 33:
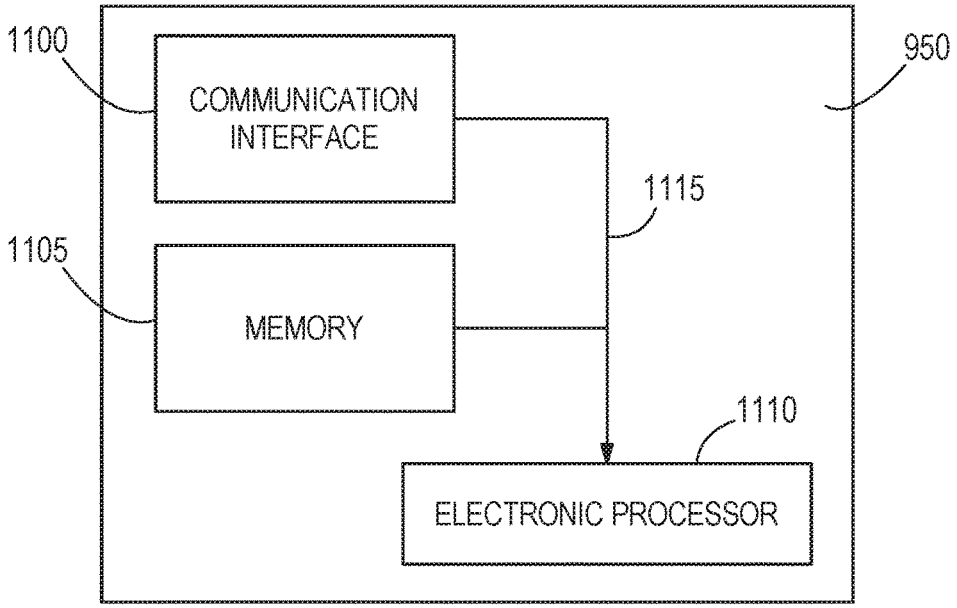
FIG. 33 illustrates a block diagram of a remote server of the data transfer structure of FIG. 30.

FIG. 33 illustrates one exemplary block diagram of the remote server 950 in further detail. As illustrated, the remote server 950 includes a communications circuit 1100, a memory 1105, and an electronic processor 1110 coupled by bus 1115. The communication interface 1100 is coupled to the communication links 1130 and 1135 of FIG. 30 and enables the electronic processor 1100 (and, thereby, the remote server 950) to communicate with the garage door opener 100 and the peripheral device 252. The communication links 1130 may include one or more wired or wireless connections, networks, and protocols including, but not limited to, a local area network (LAN), the Internet, Wi-Fi, cellular, LTE, 3G, Bluetooth, Ethernet, USB, and the like. The memory 1105 stores the accessory information 875, as well as operational data and software. The electronic processor 1110 executes software, which may be stored in the memory 1105, to carry out the functionality of the remote server 950 described herein. For example, the electronic processor 1110 reads and writes the accessory information 875 to the memory 1105. Although illustrated as a single server, the remote server 950 may be implemented by one or more servers co-located or located separately from one another and, for instance, coupled by various communication networks.

Figure 34:
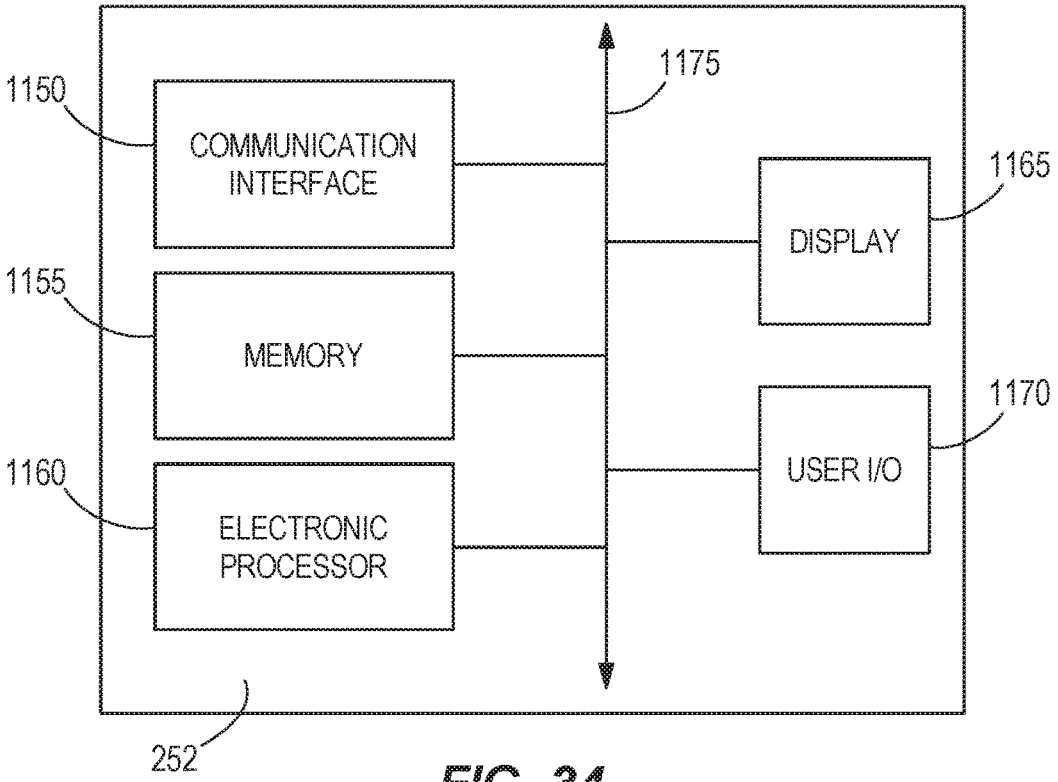
FIG. 34 illustrates a block diagram of a peripheral device of the data transfer structure of FIG. 30.

FIG. 34 illustrates one exemplary block diagram of the peripheral device 252 in further detail. As illustrated, the peripheral device 252 includes a communications circuit 1150, a memory 1155, and an electronic processor 1160, a display 1165, and user input devices 1170 coupled by bus 1175. The communication interface 1150 is coupled to the communication link 1135 of FIG. 30 and enables the electronic processor 1160 (and, thereby, the peripheral device 252) to communicate with the remote server 950 (and, thereby, the garage door opener 100). The electronic processor 1160 executes software, which may be stored in the memory 1155, to carry out the functionality of the peripheral device 252 described herein. For example, the electronic processor 1110 executes the steps of the method 1000 of FIG. 32. The user input devices 1170 include one or more push buttons, toggle switches, speakers, and vibration generators for receiving user input and providing user output. In some embodiments, the display 1165 is a touch screen display and is part of the input/output devices 1170. The display provides visual output, such as shown in FIG. 29, regarding the garage door opener 100 and the accessories 200.

Figure 35:
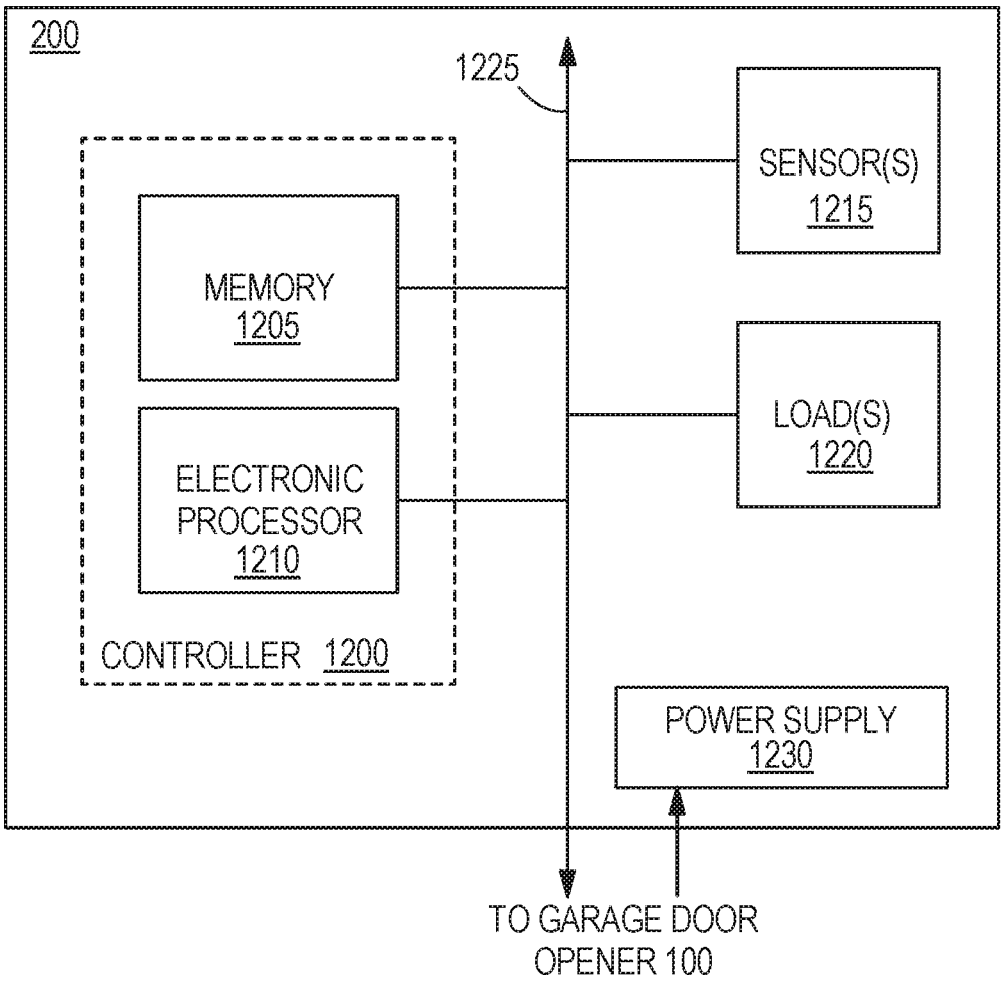
FIG. 35 illustrates a block diagram of an accessory device of the data transfer structure of FIG. 30.

FIG. 35 illustrates one exemplary block diagram of one of the accessory devices 200 in detail. As illustrated, the accessory device 200 includes a controller 1200 having a memory 1205 and an electronic processor 1210, one or more sensors 1215 (e.g., temperature sensors, humidity sensors, and carbon monoxide sensors, etc.) and one or more loads 1220 (e.g., indicators, speakers, a motor, a power relay, a park-assist laser light, a light, and a compressor) coupled by a bus 1225. The controller 1200 is coupled to the garage door opener 100 via the electrical mounting interface 400 to enable data communications between the controller 1200 and the garage door opener 100 and to provide power to the accessory 200. In particular, the power supply 1230 receives conditions and filters power from the garage door opener 100, and provides the power to the other components of the accessory 200. The controller 1200 executes software, which may be stored in memory 1205, to carry out the function of the accessory device described herein. The memory 1205 may also store the data set 850 for the accessory. The particular sensors 1215, loads 1220, and functionality of the controller 1200 varies depends on the type of accessory 200. In one example, the accessory device 200 is the extension cord reel 220. The extension cord reel 220 includes the controller 1200 having the memory and the electronic processor 1210, and one or more loads 1220 (i.e., an AC output with a relay). In this example, the controller 1200 operates the relay of the load 1220 (i.e., the AC output) to selectively allow or prevent the delivery of electricity to power outlets 230—that is, the controller 1200 can turn the power outlets 230 on and off based on communications received from the garage door opener 100 or the peripheral device 252.

Figure 36:
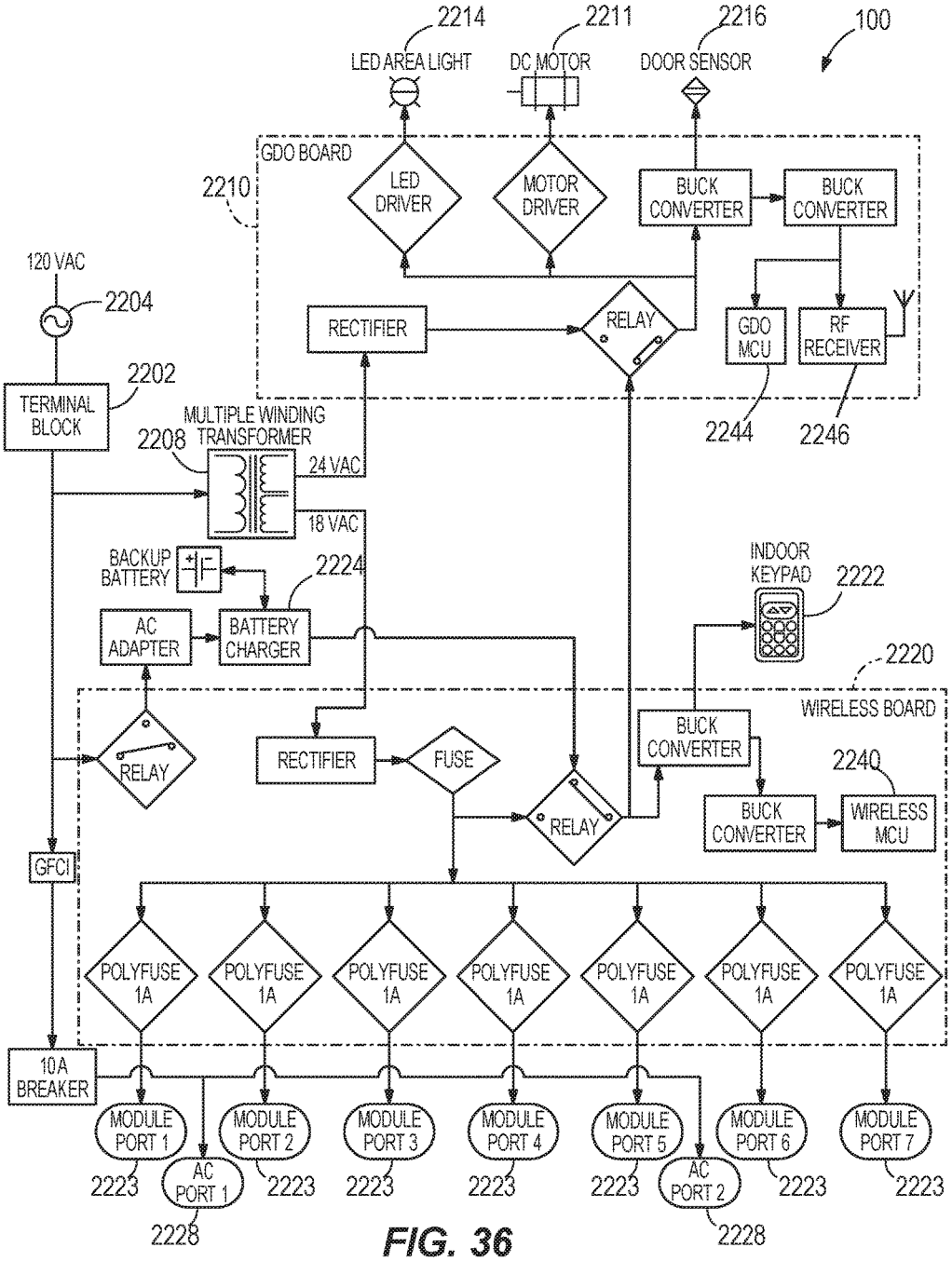
FIG. 36 is a schematic of a garage door opener according to a second embodiment of the invention.

FIG. 36 illustrates an alternative embodiment of a block power diagram of the garage door opener 100. The garage door opener 100 includes a terminal block 2202 configured to receive power from an external power source 2204, such as a standard 120 VAC power outlet. The terminal block 2202 directs power, via a transformer 2208, to a garage door opener (GDO) board 2210 for supply to components thereof as well as a motor 2211 (used to drive a drive mechanism 2116 in a similar manner as described above), LEDs 2214

(of the light unit 2152), and garage door sensors 2216. The terminal block 2202 further directs power via the transformer 2208 to a wireless board 2220 and components thereof, as well as a wired keypad 2222 and module ports 2223. The terminal block 2202 also directs power to a battery charger 2224 and to AC ports 2228, which may be referred to as pass-through outlets. The module ports 2223 are configured to receive the various accessory devices 200, such as the speaker, the fan, the extension cord reel, the parking assist laser, the environmental sensor, the flashlight, and a security camera. One or more of the accessory devices 200 are selectively attachable to and removable from the garage door opener 100, and may be monitored and controlled by the garage door opener 100 as previously described above.

The wireless board 2220 includes a wireless microcontroller 2240, among other components. Additionally, similar to the wireless board 176, and with reference to FIG. 6, the wireless board 2220 is configured to communicate with the network hub 948, the wireless network 952 (e.g., including the remote server 950), the peripheral device 252, the wall-mounted keypad 2222, and the accessory devices 200. The GDO board 2210 includes, among other components, a garage door opener (GDO) microcontroller 2244 and a radio frequency (RF) transceiver 2246. The communication diagram of FIG. 7 similarly applies to the diagram of FIG. 36 in that, for example, the GDO board 2210 may substitute for the GDO board 168, and the wireless board 2220 may substitute for the wireless board 176. Accordingly, the GDO board 2210 is in communication with the wireless board 2220 (e.g., via a multiplexer) and is configured to actuate operation of the motor 2221 based on communications received from, for example, the wireless board 2220, the peripheral device 252, the door sensors 700, the car remote 253, and the outdoor keypad 248.

The GDO board 2210 and the wireless board 2220 may also be referred to as a controller of the garage door opener, with the controller including an electronic processor and memory storing instructions. The electronic processor executes the instructions to carry out the functionality of the GDO board 2210 and the wireless board 2220 described herein and, more generally, the control functionality of the garage door opener 100 described herein. An example of a similarly configured controller having an electronic processor and memory, albeit for a battery pack, is illustrated in FIG. 10 as controller 1355.

Various features of the invention are set forth in the following claims.

What is claimed is:

1. A modular garage door opener comprising:

a motor configured to drive a garage door to open and close;

an accessory port, the accessory port configured to be removably coupled to an accessory device such that the garage door opener is in electrical communication with the accessory device via the accessory port;

a controller including an electronic processor coupled to a memory having instructions executable by the electronic processor, the controller configured to:

receive new status data from the accessory device indicating a change in a status of the accessory device to a new status;

send the new status data to a remote server to update an accessory data set;

receive new settings data from the remote server indicating a requested change in a setting of the accessory device; and send the new settings data to the accessory device to update the setting of the accessory device for controlling a load of the accessory device.

2. The modular garage door opener of claim 1, wherein the controller is further configured to:

receive, from the accessory device in response to coupling of the accessory device to the accessory port, an initial data set including a unique identifier for the accessory device, an initial status indicating the status of the accessory device, and an initial setting indicating the setting of the accessory device, and send the initial data set, to the remote server, for storage as the accessory data set.

3. The modular garage door opener of claim 1, wherein the accessory device is at least one selected from the group of a speaker, a fan, an extension cord reel, an environmental sensor, a park-assist laser, a light, an inflator, and an inflator cord reel.

4. The modular garage door opener of claim 1, wherein the load of the accessory device is at least one selected from the group of a speaker circuit, a motor, a power relay, a park-assist laser light, a light, and a compressor.

5. The modular garage door opener of claim 1, wherein:

a second accessory device is removably coupled to the accessory port in the absence of the accessory device such that the second accessory device is in electrical communication with the accessory port; and the controller is further configured to:

receive from the second accessory device a second initial data set including a second unique identifier for the second accessory device, a second initial status indicating a second status of the second accessory device, and a second initial setting indicating a second setting of the second accessory device;

send the second initial data set to the remote server for storage as a second accessory data set;

receive second new status data from the second accessory device indicating a change in the second status of the second accessory device to a second new status;

send the second new status data to the remote server to update the second accessory data set;

receive second new settings data from the remote server indicating a second requested change in the second setting of the second accessory device; and send the second new settings data to the second accessory device to update the second setting of the second accessory device.

6. The modular garage door opener of claim 1, wherein the initial data set is stored in a memory of the accessory device.

7. The modular garage door opener of claim 1, wherein the garage door opener further includes a second accessory port that removably receives the accessory device and the controller is further configured to:

receive, from the accessory device via the second accessory port, the initial data set; and send the initial data set to the remote server.

8. The modular garage door opener of claim 7, wherein the controller is further configured to:

receive, from the accessory device via the second accessory port, a further status data set indicating that the status of the accessory device is a further status;

send the further status data set to the remote server;

receive, from the remote server, a further settings data set; and send, to the accessory device via the second accessory port, the further settings data set to update the setting of the accessory device and, thereby, control the load of the accessory device.

9. An accessory device for a garage door opener, the accessory device comprising:

a mechanical interface configured to be removably coupled to an accessory port of a garage door opener;

an electrical interface configured to be in electrical communication with the garage door opener via the accessory port, wherein the electrical interface receives power from the garage door opener via the accessory port upon being coupled to the accessory port;

a load;

a controller including an electronic processor and a first memory, the controller being coupled to the load, and wherein the controller is configured to:

send, to the garage door opener via the electrical interface, an initial data set including a unique identifier for the accessory device, an initial status indicating a status of the accessory device, and an initial setting indicating a setting of the accessory device;

receive new settings data from the garage door opener to update the setting of the accessory device;

control the load of the accessory device in response to the new settings data; and send new status data to the garage door opener, the new status data indicating a change in the status of the accessory device to a new status.

10. The accessory device of claim 9, wherein:

the electrical interface receives power from a second accessory port of the garage door opener upon being decoupled from the accessory port and coupled to the second accessory port; and the controller is configured to:

send the initial data set to the garage door opener;

receive second settings data from the garage door opener to update the setting of the accessory device;

control the load of the accessory device in response to the second settings data; and send second status data to the garage door opener indicating a change in the status of the accessory device to a second status.

11. The accessory device of claim 9, wherein the accessory device is at least one selected from the group of a speaker, a fan, an extension cord reel, an environmental sensor, a park-assist laser, a light, an inflator, and an inflator cord reel.

12. The accessory device of claim 9, wherein the load of the accessory device is at least one selected from the group of a speaker circuit, a motor, a power relay, a park-assist laser light, a light, and a compressor.

13. A communication method for a garage door opener including an accessory port configured to receive an accessory device, the method comprising:

receiving, by the garage door opener, the accessory device in the accessory port;

receiving, by an electronic processor of the garage door opener, status data from the accessory device indicating a change in status of the accessory device to a new status;

sending, by the electronic processor, the status data to a remote server to update an accessory data set;

receiving, by the electronic processor, settings data from the remote server indicating a requested change in a setting of the accessory device; and sending, by the electronic processor, the settings data to the accessory device to update the setting of the accessory device.

14. The communication method of claim 13, wherein a unique identifier is received, by the electronic processor, with the status data from the accessory device, the unique identifier indicating a type of the accessory device.

15. The communication method of claim 13, wherein the accessory device is at least one selected from the group of a speaker, a fan, an extension cord reel, an environmental sensor, a park-assist laser, a light, an inflator, and an inflator cord reel.

16. The communication method of claim 13, wherein the settings data received from the remote server is received in response to user input received by a peripheral device in communication with the remote server.

17. The communication method of claim 13, further comprising controlling, by an electronic processor of the accessory device, a load of the accessory device in response to the new settings data.

18. The communication method of claim 13, further including:

receiving, by the garage door opener, a second accessory device in a second accessory port;

receiving second status data from the second accessory device indicating a change in the second status of the second accessory device to a second new status;

sending the second status data to the remote server to update a second accessory data set;

receiving second settings data from the remote server indicating a second requested change in a second setting of the second accessory device; and sending the second settings data to the second accessory device to update the second setting of the second accessory device.

19. The communication method of claim 18, wherein:

the accessory device is selected from the group of a speaker, a fan, an extension cord reel, an environmental sensor, a park-assist laser, a light, an inflator, and an inflator cord reel, and the second accessory device is different from the first accessory device, wherein the second accessory device is selected from the group of a speaker, a fan, an extension cord reel, an environmental sensor, a park-assist laser, a light, an inflator, and an inflator cord reel.

20. The communication method of claim 18, further comprising:

after the second accessory device is disconnected from the second accessory port and the accessory device is disconnected from the accessory port:

receiving the accessory device in the second accessory port and receiving the second accessory device in the accessory port, receiving, from the accessory device via the second accessory port, an initial data set;

receiving, from the second accessory device via the accessory port, a second initial data set; and sending the initial data set and the second initial data set to the remote server.

* * * * *